US009842453B2

(12) United States Patent
Hemmi et al.

(10) Patent No.: US 9,842,453 B2
(45) Date of Patent: Dec. 12, 2017

(54) BANKNOTE PROCESSING DEVICE

(71) Applicant: FUJI ELECTRIC CO., LTD., Kawasaki-shi, Kanagawa (JP)

(72) Inventors: Toshinori Hemmi, Yokkaiti (JP); Toshinori Shigeyama, Mie (JP); Masao Nakayama, Yokkaiti (JP); Masayuki Higashi, Yokkaiti (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 15/343,931

(22) Filed: Nov. 4, 2016

(65) Prior Publication Data

US 2017/0140599 A1 May 18, 2017

(30) Foreign Application Priority Data

| | | |
|---|---|---|
| Nov. 13, 2015 | (JP) | 2015-223191 |
| Dec. 1, 2015 | (JP) | 2015-235009 |
| Dec. 1, 2015 | (JP) | 2015-235160 |
| Dec. 1, 2015 | (JP) | 2015-235161 |
| May 11, 2016 | (JP) | 2016-095457 |
| May 11, 2016 | (JP) | 2016-095458 |
| May 11, 2016 | (JP) | 2016-095459 |
| May 11, 2016 | (JP) | 2016-095460 |

(51) Int. Cl.
*G07D 11/00* (2006.01)

(52) U.S. Cl.
CPC ..... *G07D 11/0096* (2013.01); *G07D 11/0018* (2013.01); *G07D 11/0084* (2013.01)

(58) Field of Classification Search
CPC ..... G07D 11/0006; G07D 11/0009; G07D 11/0012; G07D 11/0018; G07D 11/0096; G07D 11/0081; G07D 11/0084; G07D 11/0021
See application file for complete search history.

(56) References Cited

U.S. PATENT DOCUMENTS 6,454,163 B2 * 9/2002 Peebles ..... G07D 11/0018 235/379
2002/0162775 A1 * 11/2002 Saltsov ..... H01J 49/025 209/213

FOREIGN PATENT DOCUMENTS

| | | |
|---|---|---|
| JP | 2004-258993 A | 9/2004 |
| JP | 2011-65417 A | 3/2011 |
| JP | 2014-052731 A | 3/2014 |

* cited by examiner

*Primary Examiner* — Mark Beauchaine
(74) *Attorney, Agent, or Firm* — Manabu Kanesaka

(57) ABSTRACT

A banknote processing device includes: a plurality of storage units configured to store a banknote having a predetermined condition in a storage unit corresponding to the banknote among the plurality of storage units when the banknote is fed through a depositing port provided on a device main body; and a dispensing box configured to discharge the banknote through a dispensing port provided on the dispensing box by conveying the banknote, which is sent from the storage unit, to the dispensing box when a dispensing instruction is given. The dispensing box is configured to collect the banknote being stored in the storage units when a collecting instruction is given.

10 Claims, 46 Drawing Sheets

BANKNOTE PROCESSING DEVICE

CROSS-REFERENCE TO RELATED APPLICATION(S)

The present application claims priority to and incorporates by reference the entire contents of Japanese Patent Application No. 2015-223191 filed in Japan on Nov. 13, 2015, Japanese Patent Application No. 2015-235009 filed in Japan on Dec. 1, 2015, Japanese Patent Application No. 2015-235160 filed in Japan on Dec. 1, 2015, Japanese Patent Application No. 2015-235161 filed in Japan on Dec. 1, 2015, Japanese Patent Application No. 2016-095457 filed in Japan on May 11, 2016, Japanese Patent Application No. 2016-095458 filed in Japan on May 11, 2016, Japanese Patent Application No. 2016-095459 filed in Japan on May 11, 2016, and Japanese Patent Application No. 2016-095460 filed in Japan on May 11, 2016.

BACKGROUND OF THE INVENTION

1. Field of the Invention

The disclosure relates to a banknote processing device, and more particularly, relates to a banknote processing device that is applied as a banknote changing machine, for example.

2. Description of the Related Art

Conventionally, in a banknote processing device that is applied as a banknote changing machine, for example, banknotes that are fed into a disposing unit through a feeding port being formed on a device main body are conveyed to a predetermined conveyance path, and the authenticity of the banknotes being conveyed through the conveyance path is discriminated by a discriminating unit.

In the banknote processing device, the banknotes that are discriminated as "genuine" by the discriminating unit described above are separated from the conveyance path, and are stored in a predetermined storage unit. Also, in the banknote processing device, when a dispensing instruction is given, the banknotes that are sent from the predetermined storage unit are discharged from the device main body, by conveying the banknotes to a dispensing box through the conveyance path described above (for example, see Japanese Patent Application Laid-open No. 2011-65417).

Although not specified in Japanese Patent Application Laid-open No. 2011-65417 described above, in the banknote processing device, a collecting unit is generally provided in the device main body. The collecting unit is detachably provided in the device main body.

In the banknote processing device that includes the collecting unit as described above, when a collecting instruction is given, the banknotes that are stored in the storage units are conveyed to the collecting unit through the conveyance path described above, and are collected by the collecting unit. The banknotes that are collected by the collecting unit in this manner are removed from the device main body together with the collecting unit, and will be stored in a predetermined safe and the like.

In recent years, there is a demand for reducing the overall size of the banknote processing device. However, in the banknote processing device described above, the collecting unit is separately provided from a depositing unit and a dispensing box. Thus, not only space for the depositing unit, the dispensing box, and the storage unit, but also space for the collecting unit is required in the device main body. As a result, it is difficult to reduce the overall size of the device.

SUMMARY OF THE INVENTION

It is an object of the present invention to at least partially solve the problems in the conventional technology.

In some embodiments, a banknote processing device includes: a plurality of storage units configured to store a banknote having a predetermined condition in a storage unit corresponding to the banknote among the plurality of storage units when the banknote is fed through a depositing port provided on a device main body; and a dispensing box configured to discharge the banknote through a dispensing port provided on the dispensing box by conveying the banknote, which is sent from the storage unit, to the dispensing box when a dispensing instruction is given. The dispensing box is configured to collect the banknote being stored in the storage units when a collecting instruction is given.

In some embodiments, a banknote processing device includes: a depositing unit into which a banknote is deposited through a depositing port; a discriminating unit configured to discriminate authenticity and denomination of the banknote that is conveyed from the depositing unit; and a distribution gate member provided corresponding to a storage unit of each denomination and configured to distribute the banknote being discriminated as genuine by the discriminating unit to the storage unit corresponding to the denomination of the banknote. The discriminating unit is configured to discriminate the authenticity and denomination of the banknote that passes through an inclination path being gradually inclined upward as the inclination path is away from an outlet of the depositing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Preferred embodiments of a banknote processing device according to the disclosure will now be described in detail with reference to the accompanying drawings.

First Embodiment

Figure 1:
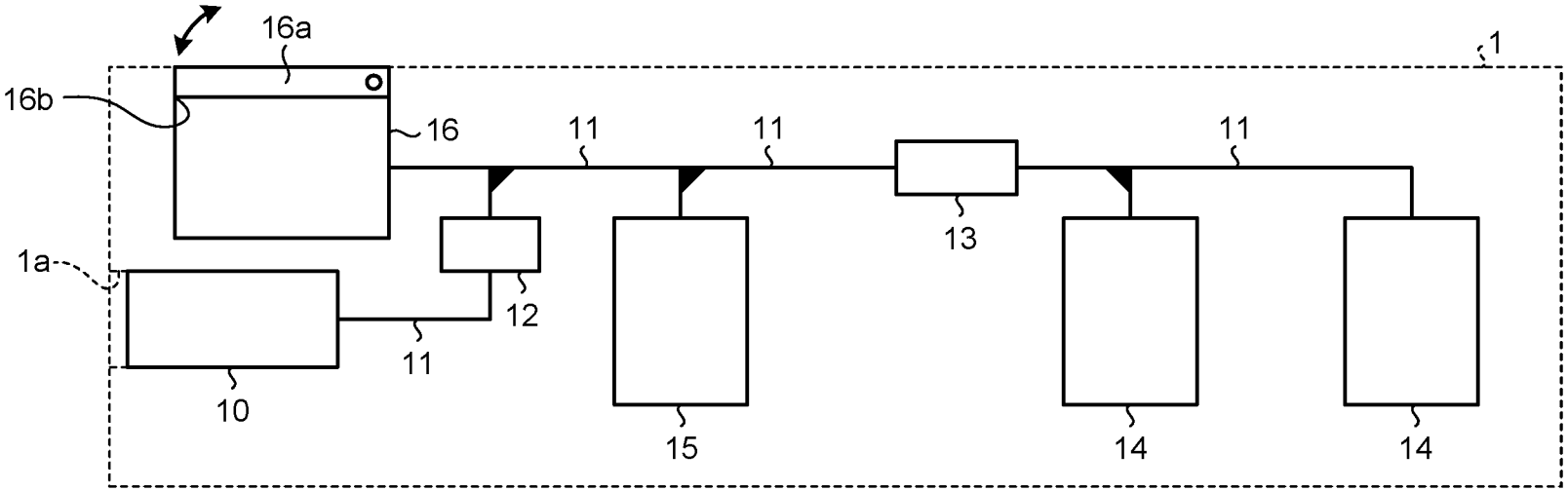
FIG. 1 is an explanatory diagram schematically illustrating a banknote processing device of a first embodiment of the disclosure.

FIG. 1 is an explanatory diagram schematically illustrating a banknote processing device of a first embodiment of the disclosure. The banknote processing device illustrated in this example is applied as a banknote changing machine, for example, and includes a device main body 1. The device main body 1 includes a depositing box 10, a conveyance path 11, a discriminating unit 12, a determining unit 13, a plurality of storage boxes (storage units) 14, a checking box 15, and a dispensing box 16.

The depositing box 10 is communicably connected to a depositing port 1*a* formed on the device main body 1. In this example, the depositing port 1*a* is an opening that is opened and closed by a depositing door, which is not illustrated. The depositing box 10 delivers banknotes being fed therein through the depositing port 1*a*, to the conveyance path 11.

The conveyance path 11 extends in the front-to-rear direction inside the device main body 1. Although not illustrated, the conveyance path 11 is formed by a pair of left and right conveyance belts being stretched over a plurality of conveyance pulleys. The conveyance path 11 is a path that conveys the banknotes from the front toward the rear, and also conveys the banknotes from the rear toward the front.

The discriminating unit 12 is placed in the middle of the conveyance path 11. This discriminating unit 12 is a conventionally known discriminating unit, and discriminates the authenticity and denomination of the banknotes that are delivered from a depositing unit to the conveyance path 11.

The discrimination result by the discriminating unit 12 is given to a control unit, which is not illustrated, as a discrimination signal.

The determining unit 13 is placed in the middle of the conveyance path 11 in the rear side of the discriminating unit 12. The determining unit 13 is a conventionally known determining unit, and determines the denomination and number of the banknotes that pass therethrough. The determination result by the determining unit 13 is given to the control unit as a determination signal.

The storage boxes 14 are provided for each denomination in the rear side of the determining unit 13. Each of the storage boxes 14 stores therein the banknotes of the designated denomination, based on the discrimination result of the discriminating unit 12. The storage box 14 also delivers the stored banknotes to the conveyance path 11, based on an instruction from the control unit.

The checking box 15 is placed in the front side of the determining unit 13. Upon performing a checking process, which will be described below, the checking box 15 stores therein the banknotes, and delivers the stored banknotes to the conveyance path 11.

The dispensing box 16 is detachably provided at the front side of the device main body 1 and above the depositing box 10. The dispensing box 16 includes a dispensing port 16*b* that is opened and closed by a dispensing door 16*a*. In other words, the dispensing door 16*a* of the dispensing box 16 is exposed to the outside of the device main body 1. When the dispensing door 16*a* swings to open, the dispensing port 16*b* is opened, and the inside of the dispensing box 16 is exposed to the outside of the device main body 1. The dispensing box 16 as described above accommodates the banknotes that are conveyed through the conveyance path 11. Thus, the accommodated banknotes can be taken out from the dispensing port 16*b*.

As described above, the dispensing box 16 is detachably provided in the device main body 1. However, when the dispensing box 16 is provided in the device main body 1 as illustrated in FIG. 1, the dispensing box 16 cannot be removed from the device main body 1, as long as an exclusive input operation, an operation of inserting an ejection key, which is not illustrated, into a predetermined ejection key hole (not illustrated), or the like is carried out. In other words, the dispensing box 16 cannot be easily removed from the device main body 1.

When the dispensing box 16 is provided in the device main body 1, the dispensing door 16*a* swings to open and close by an instruction from the control unit. When the dispensing box 16 is removed from the device main body 1, the dispensing door 16*a* always closes the dispensing port 16*b*. The state of the dispensing port 16*b* being closed is released and the dispensing door 16*a* can swing to open, when an operation of inserting a releasing key, which is not illustrated, into a predetermined releasing key hole (not illustrated), or the like is carried out.

An operation of the banknote processing device having the configuration described above will now be explained. First, a depositing operation will be described.

Figure 2:
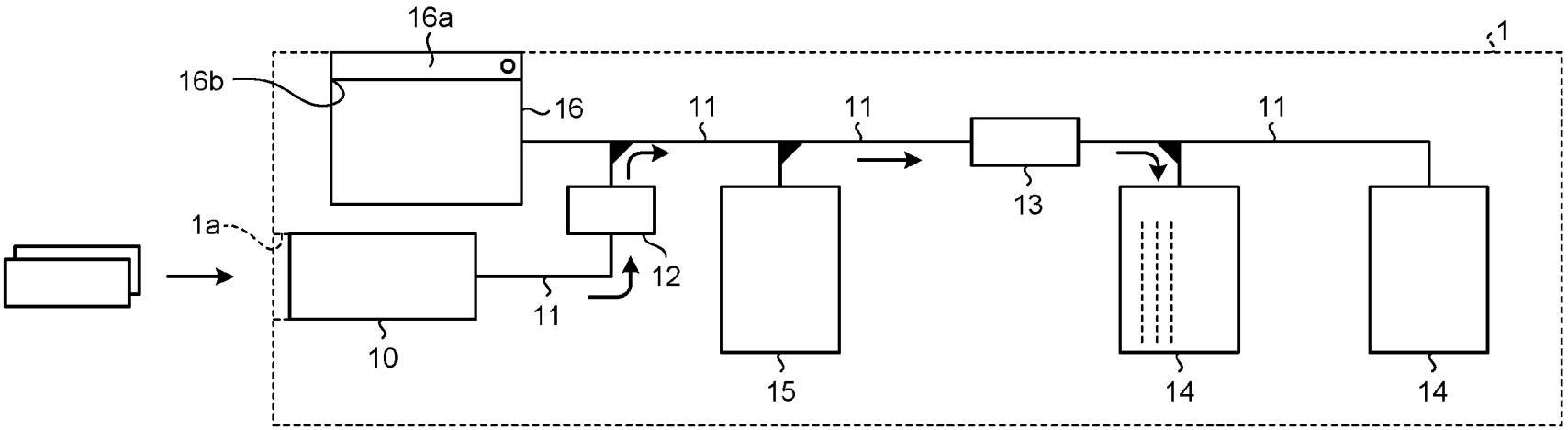
FIG. 2 is an explanatory diagram explaining a case when the banknote processing device illustrated in FIG. 1 performs a depositing operation.

When banknotes are fed into the depositing box 10 through the depositing port 1*a*, and the user performs an input operation on an input unit, which is not illustrated, to give a depositing instruction, as illustrated in FIG. 2, the banknote processing device delivers the banknotes, which are fed into the depositing box 10, to the conveyance path 11 for conveyance, by driving the conveyance pulley and the like. The banknote processing device that has conveyed the banknotes through the conveyance path 11 causes the discriminating unit 12 to discriminate the authenticity and denomination of the banknotes being conveyed, in the course of conveyance.

When the discriminating unit 12 discriminates that the banknotes are "genuine" and discriminates the denomination of the banknotes, the banknote processing device conveys the discriminated banknotes to the predetermined storage box 14 that is designated for each denomination through the conveyance path 11, and stores the banknotes in the storage box 14.

Figure 3:
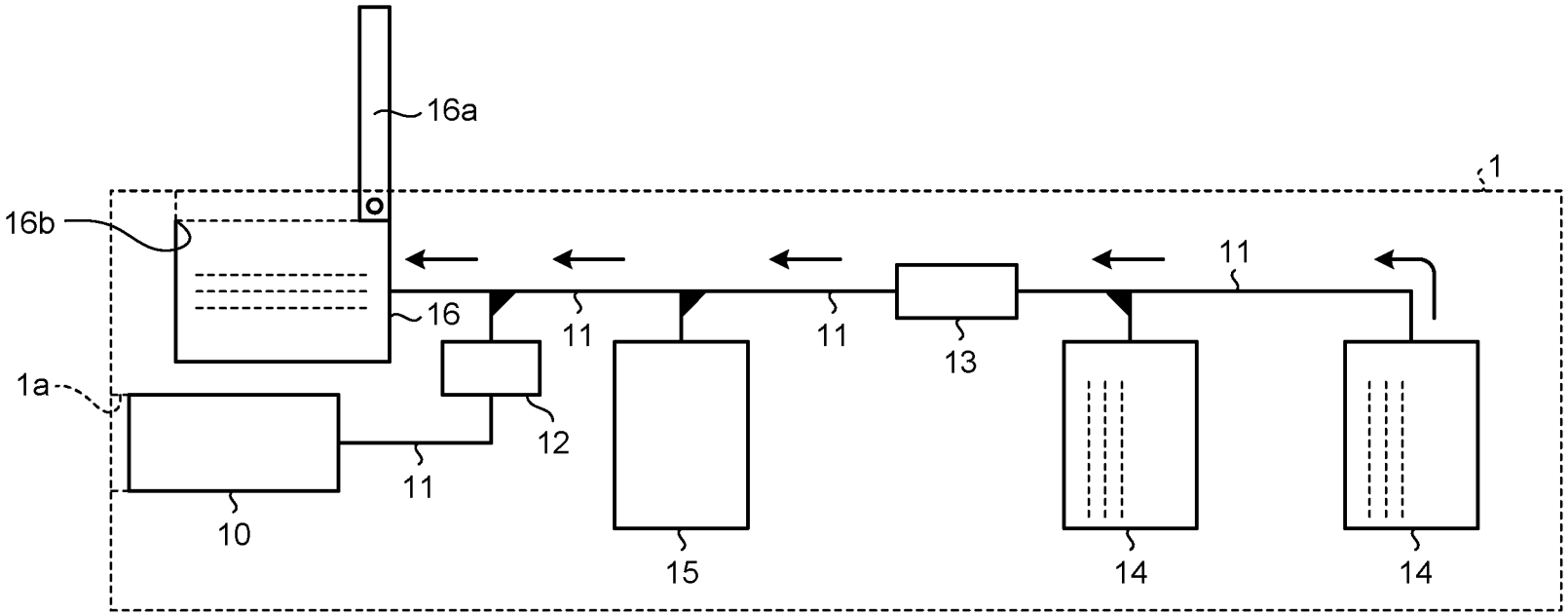
FIG. 3 is an explanatory diagram explaining a case when the banknote processing device illustrated in FIG. 1 performs a dispensing operation.

Next, a dispensing operation will be described. When a user performs an input operation on the input unit to give a depositing instruction, as illustrated in FIG. 3, the banknote processing device delivers the banknotes, which are stored in the predetermined storage box 14, to the conveyance path 11 for conveyance, by driving the conveyance pulley and the like. The banknote processing device that has conveyed the banknotes through the conveyance path 11 causes the determining unit 13 to determine the denomination and number of the banknotes being conveyed, in the course of conveyance.

After the denomination or the like is determined by the determining unit 13, the banknote processing device conveys the determined banknotes to the dispensing box 16 through the conveyance path 11, and stores the banknotes in the dispensing box 16. When a dispensing preparation is completed by storing a predetermined number of banknotes in the dispensing box 16 in this manner, the banknote processing device causes the control unit to open the dispensing port 16*b* by swinging and opening the dispensing door 16*a*. The banknote processing device then discharges the banknotes that are stored in the dispensing box 16 so that the banknotes can be retrieved therefrom.

Figure 4:
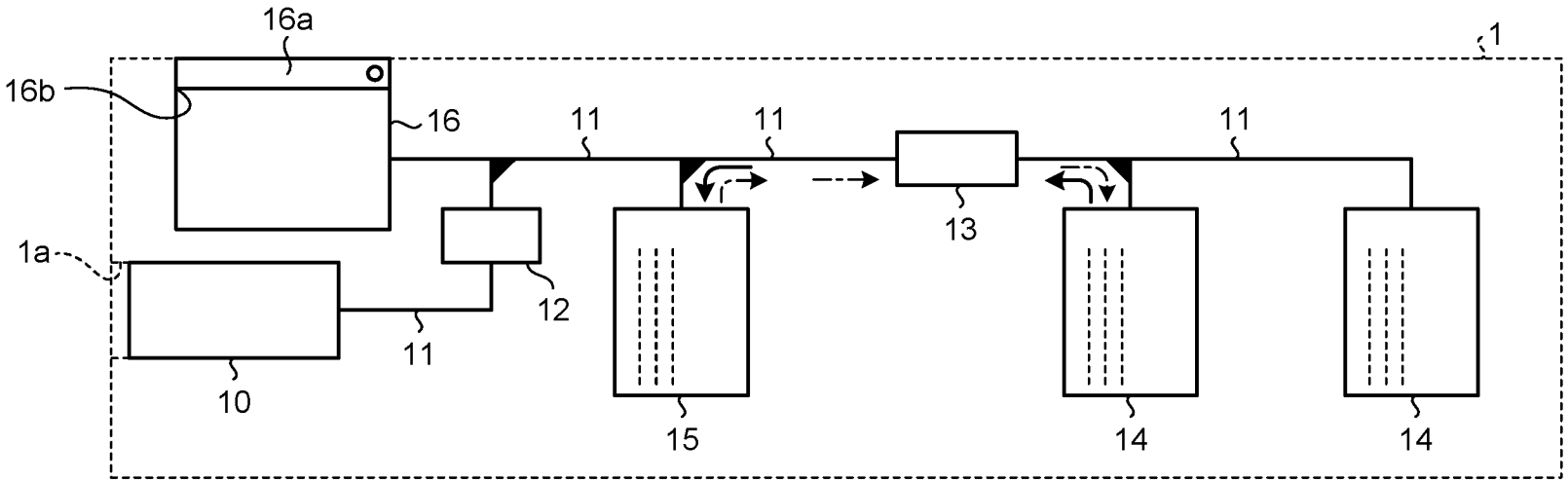
FIG. 4 is an explanatory diagram explaining a case when the banknote processing device illustrated in FIG. 1 performs a checking operation.

A checking operation will now be described. When a manager or the like performs an input operation on an input unit for the manager (not illustrated) to give a checking instruction, as illustrated in FIG. 4, the banknote processing device delivers the banknotes, which are stored in the predetermined storage box 14, to the conveyance path 11, causes the conveyance path 11 to convey the banknotes forward, and stores the banknotes in the checking box 15, by driving the conveyance pulley and the like.

After the banknotes of a predetermined denomination are stored in the checking box 15 in this manner, the banknote processing device delivers the banknotes from the checking box 15 to the conveyance path 11, and causes the conveyance path 11 to convey the banknotes toward the rear, by driving the conveyance pulley and the like. The banknote processing device then causes the determining unit 13 to determine the denomination and number of the banknotes being conveyed, in the course of conveyance, and stores the determined banknotes in the original storage box 14. In this manner, the number of the banknotes that are stored in the storage box 14 can be counted and checked.

Figure 5:
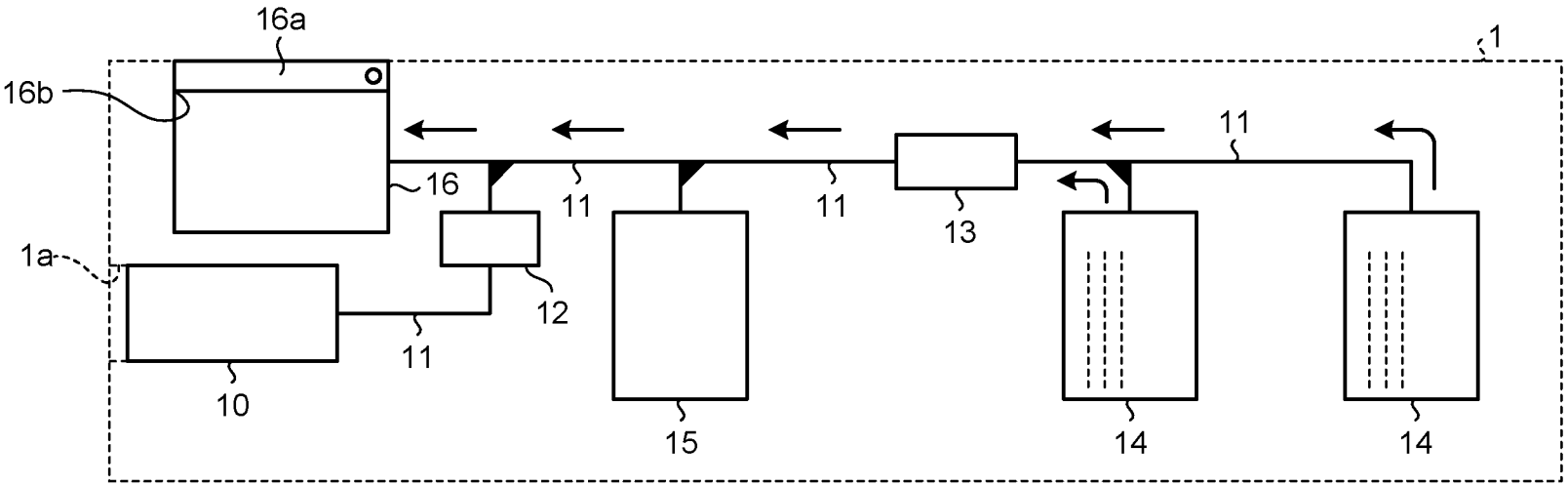
FIG. 5 is an explanatory diagram explaining a case when the banknote processing device illustrated in FIG. 1 performs a collecting operation.

Finally, a collecting operation will now be described. When the manager or the like performs an input operation on the input unit for the manager to give a collecting instruction, as illustrated in FIG. 5, the banknote processing device delivers the banknotes, which are stored in all the storage boxes 14, to the conveyance path 11, causes the conveyance path 11 to convey the banknotes forward, and stores the banknotes in the dispensing box 16, by driving the conveyance pulley and the like. In the dispensing box 16, the dispensing port 16*b* is always in a closed state of the dispensing door 16*a*, based on an instruction from the control unit, and the closed state can only be released by performing an operation of inserting the releasing key into the releasing key hole.

Figure 6:
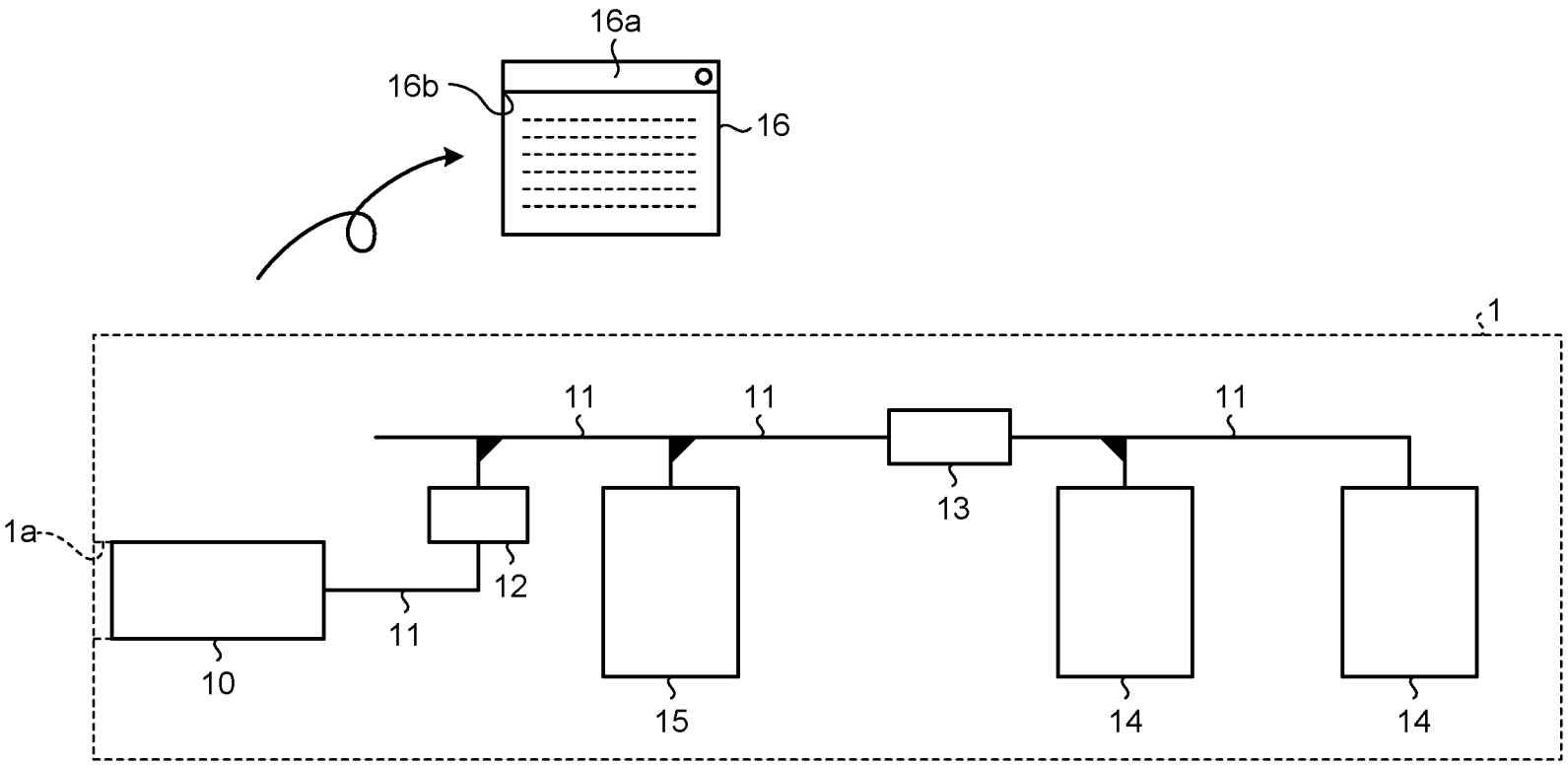
FIG. 6 is an explanatory diagram explaining a case when the banknote processing device illustrated in FIG. 1 performs the collecting operation.

In this manner, when the banknotes in all the storage boxes 14 are stored in the dispensing box 16, as illustrated in FIG. 6, the banknote processing device allows the dispensing box 16 to be removed from the device main body 1, by performing the operation of inserting the ejection key into the ejection key hole. The dispensing box 16 that is removed in this manner will be stored in a safe managed by the manager.

In the banknote processing device of the first embodiment having the above configuration, the dispensing box 16 collects the banknotes that are stored in the storage boxes 14 when a collecting instruction is given. Thus, the dispensing box 16 also functions as a conventional collection box. In this manner, the installation space of the collection box can be reduced, thereby reducing the overall size of the device.

In the banknote processing device described above, the dispensing box 16 is detachably provided in the device main body 1. Thus, the dispensing box 16 can be stored in the predetermined safe and the like as a whole, by removing the dispensing box 16 from the device main body 1, after the banknotes that are stored in the storage boxes 14 are stored in the dispensing box 16. Consequently, there is no need to take out the banknotes from the dispensing box 16, thereby improving the security.

In the banknote processing device described above, the depositing box 10 is disposed below the dispensing box 16. Thus, the banknotes that are fed into the depositing box 10 need to be temporarily conveyed upward. Consequently, a sufficient distance can be secured between the depositing box 10 and the discriminating unit 12. As a result, the length of the conveyance path 11 in the front-to-rear direction can be reduced, thereby further reducing the overall size of the device.

Second Embodiment

Figure 7:
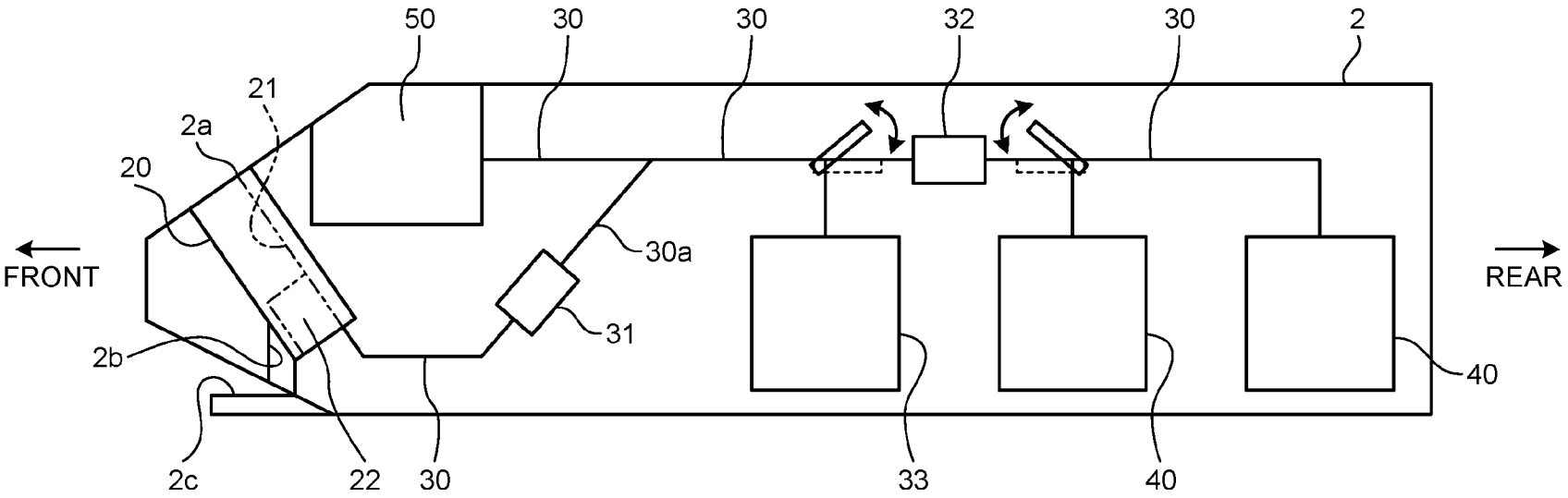
FIG. 7 is an explanatory diagram schematically illustrating a banknote processing device of a second embodiment of the disclosure.

FIG. 7 is an explanatory diagram schematically illustrating a banknote processing device of a second embodiment of the disclosure. The banknote processing device illustrated in this example is applied as a banknote changing machine, for example, and includes a device main body 2 and a dispensing box 50.

The device main body 2 includes a depositing unit 20, a discriminating unit 31, a determining unit 32, and storage units 40. The depositing unit 20 is provided at a front end portion of the device main body 2, and includes a depositing path 21 and a conveyance and distribution mechanism 22.

The depositing path 21 is communicably connected to a depositing port 2*a* formed on the device main body 2, and is gradually inclined downward as the depositing path 21 is away from the depositing port 2*a*. In other words, the depositing path 21 is gradually inclined downward toward the rear. The downstream side of the depositing path 21 is connected to a conveyance path 30.

In this example, the conveyance path 30 conveys the banknotes that have passed through the depositing path 21, and extends along the front-to-rear direction in the device main body 2. More specifically, the conveyance path 30 has an inclination path 30*a* that is gradually inclined upward toward the rear from the portion where the conveyance path 30 is connected to the depositing path 21. In other words, the inclination path 30*a* is gradually inclined upward as the inclination path 30*a* is away from an outlet of the depositing path 21. The conveyance path 30 extends toward the rear at the same height level, after the inclination path 30*a*.

Although not illustrated, such conveyance path 30 is a path that conveys the banknotes from the front toward the rear, and that conveys the banknotes from the rear to the front, when the conveyance belts that are stretched over the conveyance pulleys are displaced.

The conveyance and distribution mechanism 22 has a function of sending the banknotes that are fed into the depositing unit 20 through the depositing port 2*a*, to the conveyance path 30 one by one. When foreign matters other than banknotes such as a coin are included in the banknotes being fed, the conveyance and distribution mechanism 22 has a function of distributing the foreign matters to a discharge path 2*b*. The foreign matters that are distributed to the discharge path 2*b* pass through the discharge path 2*b*, led into a receptacle 2*c*, and are discharged outside the device main body 2.

The discriminating unit 31 is placed in the middle of the inclination path 30*a* described above. The discriminating unit 31 discriminates the authenticity and denomination of the banknotes that are sent from the depositing unit 20 one by one and pass therethrough. The discrimination result by the discriminating unit 31 is given to the control unit, which is not illustrated, as a discrimination signal.

The determining unit 32 is placed in the middle of the conveyance path 30 in the rear side of the discriminating unit 31. The determining unit 32 determines the denomination and number of the banknotes that pass therethrough. The determination result by the determining unit 32 is given to the control unit as a determination signal.

The storage units 40 are provided at the rear side of the device main body 2 and below the conveyance path 30. The storage units 40 are aligned in the front-to-rear direction for each denomination.

Figure 8:
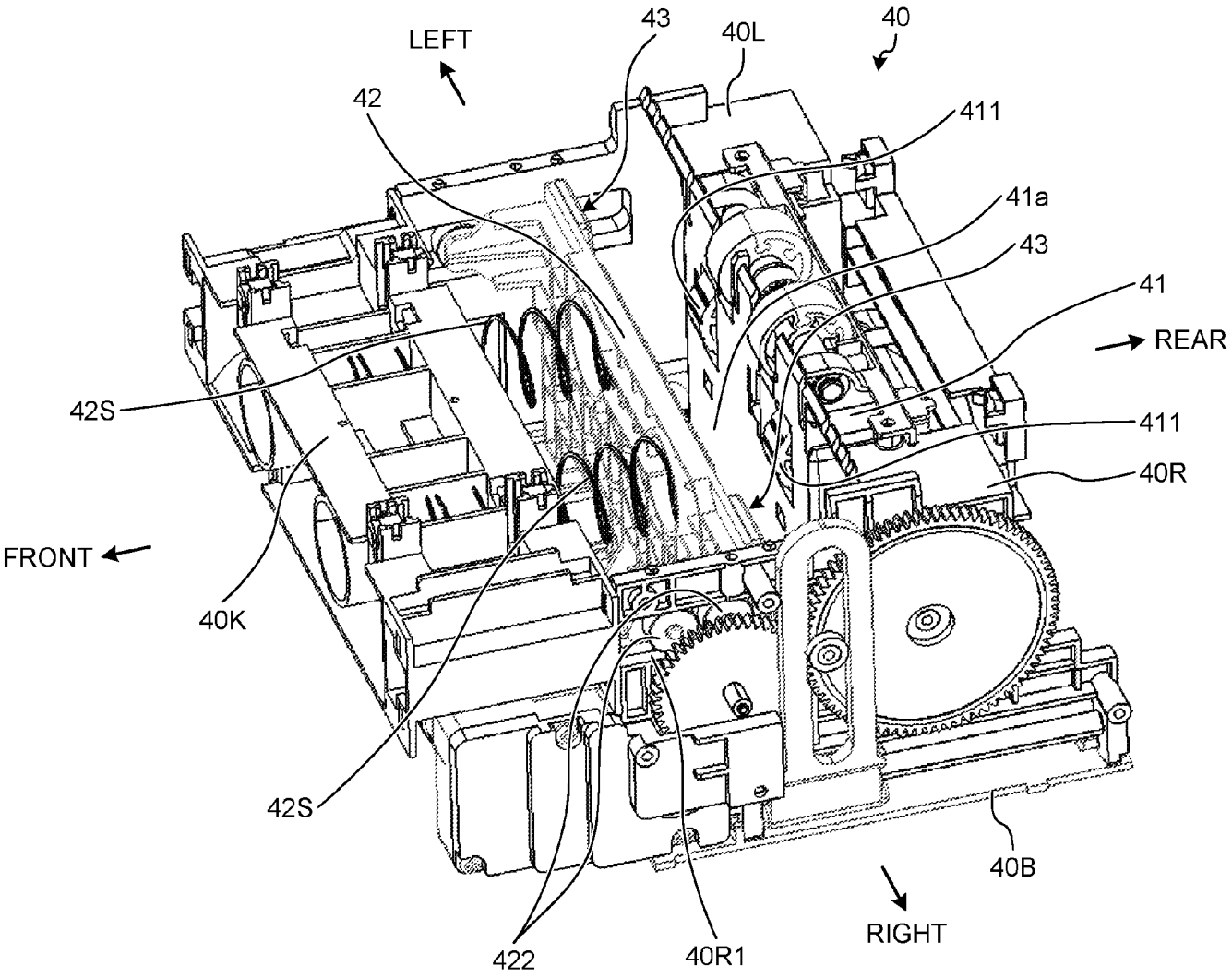
FIG. 8 is a perspective view illustrating a case when a storage unit at the forefront is viewed from the right front.
Figure 9:
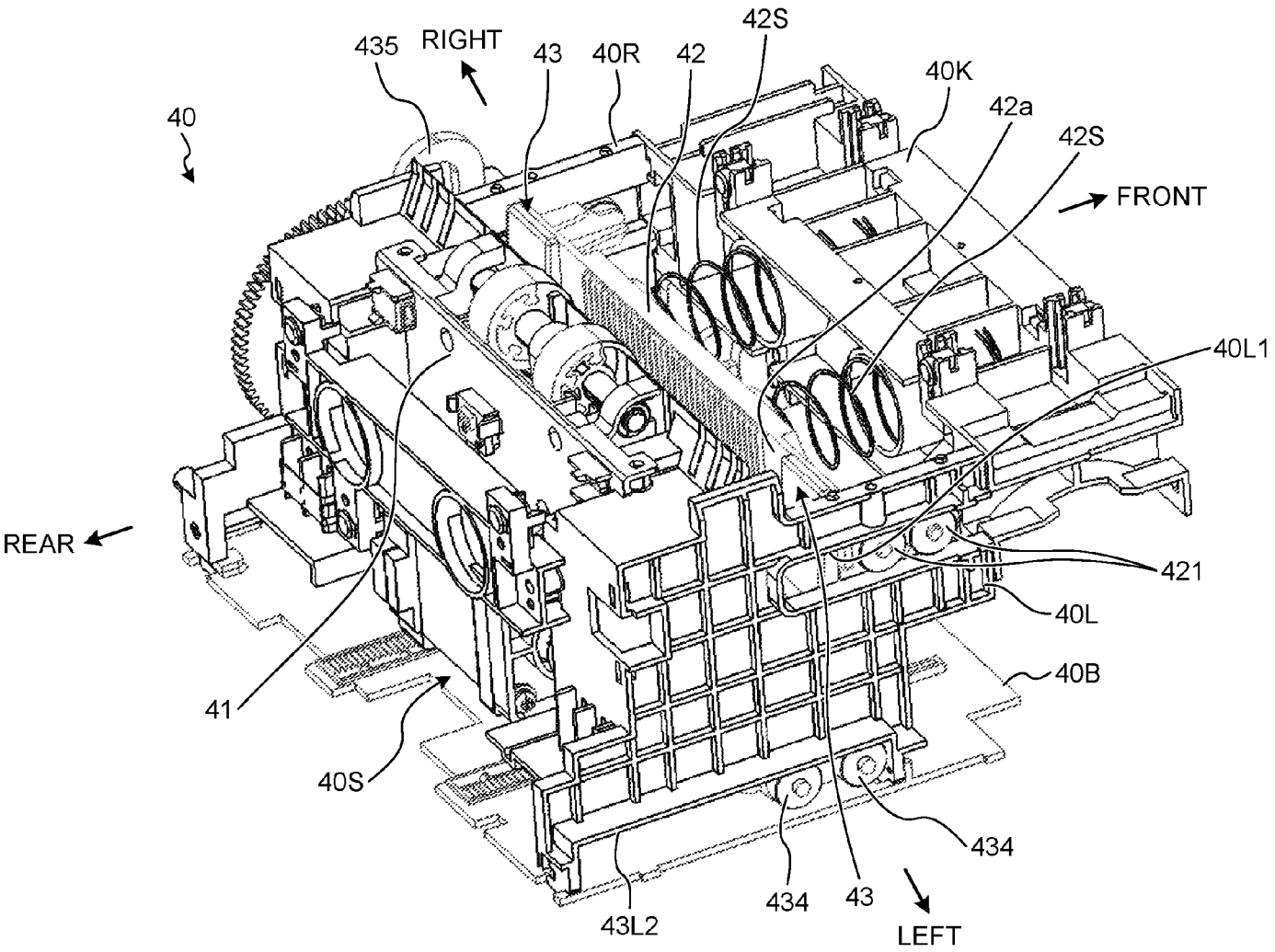
FIG. 9 is a perspective view illustrating a case when the storage unit at the forefront is viewed from the left rear.

FIG. 8 and FIG. 9 illustrate the storage unit 40 at the forefront. FIG. 8 is a perspective view illustrating a case when the storage unit 40 is viewed from the right front. FIG. 9 is a perspective view illustrating a case when the storage unit 40 is viewed from the left rear. In this example, the storage unit 40 at the forefront is described. However, the storage unit 40 at the rearmost also has substantially the same configuration.

As illustrated in FIG. 8 and FIG. 9, the storage unit 40 includes a storage wall 41, a pressing unit 42, and a pusher member 43.

The storage wall 41 forms the rear wall of the storage unit 40. In a state of forming a gap 40S with a storage bottom 40B, the storage wall 41 is supported by a storage left side unit 40L that forms the left wall of the storage unit 40 and a storage right side unit 40R that forms the right wall of the storage unit 40. The storage left side unit 40L and the storage right side unit 40R individually stand upright from the storage bottom 40B.

A kick roller 411 is provided on the storage wall 41. There are two kick rollers 411, and each of the kick rollers 411 is rotatable around the center axis of an axis member 412 (see FIG. 12 to FIG. 14) that extends along the left-to-right direction. The kick rollers 411 are linked to a roller motor, which is not illustrated, and rotates in the clockwise direction or in the counterclockwise direction, when the roller motor is driven. A part of the outer peripheral surface of the kick roller 411 projects forward from a storage surface 41*a* that is the front surface of the storage wall 41.

The pressing unit 42 is provided in front of the storage wall 41. A pressing surface 42*a* that is the rear surface of the pressing unit 42 is provided so as to face the storage surface 41*a*. The left-to-right width of the pressing unit 42 is larger than the left-to-right width of the storage surface 41*a*.

The pressing unit 42 as described above is movable on the upper surface of the storage bottom 40B along the front-to-rear direction. This is because, a pressing lower portion roller, which is not illustrated, being provided on the lower portion enters a lower side guiding groove, which is not illustrated, that is formed on the storage bottom 40B and the front-to-rear direction of which is the longitudinal direction. Also, a pressing left side roller 421 being provided on the left side portion enters a left side guiding groove 40L1 that is formed on the storage left side unit 40L and the front-to-rear direction of which is the longitudinal direction. Furthermore, a pressing right side roller 422 being provided on the right side portion enters a right side guiding groove 40R1 that is formed on the storage right side unit 40R and the front-to-rear direction of which is the longitudinal direction.

The pressing unit 42 is always energized toward the rear by a pressing spring 42S. The pressing spring 42S is interposed between the pressing unit 42 and a storage base 40K that stands upright from the storage bottom 40B so that the front end portion of the storage left side unit 40L and the front end portion of the storage right side unit 40R are connected. In other words, the pressing unit 42 is always energized so as to come close to the storage wall 41. In this example, the storage base 40K forms the front wall of the storage unit 40.

Figure 10:
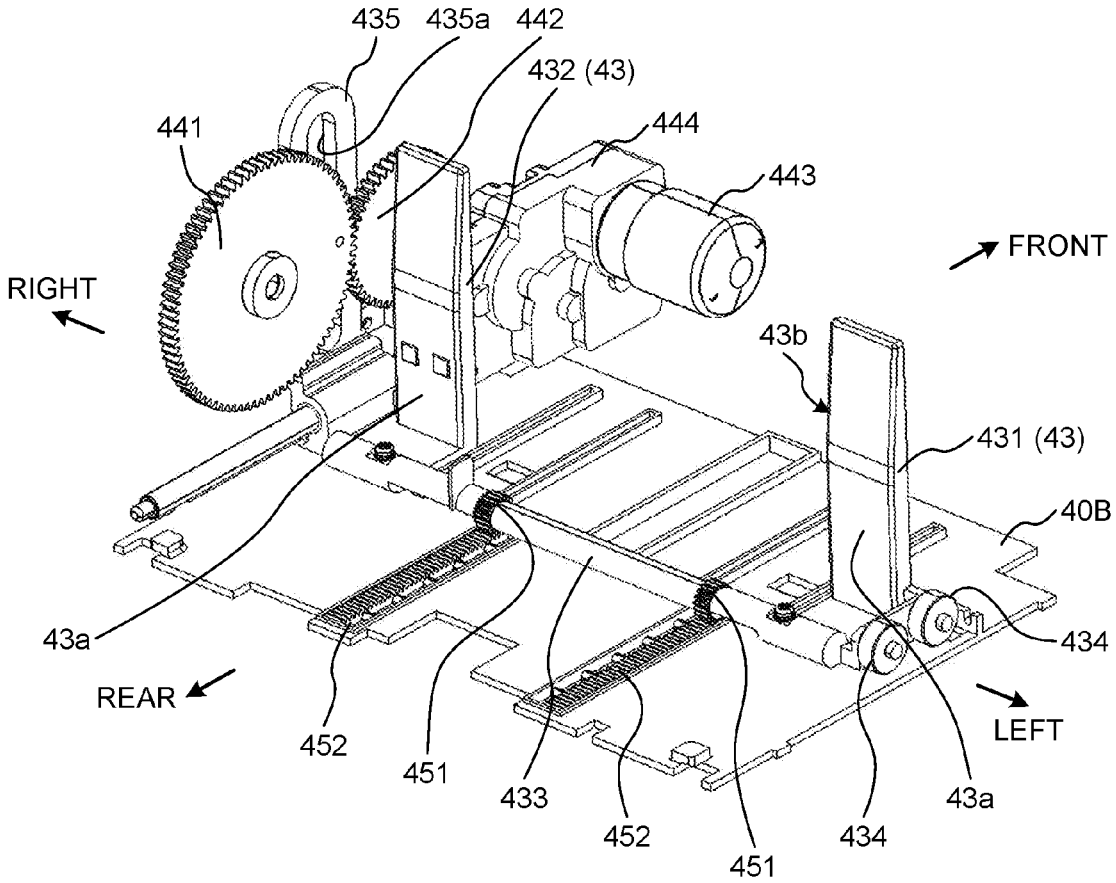
FIG. 10 is a perspective view illustrating a main part of the storage unit illustrated in FIG. 8 and FIG. 9.
Figure 11:
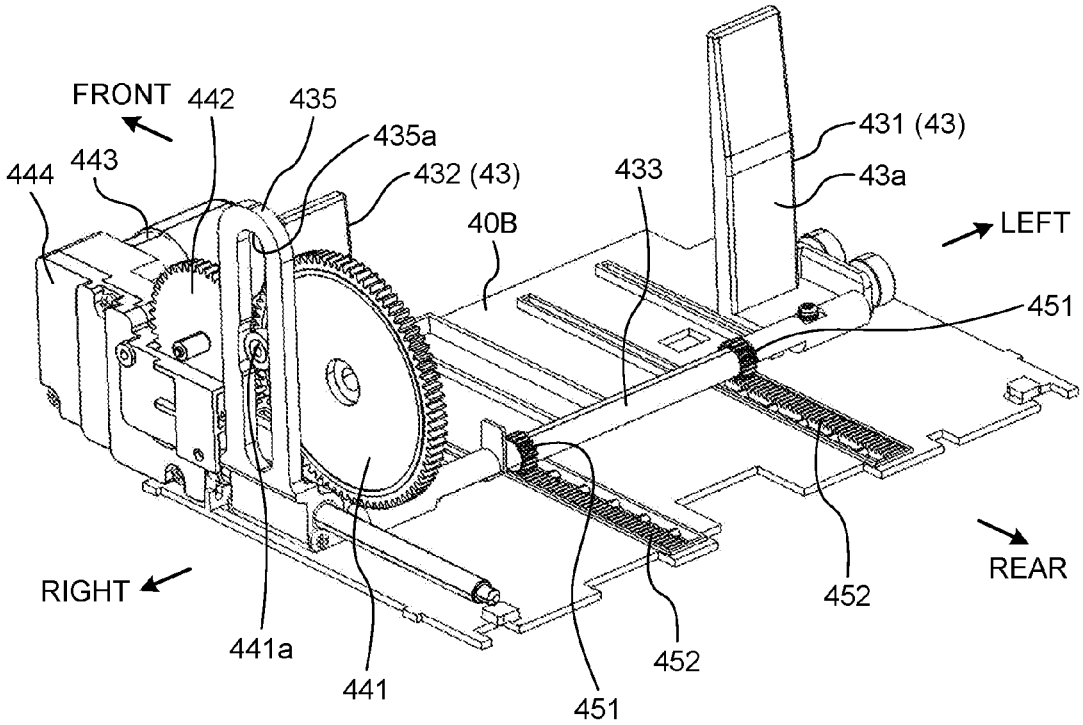
FIG. 11 is a perspective view illustrating the main part of the storage unit illustrated in FIG. 8 and FIG. 9.

The pusher member 43 is provided between the storage wall 41 and the pressing unit 42. As illustrated in FIG. 10 and FIG. 11, the pusher member 43 is formed by connecting the lower end portions of a pair of left side pusher unit 431 and right side pusher unit 432 with a pusher rod 433. The pusher rod 433 is a long rod the left-to-right direction of which is the longitudinal direction, and is rotatable around the center axis.

In the pusher member 43 as described above, the rear surface of the left side pusher unit 431 and the rear surface of the right side pusher unit 432 form an action surface 43*a*, and a notch 43*b* is formed between the left side pusher unit 431 and the right side pusher unit 432. The left-to-right width of the notch 43*b*, in other words, the distance between the left side pusher unit 431 and the right side pusher unit 432 is made larger than the left-to-right width of the storage wall 41.

A pusher roller 434 is provided on the left side pusher unit 431 of the pusher member 43, and the pusher roller 434 enters a guide groove 43L2. The guide groove 43L2 is formed between the storage bottom 40B and the storage left side unit 40L, and the front-to-rear direction of the guide groove 43L2 is the longitudinal direction.

A connection board 435 that has a long hole 435*a* and the vertical direction of which is the longitudinal direction, is fixed to the right side pusher unit 432. A pusher transmission projection 441*a* enters the long hole 435*a* of the connection board 435. The pusher transmission projection 441*a* projects toward the right from the right side surface of a pusher transmission gear 441 that is rotatably provided around the own center axis, at the right side of the storage right side unit 40R. A part of the pusher transmission gear 441 that is formed on the outer peripheral surface is meshed with a pusher driving gear 442. The pusher driving gear 442 is linked to a pusher motor 443 via a transmission unit 444, and rotates around the own center axis, when the pusher motor 443 is driven. That is, the pusher transmission gear 441 rotates around the center axis via the transmission unit 444 and the pusher driving gear 442, when the pusher motor 443 is driven.

When the pusher transmission gear 441 rotates around the center axis by the drive of the pusher motor 443, the pusher transmission projection 441*a* moves inside of the long hole 435*a*. Thus, the pusher member 43 moves forward and rearward on the upper surface of the storage bottom 40B, between a reference position that is the forefront position and an advanced position that is the rearmost position, along the front-to-rear direction. In other words, the pusher member 43 moves forward and rearward, when the driving force from the pusher motor 443 being a driving source is applied to the right side portion.

The reference position described above is a position between the storage wall 41 and the pressing unit 42, and forms an accumulation area S1 (see FIG. 12 and the like) with the storage wall 41 and also forms a storage area S2 (see FIG. 12 and the like) with the pressing unit 42. In a normal state, the pusher member 43 is disposed at the reference position. The advanced position described above is a position where the storage wall 41 has relatively passed the notch 43*b* (see FIG. 13).

In the pusher member 43 described above, a pair of left and right pinions 451 is formed on the pusher rod 433. The pair of pinions 451 is meshed with a pair of left and right racks 452. The pair of left and right racks 452 is formed on the storage bottom 40B, and the front-to-rear direction of the pair of left and right racks 452 is the longitudinal direction.

A storage operation of banknotes in the storage unit 40 having such a configuration will now be described. For description, it is assumed that the pusher member 43 is disposed at the reference position, banknotes are already stored in the storage area S2, and the banknotes are pressed against the front surface of the pusher member 43 (left side pusher unit 431 and the right side pusher unit 432) by the pressing unit 42.

Figure 12:
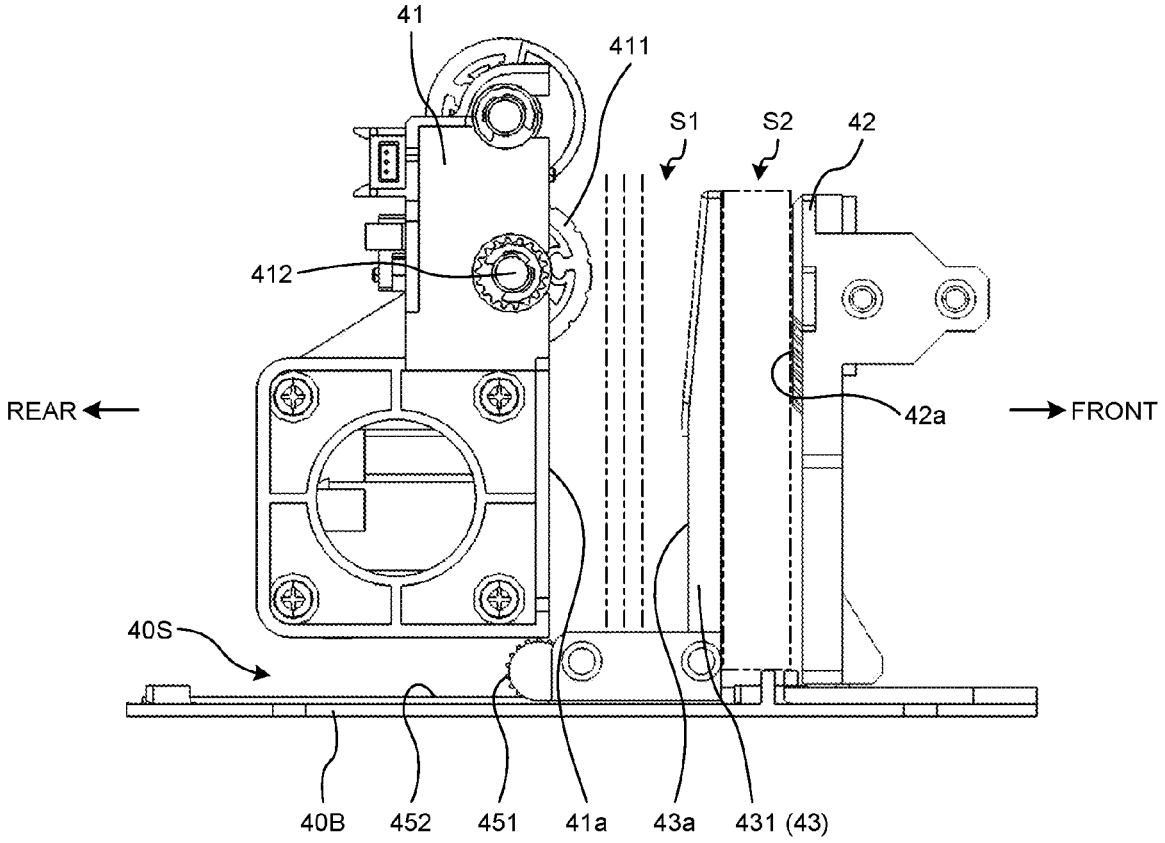
FIG. 12 is an explanatory diagram illustrating a storage operation of the storage unit illustrated in FIG. 8 and FIG. 9.

As illustrated in FIG. 12, when the banknotes are conveyed to the accumulation area S1, the pusher member 43 moves forward toward the rear, by the drive of the pusher motor 443. At this time, the pusher rod 433 rotates around the center axis, while each of the pinions 451 is meshed with the corresponding rack 452. The upper displacement of the pusher member 43 is restricted, because the pusher roller 434 of the left side pusher unit 431 rotatably moves the guide groove 43L2. In other words, the upper displacement of the pusher member 43 is restricted, and the meshing state between the pinion 451 and the rack 452 is maintained. The pressing unit 42 follows the forward movement of the pusher member 43 and moves toward the rear, by the pressing spring 42S.

Figure 13:
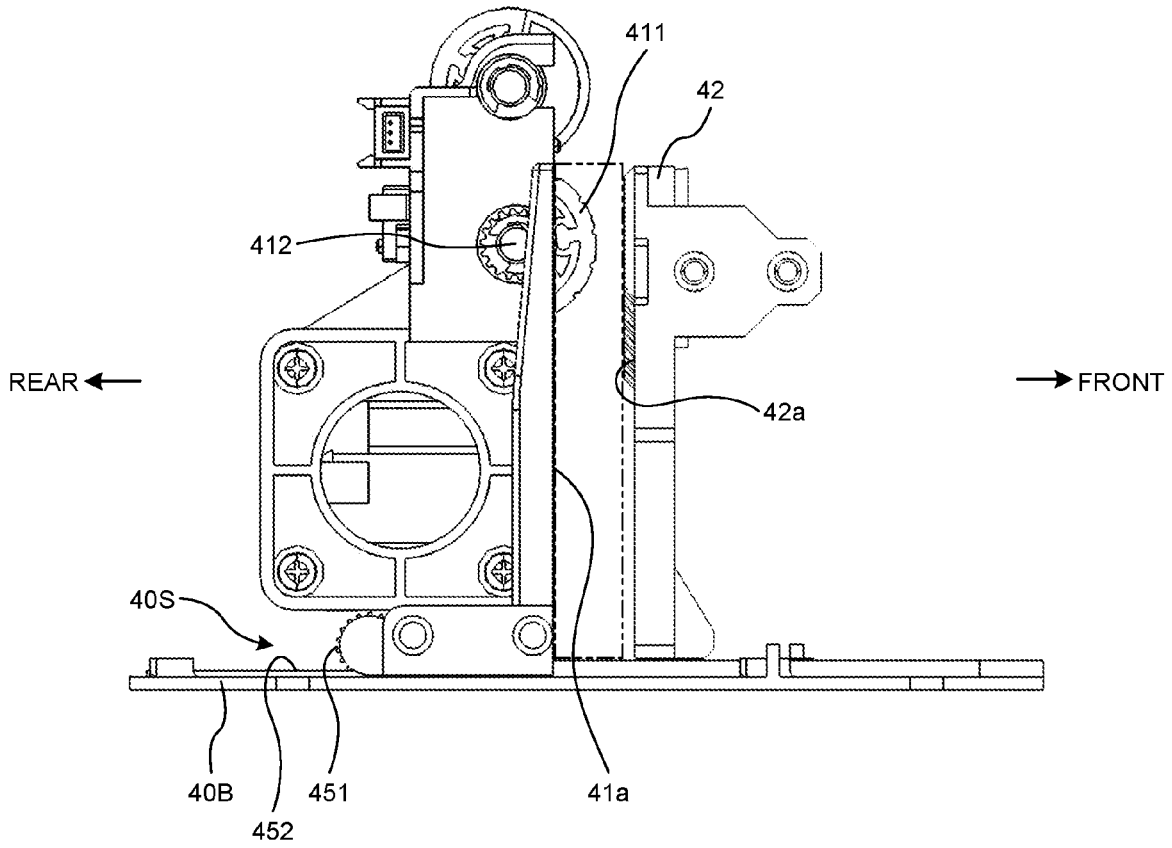
FIG. 13 is an explanatory diagram illustrating the storage operation of the storage unit illustrated in FIG. 8 and FIG. 9.

As illustrated in FIG. 13, when the pusher member 43 moves forward toward the advanced position, the storage wall 41 relatively passes the notch 43*b*. Thus, the banknotes that are conveyed to the accumulation area S1 relatively pass the notch 43*b* while changing the shape, and move to the storage area S2. In this case, the number of banknotes in the storage area S2 is increased. However, the thickness of the increased banknotes is absorbed, because the pressing unit 42 moves toward the rear against the energizing force of the pressing spring 42S.

Figure 14:
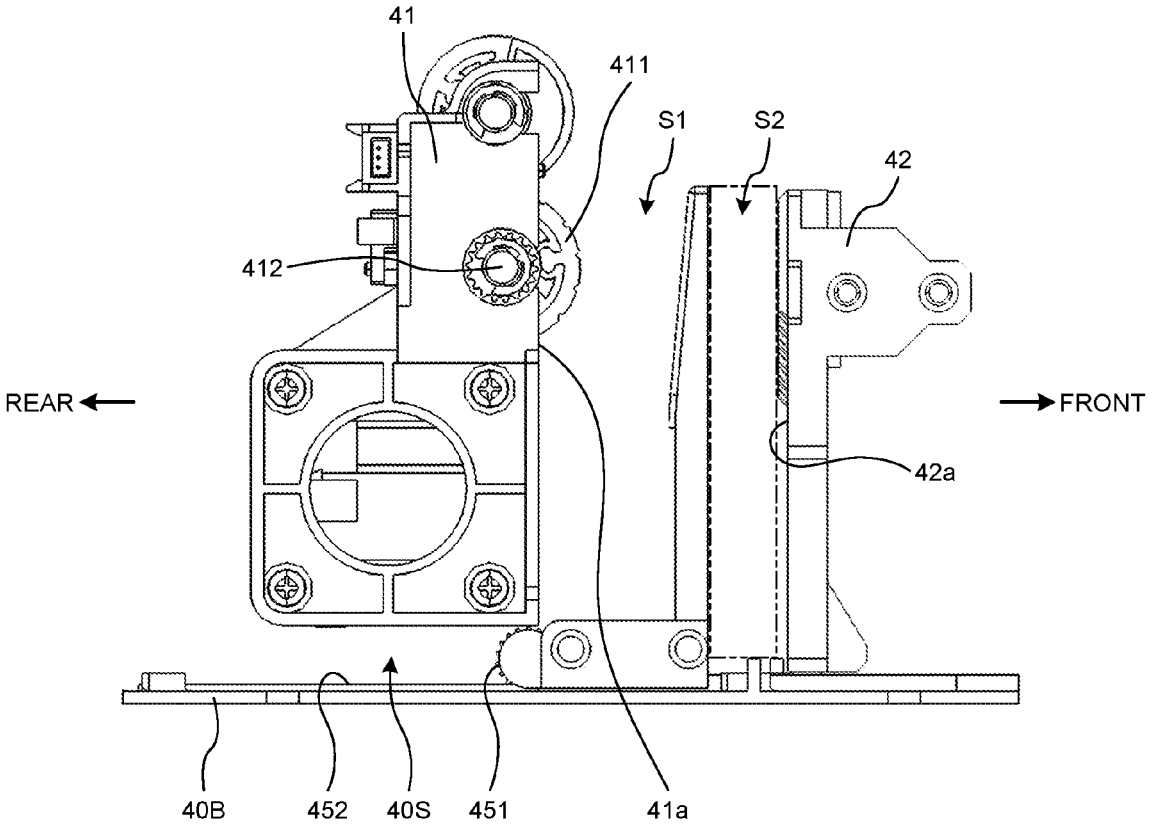
FIG. 14 is an explanatory diagram illustrating the storage operation of the storage unit illustrated in FIG. 8 and FIG. 9.

The pusher member 43 that has moved to the advanced position in this manner, then moves rearward toward the front by the drive of the pusher motor 443. At this time, the pressing unit 42 also moves forward against the energizing force of the pressing spring 42S. Then, as illustrated in FIG. 14, when the pusher member 43 moves to the reference position, the storage operation of the banknotes is completed.

A checking unit 33 is provided in front of the determining unit 32 described above (see FIG. 7). The checking unit 33 temporarily stores therein the to-be-checked banknotes that are stored in the storage unit 40. The checking unit 33 then delivers the banknotes that are temporarily stored therein for checking, to the conveyance path 30.

Figure 15:
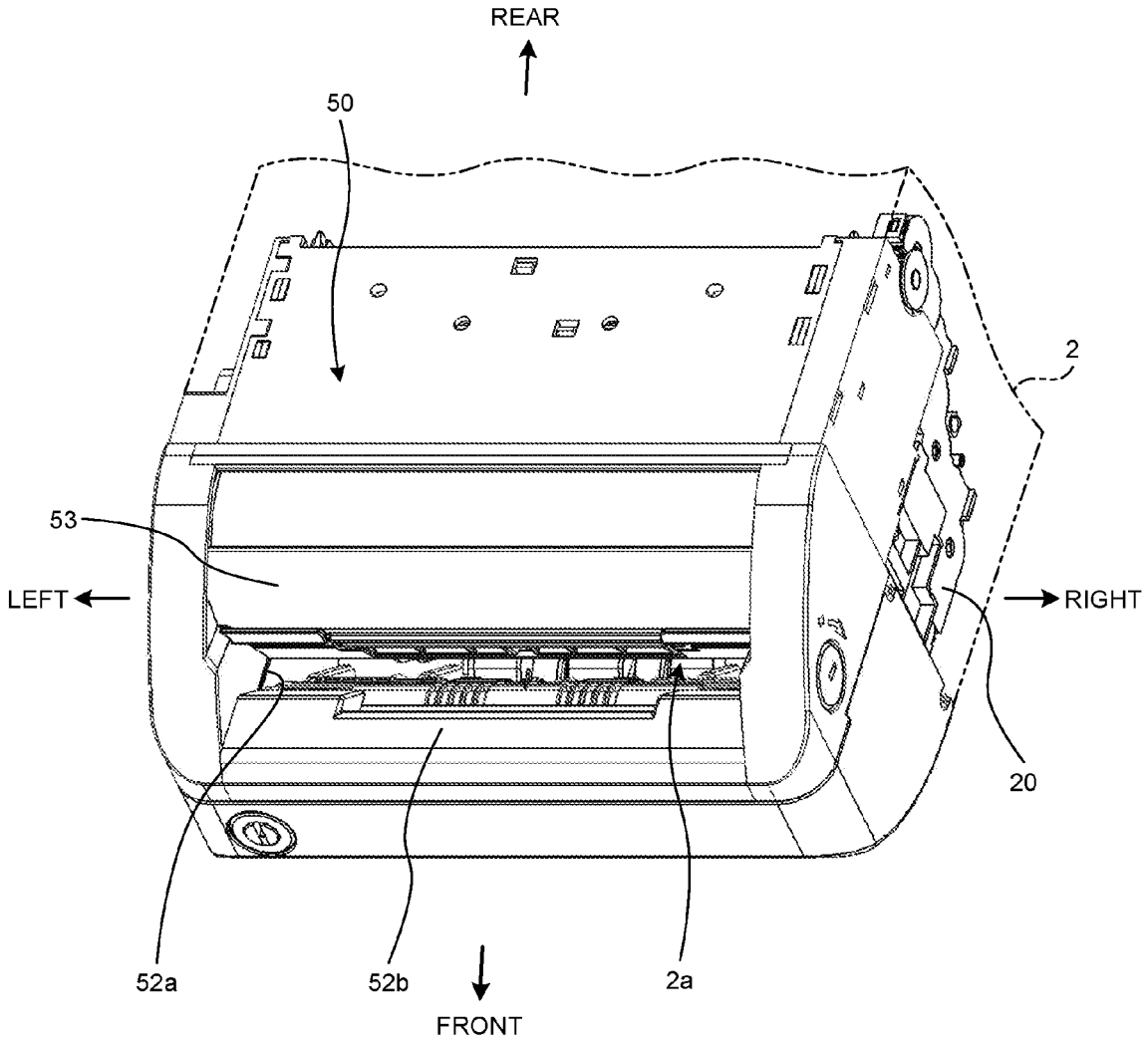
FIG. 15 is a perspective view illustrating a front end portion of the banknote processing device illustrated in FIG. 7.
Figure 16:
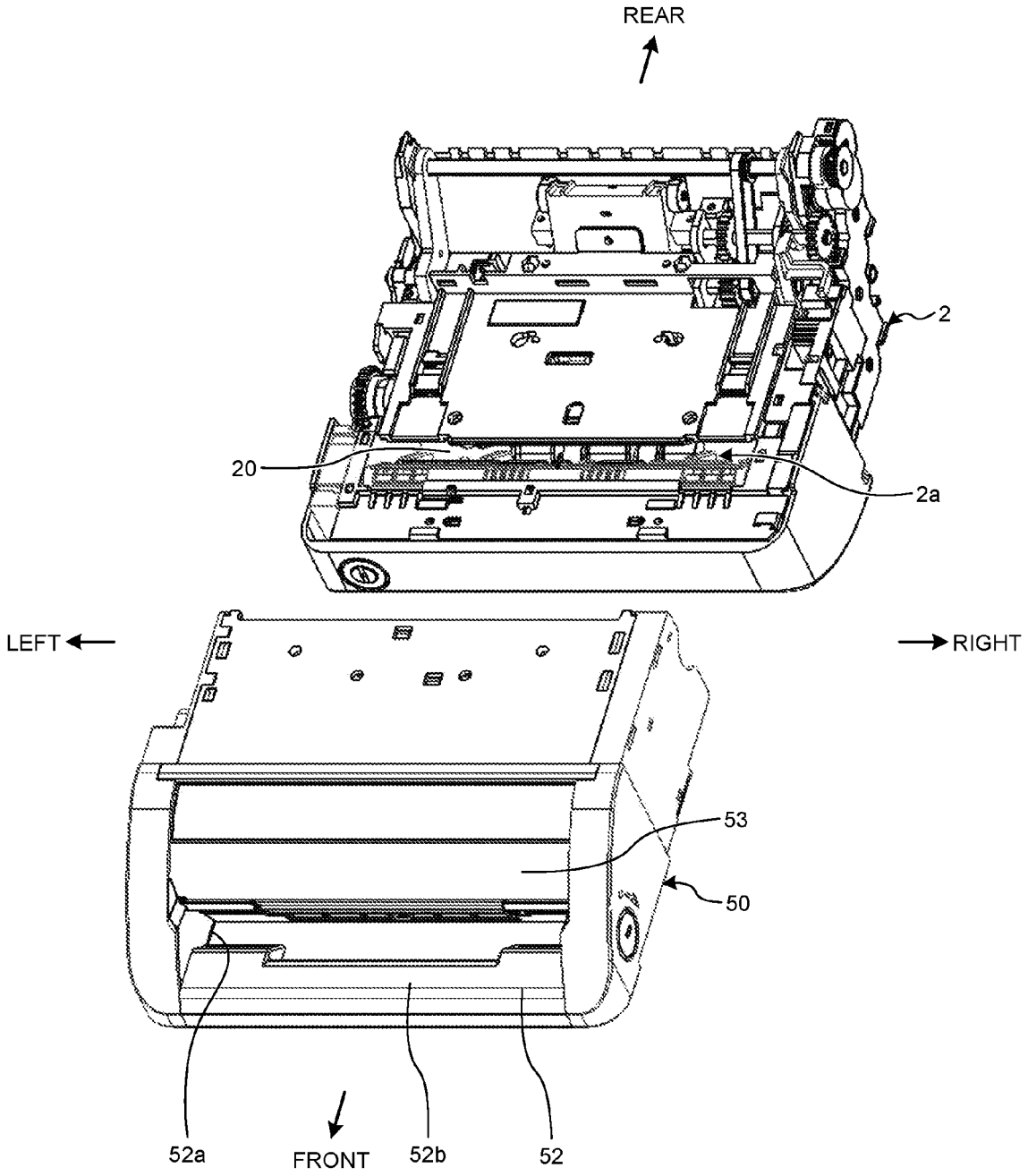
FIG. 16 is a perspective view illustrating a state when a dispensing box illustrated in FIG. 15 is removed from a device main body.

As illustrated in FIG. 15, the dispensing box 50 is provided at the front side of the device main body 2 and above the depositing unit 20. As illustrated in FIG. 16, the dispensing box 50 can be removed from the device main body 2, and is detachably provided in the device main body 2. As described above, the dispensing box 50 is detachably provided in the device main body 2. However, when the dispensing box 50 is provided in the device main body 2 as illustrated in FIG. 15, the dispensing box 50 cannot be removed from the device main body 2, as long as an exclusive input operation, an operation of inserting an ejection key, which is not illustrated, into a predetermined ejection key hole (not illustrated), or the like is carried out. In other words, the dispensing box 50 cannot be easily removed from the device main body 2.

Figure 17:
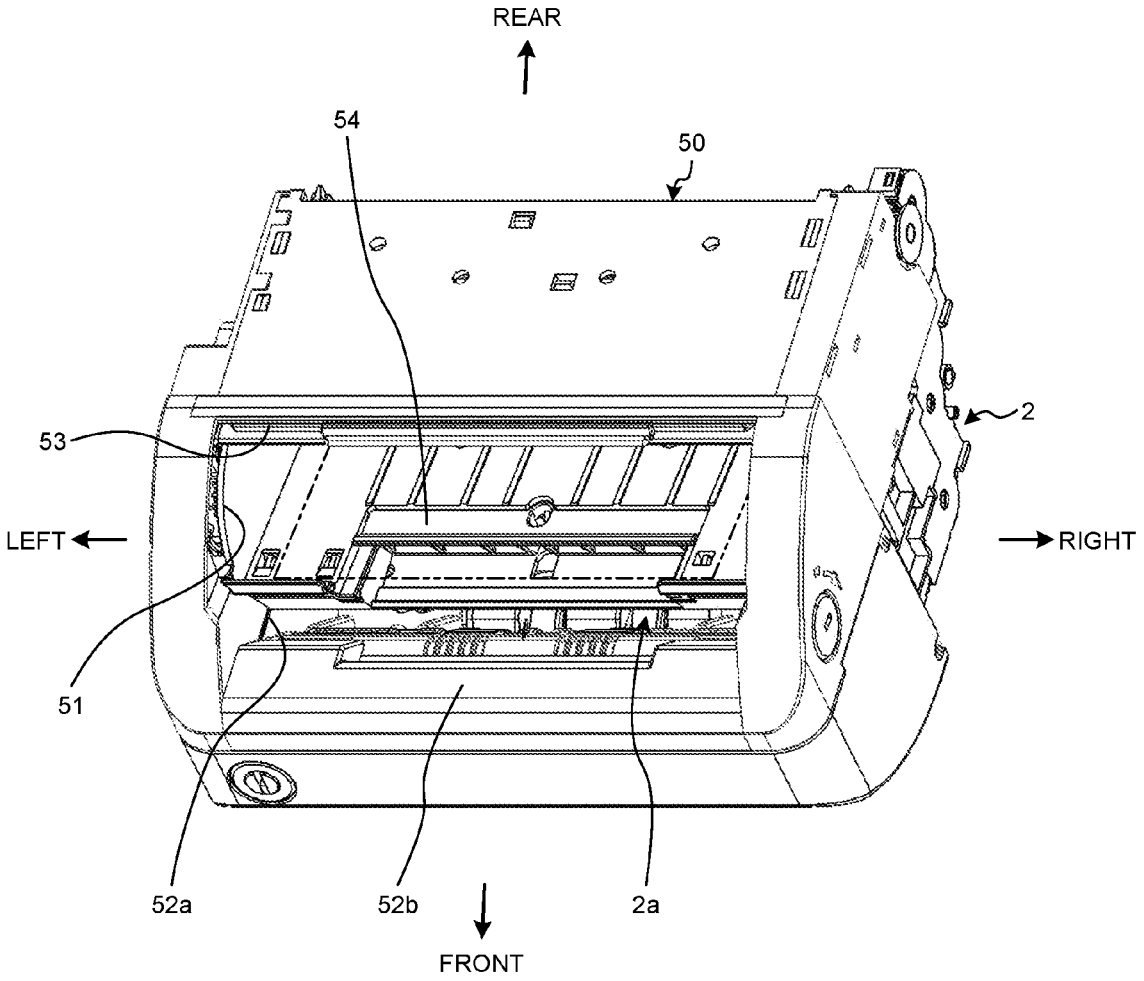
FIG. 17 is a perspective view illustrating the front end portion of the banknote processing device illustrated in FIG. 7.
Figure 18:
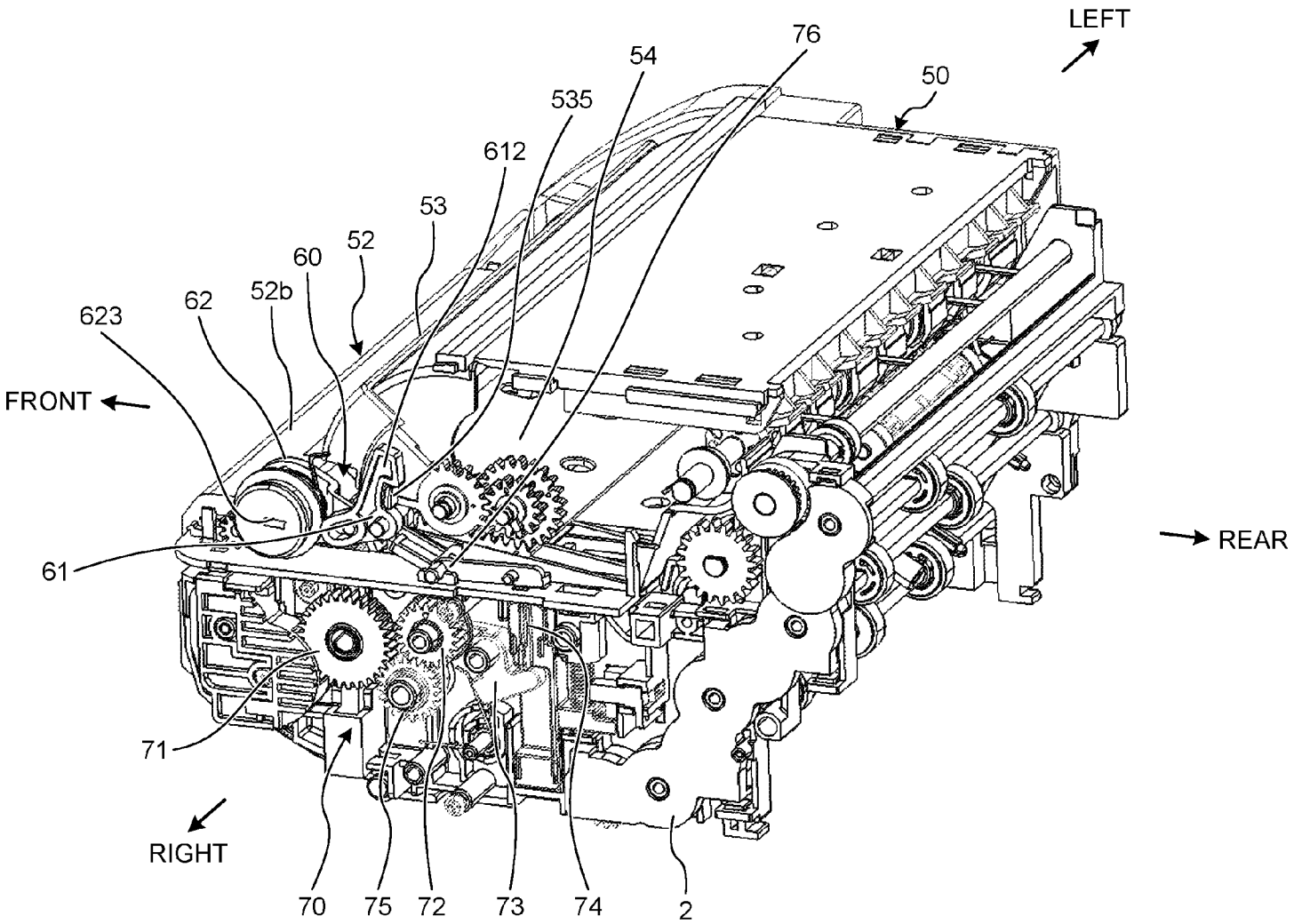
FIG. 18 is a perspective view illustrating the inside structure of the main part of the banknote processing device illustrated in FIG. 15.

As illustrated in FIG. 17, the dispensing box 50 as described above includes a dispensing port 51, and accommodates the banknotes that are conveyed through the conveyance path 30. The dispensing box 50 then discharges the banknotes to the outside through the dispensing port 51. As illustrated in FIG. 18, the dispensing box 50 includes a guide unit 52, a dispensing door 53, a slide member 54, and a dispensing lock unit 60.

The guide unit 52 is a portion that forms a communication port 52*a*. As illustrated in FIG. 15, when the dispensing box 50 is mounted on the device main body 2, the communication port 52*a* of the guide unit 52 is communicably connected to the depositing port 2*a*. As illustrated in FIG. 16, when the dispensing box 50 is removed from the device main body 2, a front edge 52*b* of the communication port 52*a* of the guide unit 52 functions as a gripping unit for an operator.

Figure 19:
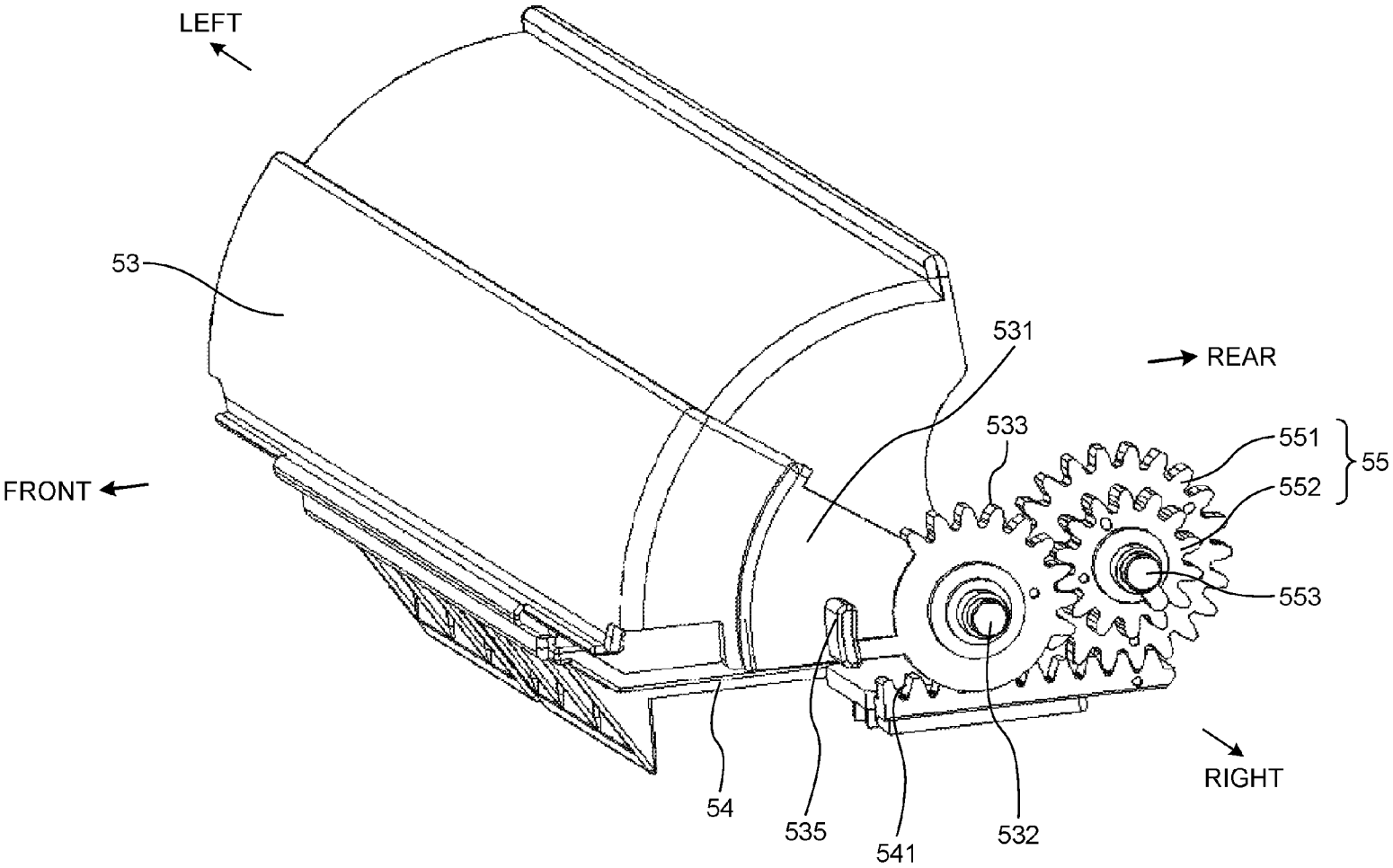
FIG. 19 is a perspective view illustrating the main part of the dispensing box illustrated in FIG. 15 and FIG. 18.
Figure 20:
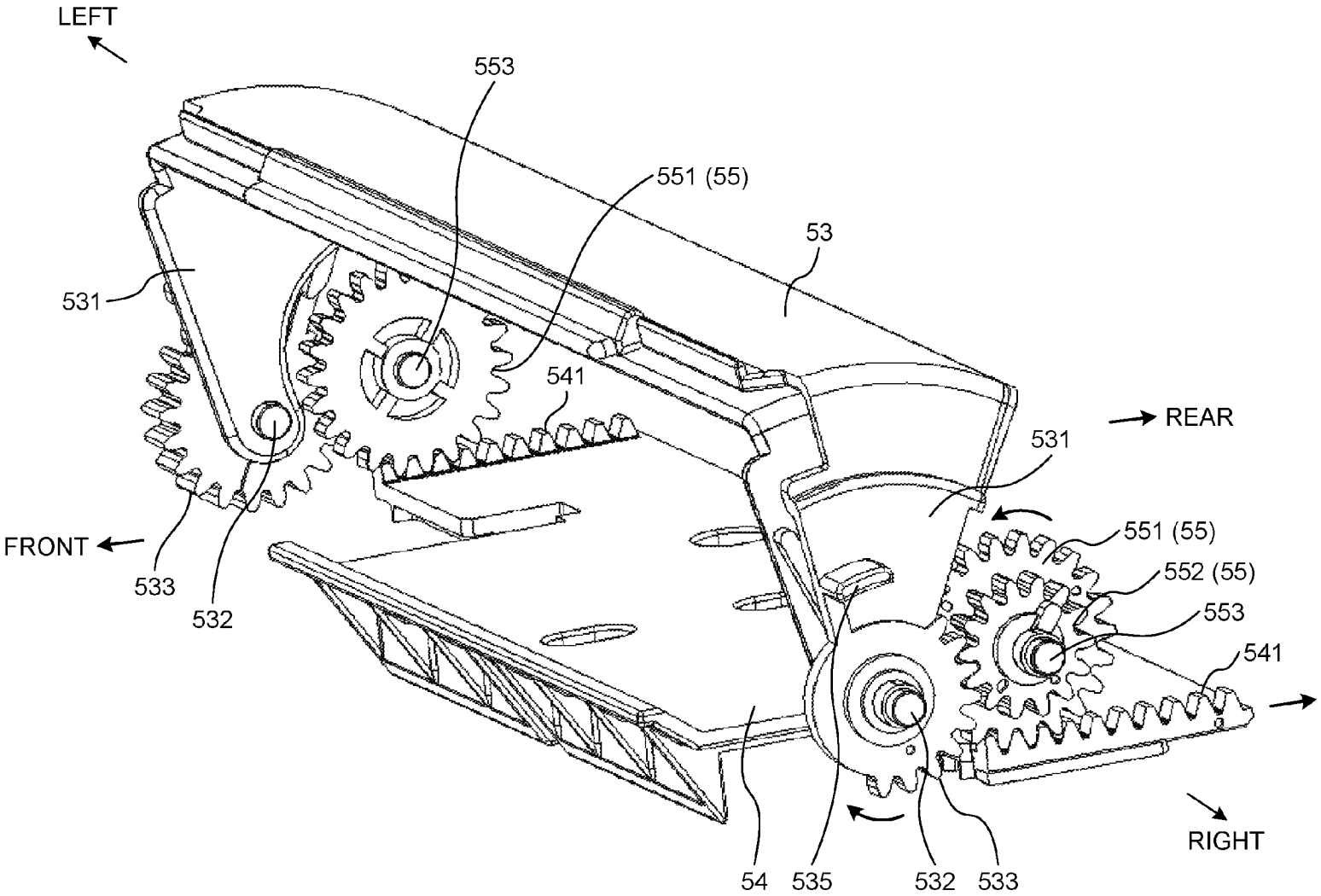
FIG. 20 is a perspective view illustrating the main part of the dispensing box illustrated in FIG. 15 and FIG. 18.

The dispensing door 53 opens and closes the dispensing port 51. As illustrated in FIG. 19 and FIG. 20, a door axis 532 that extends along the left-to-right direction rotatably supports left and right ends 531. The dispensing door 53 is swingably provided around the center axis of the door axis 532. The dispensing port 51 is opened when the dispensing door 53 swings upward, and the dispensing port 51 is closed when the dispensing door 53 swings downward.

In the dispensing door 53 as described above, a door gear unit 533 is formed at a location outside the radial direction of the door axis 532 of the left and right ends 531.

The slide member 54 forms a part of a lower edge portion of the dispensing port 51, and is slidably provided in the front-to-rear direction. In the slide member 54 as described above, a slide gear unit 541 is formed at the rear of each of the left and right ends, and the slide member 54 is linked to the dispensing door 53 via a linking gear (linking member) 55.

There is a pair of left and right linking gears 55. In each of the linking gears 55, a large diameter gear unit 551 in which the gear portion is formed on the periphery and a small diameter gear unit 552 in which the gear portion is formed on the periphery are joined with each other. The linking gears 55 are rotatably provided around the center axis of a common linking gear axis 553 that extends along the left-to-right direction. In this example, the outer diameter of the small diameter gear unit 552 is smaller than that of the large diameter gear unit 551.

In the linking gear 55 as described above, a part of the gear portion of the large diameter gear unit 551 is meshed with the corresponding slide gear unit 541. Also, the small diameter gear unit 552 is meshed with the corresponding door gear unit 533 of the dispensing door 53.

In this manner, as illustrated in FIG. 19 and FIG. 20, when the dispensing door 53 swings downward to close the dispensing port 51, the slide member 54 slides toward the front, and the front end portion of the slide member 54 comes into contact with the end of the dispensing door 53. When the dispensing door 53 swings upward to open the dispensing port 51, the slide member 54 slides toward the rear, and the front end portion of the slide member 54 is disposed behind the front end portion of the lower edge of the dispensing port 51. In other words, the lower portion of the bottom banknote among the banknotes that is indicated by a long dashed double-short dashed line in FIG. 17 is exposed, when the slide member 54 slides toward the rear.

Figure 21:
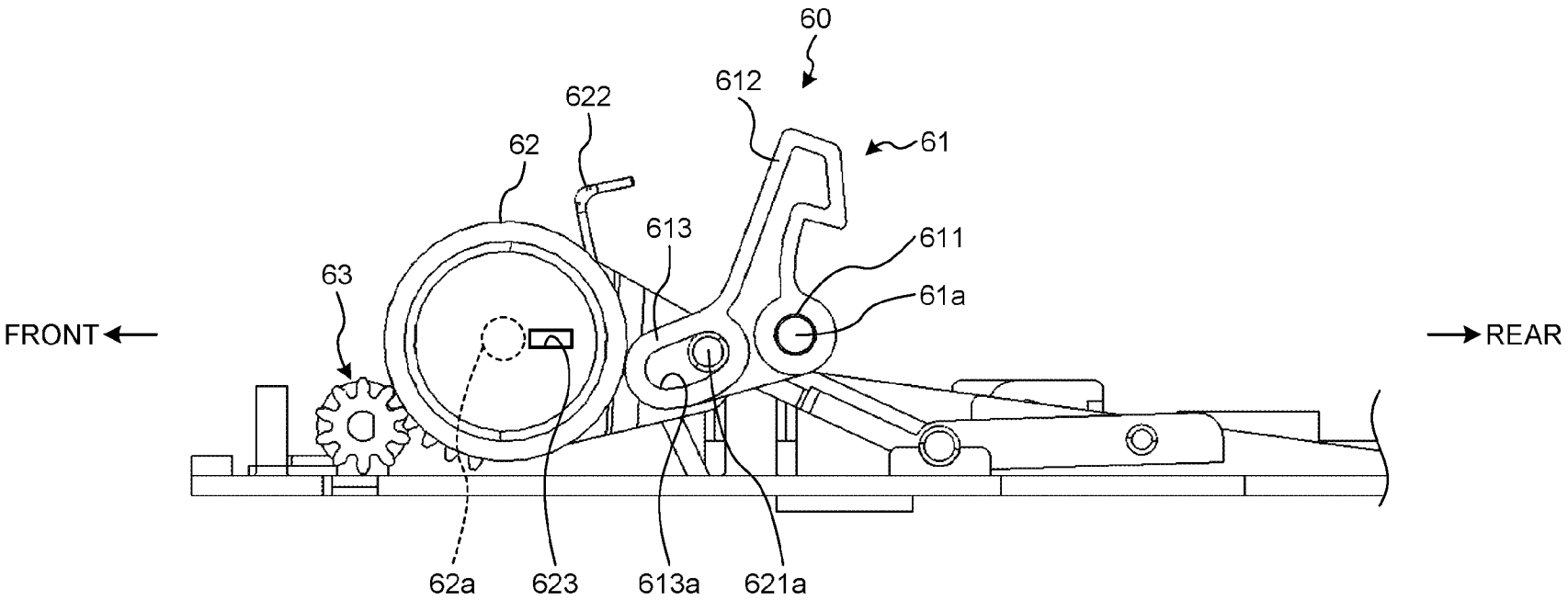
FIG. 21 is a schematic diagram illustrating a dispensing lock unit at the right side included in the dispensing box illustrated in FIG. 15 and FIG. 18.

There is a pair of left and right dispensing lock units 60. Each of the dispensing lock units 60 includes a lock action piece 61. FIG. 21 is a schematic diagram illustrating the dispensing lock unit 60 at the right side. The dispensing lock unit 60 at the left side and the dispensing lock unit 60 at the right side are different from each other in which the left and right are reversed. Thus, in the following, the dispensing lock unit 60 at the right side will be explained, and the explanation of the dispensing lock unit 60 at the left side will be omitted.

The lock action piece 61 is placed right to the right end 531 of the dispensing door 53, and is rotatable around the center axis of an action axis 61*a* that extends along the left-to-right direction. The lock action piece 61 includes an action base 611 on which the action axis 61*a* is fixed, an action hook unit 612 that extends upward from the action base 611, and an action input unit 613 that extends forward from the action base 611. A rectangular shaped action input hole 613*a* is formed in the action input unit 613.

A first input projection 621*a* of an operation input unit 62 is inserted into the action input hole 613*a* from the left. The operation input unit 62 is rotatable around the center axis of an input axis 62*a* that extends along the left-to-right direction. The basic posture of the operation input unit 62 is determined by an input spring 622, and when the operation input unit 62 is in the basic posture, the first input projection 621*a* is positioned behind the input axis 62*a*. A reference numeral 63 in FIG. 21 is a transmission member that transmits the rotation force to the operation input unit 62 forming the dispensing lock unit 60 at the left side.

In the dispensing lock unit 60 as described above, in the normal state, the operation input unit 62 is in the basic posture. Consequently, as illustrated in FIG. 21, the action hook unit 612 of the lock action piece 61 extends upward from the action base 611. Thus, the tip end of the action hook unit 612 is positioned above a projection piece 535 (see FIG. 19) that projects toward the right from the right end 531 of the dispensing door 53. Hence, even if the dispensing door 53 swings upward, the tip end of the action hook unit 612 interferes with the dispensing door 53. Consequently, in the normal state, the dispensing lock unit 60 is in a locked state that restricts the dispensing door 53 to move in the opening direction.

Figure 22:
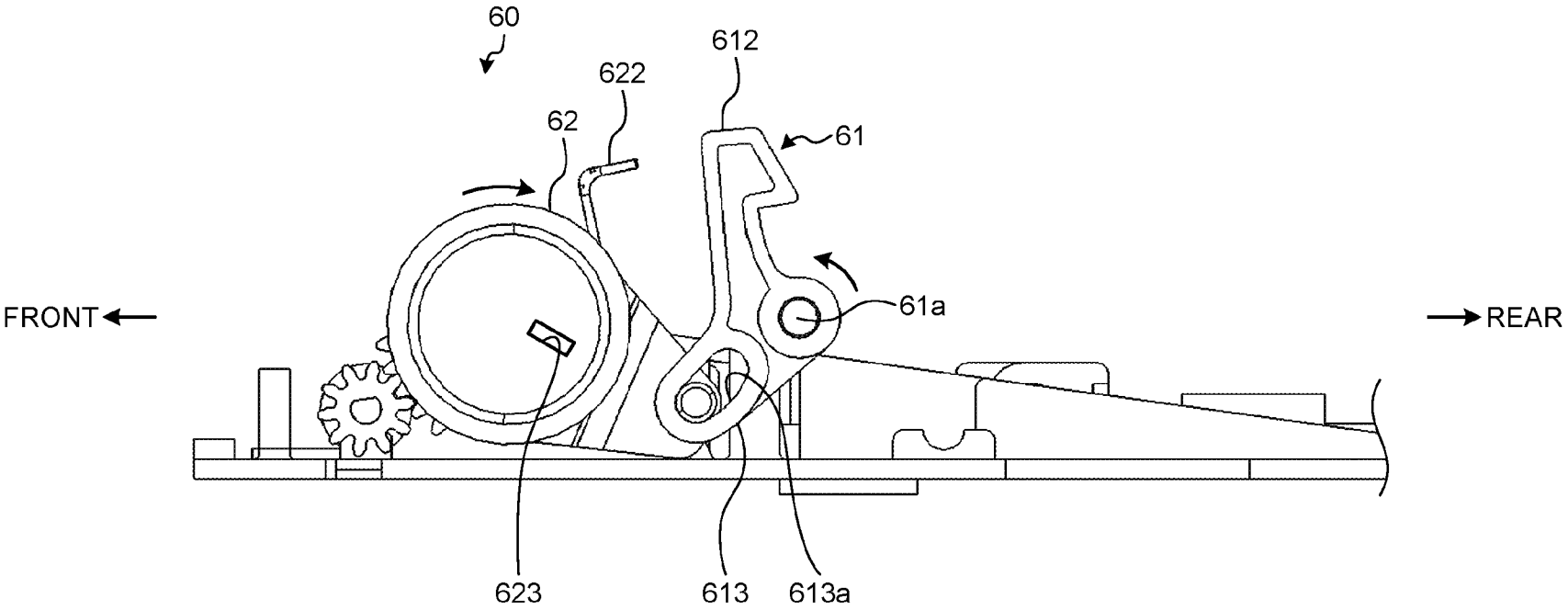
FIG. 22 is a schematic diagram illustrating the dispensing lock unit at the right side included in the dispensing box illustrated in FIG. 15 and FIG. 18.

When a releasing operation is performed by inserting a dispensing key (not illustrated) into an input key hole 623 that is formed on the operation input unit 62, and bringing the operation input unit 62 into a releasing posture in which the operation input unit 62 has rotated in the clockwise direction when viewed from the right side against the energizing force of the input spring 622, as illustrated in FIG. 22, the dispensing lock unit 60 allows the lock action piece 61 to rotate forward, allows the tip end of the action hook unit 612 to be removed from the upper side of the projection piece 535, and allows the dispensing door 53 to swing upward. Consequently, when the releasing operation is performed, the dispensing lock unit 60 will be in a non-locked state that allows the dispensing door 53 to move in the opening direction.

As illustrated in FIG. 18, in addition to the structure described above, the device main body 2 described above includes a lock mechanism 70.

Figure 23:
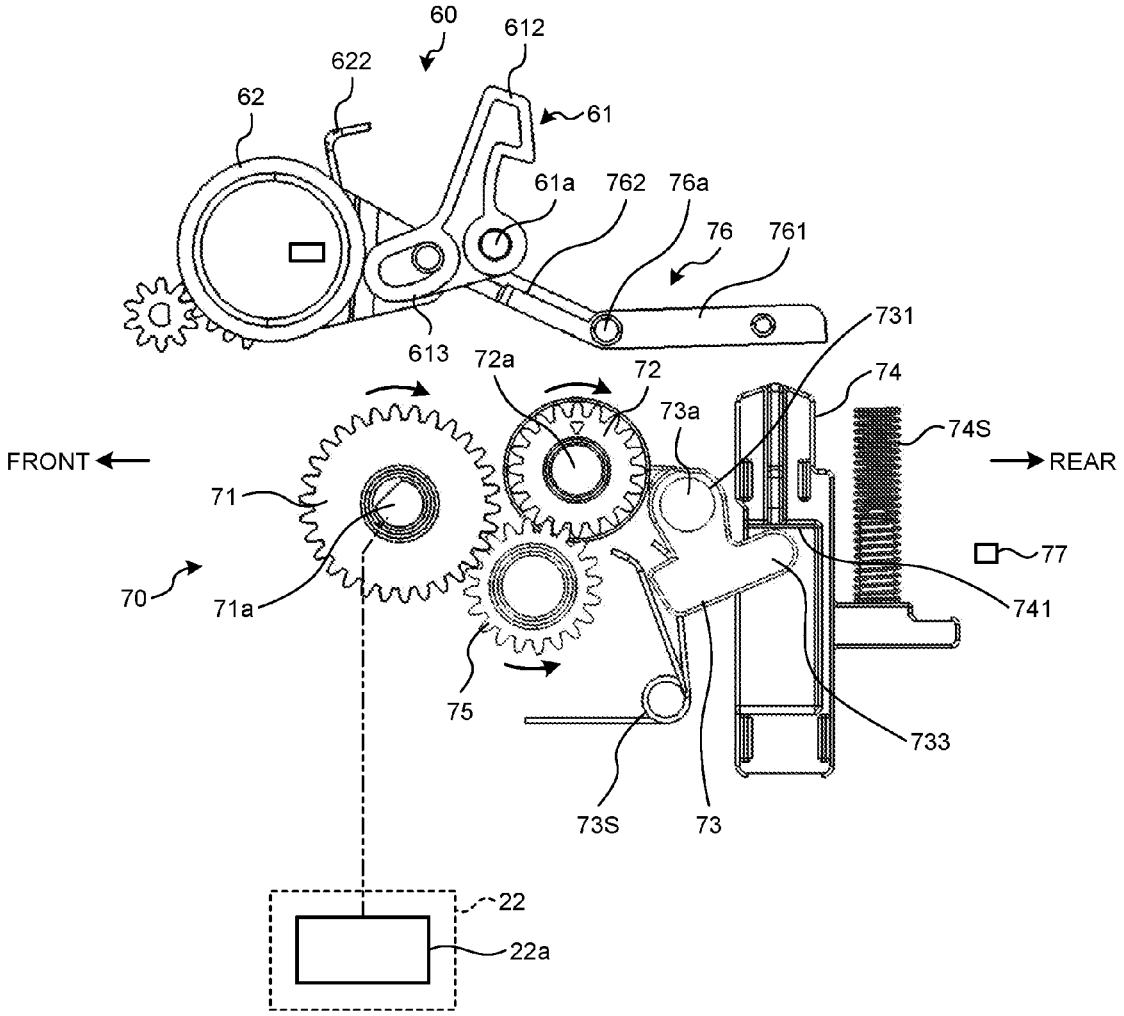
FIG. 23 is an explanatory diagram when components of the dispensing lock unit and a lock mechanism at the right side are viewed from the right side.
Figure 24:
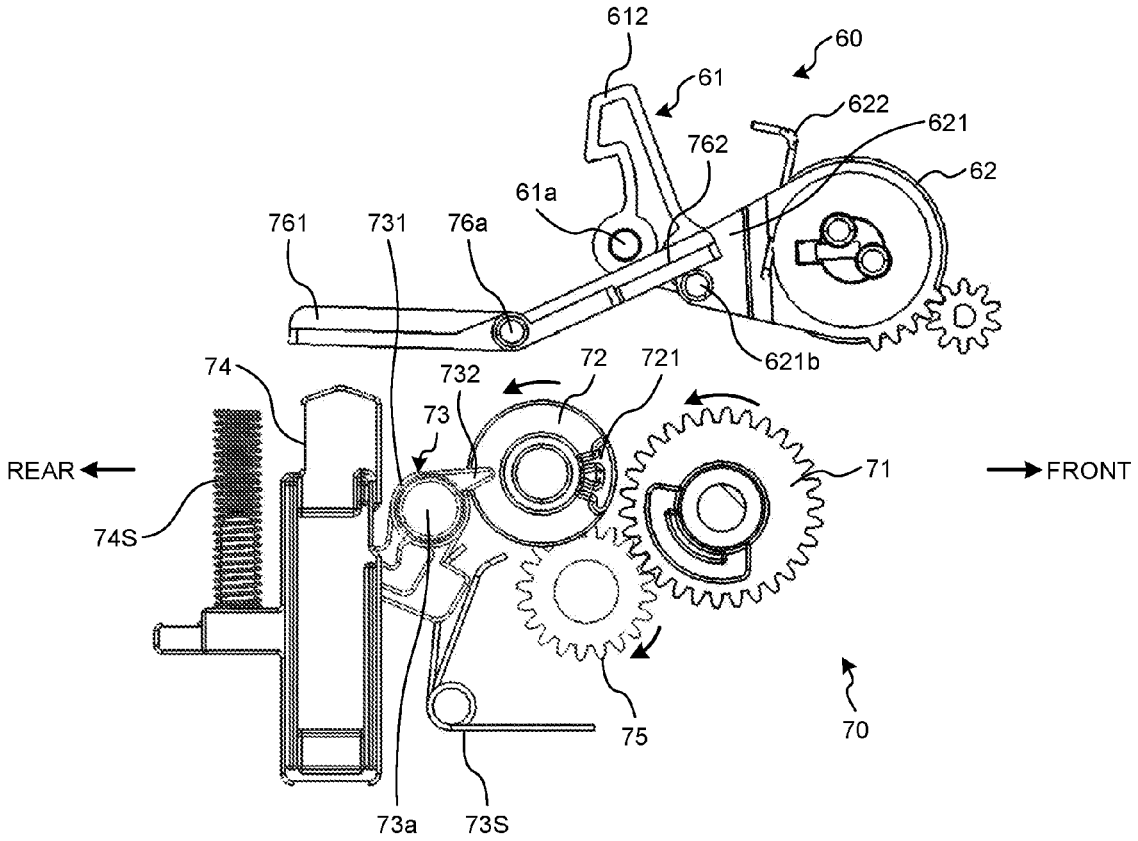
FIG. 24 is an explanatory diagram when the components of the dispensing lock unit and the lock mechanism at the right side are viewed from the left side.

FIG. 23 and FIG. 24 each illustrates components of the dispensing lock unit 60 and the lock mechanism 70 at the right side. FIG. 23 is an explanatory diagram when the dispensing lock unit 60 and the lock mechanism 70 are viewed from the right side. FIG. 24 is an explanatory diagram when the dispensing lock unit 60 and the lock mechanism 70 are viewed from the left side.

As illustrated in FIG. 18, the lock mechanism 70 illustrated in this example is provided at the right side of the depositing unit 20 of the device main body 2. The lock mechanism 70 includes a lock drive gear 71, a lock transmission gear 72, a lock transmission lever 73, and a lock transmission unit 74.

The lock drive gear 71 is rotatably provided around the center axis of a lock drive axis 71*a* that extends along the left-to-right direction. The lock drive gear 71 is driven either in the clockwise direction or in the counterclockwise direction when viewed from the right, by the drive of a conveyance and distribution motor 22*a* that is the drive source of the conveyance and distribution mechanism 22 of the depositing unit 20.

The lock transmission gear 72 is placed behind the lock drive gear 71, and is rotatably provided around the center axis of a lock transmission axis 72*a* that extends along the left-to-right direction. In the lock transmission gear 72, a gear portion that is formed on the outer peripheral surface is meshed with a gear portion at the outer peripheral surface of a lock linking gear 75. The gear portion of the lock linking gear 75 is meshed with a gear portion that is formed on the outer peripheral surface of the lock drive gear 71.

In this manner, when the lock drive gear 71 is rotated in the clockwise direction when viewed from the right, the lock transmission gear 72 rotates in the clockwise direction when viewed from the right, via the lock linking gear 75. When the lock drive gear 71 is rotated in the counterclockwise direction when viewed from the right, the lock transmission gear 72 rotates in the counterclockwise direction when viewed from the right, via the lock linking gear 75. Furthermore, a lock transmission projection 721 that projects toward the left is formed on the left surface of the lock transmission gear 72.

The lock transmission lever 73 is placed behind the lock transmission gear 72, and is rotatable around the center axis of a lock transmission lever axis 73*a* that extends along the left-to-right direction. The basic posture of the lock transmission lever 73 is determined by a lock transmission lever spring 73S.

The lock transmission lever 73 as described above includes a transmission lever input unit 732 and a transmission lever output unit 733. The transmission lever input unit 732 extends forward from a transmission lever base 731 on which the lock transmission lever axis 73*a* is fixed. The transmission lever output unit 733 extends toward the rear from the transmission lever base 731. In this example, when the lock transmission gear 72 rotates in the clockwise direction when viewed from the right (in the counterclockwise direction when viewed from the left), the transmission lever input unit 732 is disposed at a position that interferes with the lock transmission projection 721.

The lock transmission unit 74 is a long member and the vertical direction of the lock transmission unit 74 is the longitudinal direction. The lock transmission unit 74 is movable between the uppermost position and the lowermost position along the vertical direction. The lock transmission unit 74 is disposed at the lowermost position, by being energized downward by a lock transmission spring 74S.

When the lock transmission lever 73 is rotated in the counterclockwise direction when viewed from the right, a lock abutment surface 741 that is to be abutted to the transmission lever output unit 733 is formed on the right side of the lock transmission unit 74 as described above.

When the lock transmission unit 74 moves to the uppermost position against the energizing force of the lock transmission spring 74S, the upper end of the lock transmission unit 74 abuts to a lock action lever 76.

The lock action lever 76 is provided on the dispensing box 50. The lock action lever 76 is placed behind the dispensing lock unit 60 at the right side, and is rotatable around the center axis of a lock action lever axis 76*a* that extends along the left-to-right direction. The lock action lever 76 includes an action lever input unit 761 and an action lever output unit 762. The action lever input unit 761 extends toward the rear that is the radially outward direction of the lock action lever axis 76*a*. The action lever output unit 762 extends toward the front and diagonally upward that is the radially outward direction of the lock action lever axis 76*a*. The end of the action lever output unit 762 is positioned above a second input projection 621*b* that projects toward the left from the left surface of a plate-shaped unit 621 on which the first input projection 621*a* described above is formed.

A reference numeral 77 in FIG. 23 is a sensor. The sensor 77 detects whether the lock transmission unit 74 has moved to the uppermost position, and gives the detection result to the control unit as a detection signal.

An operation of the lock mechanism 70 as described above will now be described. In the lock mechanism 70, as illustrated in FIG. 23 and FIG. 24, in the normal state, the dispensing lock unit 60 is in a locked state with the lock transmission unit 74 disposed at the lowermost position.

Upon receiving a releasing instruction from the control unit, the lock mechanism 70 turns the dispensing lock unit 60 into a non-locked state as follows.

When the lock drive gear 71 is rotated in the clockwise direction when viewed from the right, by the drive of the conveyance and distribution motor 22*a*, the lock transmission gear 72 rotates in the clockwise direction when viewed from the right. When the lock transmission gear 72 rotates in this manner, the lock transmission projection 721 abuts to and presses the transmission lever input unit 732. Consequently, the lock transmission lever 73 rotates in the counterclockwise direction when viewed from the right.

When the lock transmission lever 73 is rotated, the transmission lever output unit 733 abuts to the lock abutment surface 741 of the lock transmission unit 74, and the lock transmission unit 74 moves upward against the energizing force of the lock transmission spring 74S.

Figure 25:
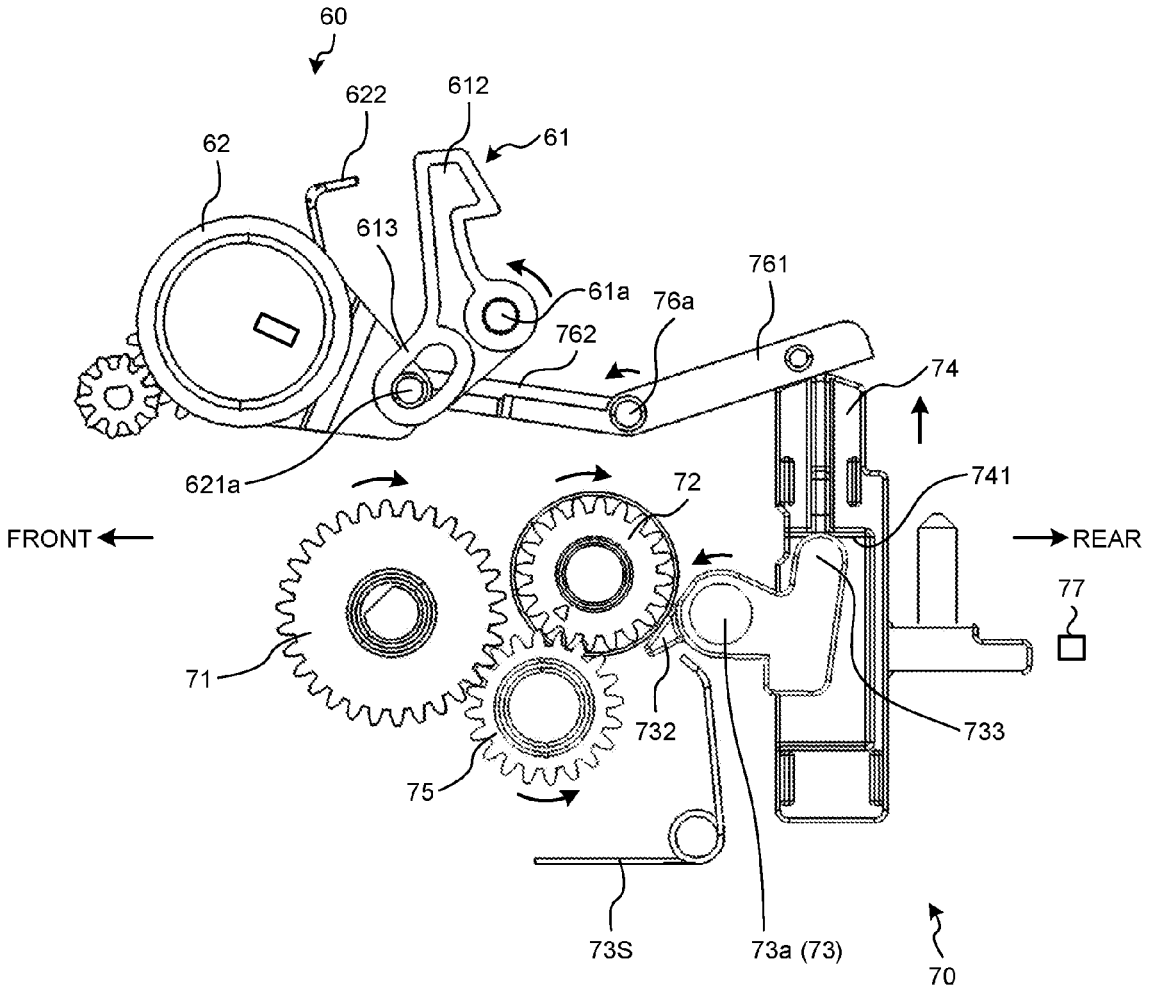
FIG. 25 is an explanatory diagram when the components of the dispensing lock unit and the lock mechanism at the right side are viewed from the right side.
Figure 26:
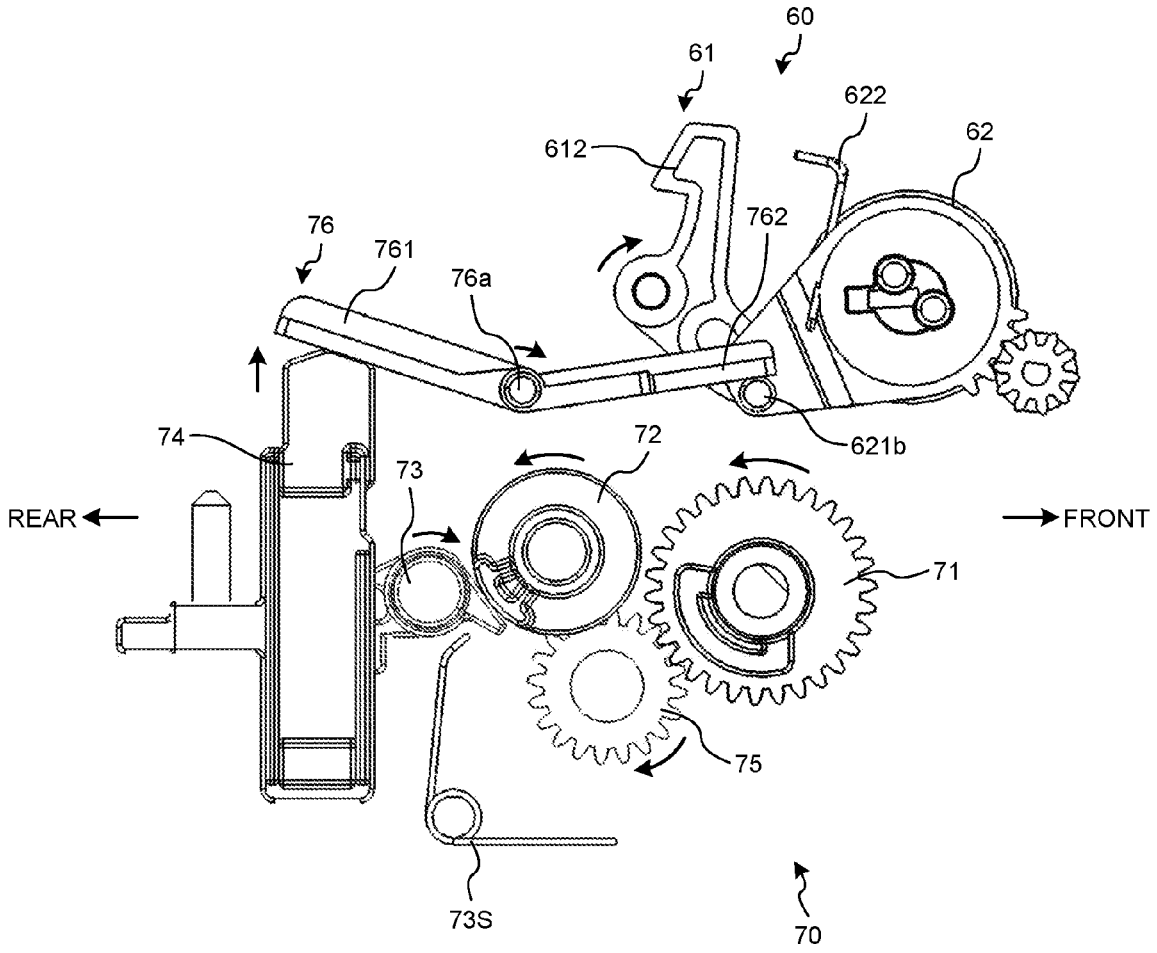
FIG. 26 is an explanatory diagram when the components of the dispensing lock unit and the lock mechanism at the right side are viewed from the left side.

As illustrated in FIG. 25 and FIG. 26, when the lock transmission unit 74 moves to the uppermost position, the sensor 77 detects the movement, and sends a detection signal to the control unit. Consequently, the control unit temporarily stops driving the conveyance and distribution motor 22*a*. Thus, the lock transmission unit 74 is disposed at the uppermost position.

When the lock transmission unit 74 moves from the lowermost position to the uppermost position, the lock action lever 76, in which the action lever input unit 761 is abutted to the upper end of the lock transmission unit 74, rotates around the center axis of the lock action lever axis 76*a*. Consequently, the action lever output unit 762 is displaced downward. Because the action lever output unit 762 presses the second input projection 621*b* downward, the operation input unit 62 is brought into a releasing posture against the energizing force of the input spring 622. Hence, the lock action piece 61 swings forward and turns the dispensing lock unit 60 in a non-locked state. Because the lock transmission unit 74 is disposed at the uppermost position, the dispensing lock unit 60 is maintained in a non-locked state.

When the conveyance and distribution motor 22*a* is driven based on an instruction from the control unit after a predetermined time has passed, the lock drive gear 71 and the lock transmission gear 72 rotate in the clockwise direction when viewed from the right. Then, when the lock transmission projection 721 of the lock transmission gear 72 is removed from the transmission lever input unit 732, the lock transmission lever 73 returns to the basic posture by the energizing force of the lock transmission lever spring 73S. As a result, the lock transmission unit 74 moves to the lowermost position by the energizing force of the lock transmission spring 74S. When the lock transmission unit 74 moves to the lowermost position in this manner, the lock action lever 76 returns to the original state, because the operation input unit 62 is in the basic posture by the input spring 622.

In this manner, while the dispensing box 50 is mounted on the device main body 2, the lock mechanism 70 turns the dispensing lock unit 60 into a locked state in the normal state, and turns the dispensing lock unit 60 into a non-locked state when a releasing instruction is given.

An operation of the banknote processing device having the above configuration will now be described. First, a depositing operation will be described.

When banknotes are fed into the depositing unit 20 through the depositing port 2*a*, and the user performs an input operation on the input unit, which is not illustrated, to give a depositing instruction, the banknote processing device delivers the banknotes, which are fed into the depositing unit 20, to the conveyance path 30 for conveyance, by driving the conveyance pulley and the like. The banknote processing device that has conveyed the banknotes through the conveyance path 30 causes the discriminating unit 31 to discriminate the authenticity and denomination of the banknotes being conveyed, in the course of conveyance.

When the discriminating unit 31 discriminates that the banknotes are "genuine" and discriminates the denomination of the banknotes, the banknote processing device conveys the banknotes being discriminated to the predetermined storage unit 40 that is designated for each denomination through the conveyance path 30. In the storage unit 40 to which the banknotes are conveyed in this manner, the banknotes are stored by performing the storage operation as described above.

Next, a dispensing operation will be described. When the user performs an input operation on the input unit to give a dispensing instruction, the banknote processing device delivers the banknotes, which are stored in the predetermined storage unit 40, to the conveyance path 30 for conveyance, by driving the conveyance pulley and the like. The banknote processing device that has conveyed the banknotes through the conveyance path 30 causes the determining unit 32 to determine the denomination and number of the banknotes being conveyed, in the course of conveyance.

After the denomination or the like is determined by the determining unit 32, the banknote processing device delivers the banknotes being determined to the dispensing box 50 through the conveyance path 30 for accommodation. When a dispensing preparation is completed by accommodating a predetermined number of banknotes in the dispensing box 50 in this manner, the banknote processing device turns the dispensing lock unit 60 into a non-locked state by giving a releasing instruction to the lock mechanism 70 via the control unit, as described above. The banknote processing device then allows the dispensing door 53 to swing in the opening direction, and discharges the banknotes that are stored in the dispensing box 50 to the outside, from the dispensing port 51.

Furthermore, a collecting operation will now be described. When the manager or the like performs an input operation on the input unit for the manager to give a collecting instruction, the banknote processing device delivers the banknotes that are stored in all the storage units 40 to the conveyance path 30, causes the conveyance path 30 to convey the banknotes forward, and accommodates the banknotes in the dispensing box 50, by driving the conveyance pulley and the like. In the dispensing box 50, the dispensing door 53 always closes the dispensing port 51 because the dispensing lock unit 60 is in a locked state by the lock mechanism 70.

When the banknotes in all the storage units 40 are accommodated in the dispensing box 50 in this manner, the banknote processing device allows the dispensing box 50 to be removed from the device main body 2, when an operation of inserting an ejection key into an ejection key hole is carried out. The dispensing box 50 that is removed in this manner will be stored in the safe managed by the manager.

To take out the banknotes from the dispensing box 50 that is removed from the device main body 2 in this manner, the dispensing lock unit 60 is turned into a non-locked state by performing a releasing operation of inserting a dispensing key into the input key hole 623. Consequently, the dispensing door 53 swings in the opening direction, and the banknotes can be taken out from the dispensing port 51.

In the banknote processing device of the second embodiment having the above configuration, the dispensing box 50 is detachably provided in the device main body 2. Also, the dispensing box 50 functions as a conventional collection box, because the dispensing box 50 collects the banknotes that are stored in the storage units 40 when a collecting instruction is given. In this manner, the installation space of the collection box can be reduced, thereby reducing the overall size of the device. Furthermore, because the dispensing box 50 is detachably provided in the device main body 2, the dispensing box 50 can be stored in a predetermined safe and the like by removing the dispensing box 50 from the device main body 2, after accommodating the banknotes that are stored in the storage units 40 in the dispensing box 50. Consequently, there is no need to take out the banknotes from the dispensing box 50, thereby improving the security.

In the banknote processing device described above, the dispensing box 50 includes the dispensing lock unit 60 that is in a locked state for restricting the dispensing door 53, which opens and closes the dispensing port 51, from moving in the opening direction in the normal state, and that is in a non-locked state for allowing the dispensing door 53 to move in the opening direction when a releasing operation is performed. Consequently, even when the dispensing box 50 is removed from the device main body 2, the dispensing port 51 can be prevented from opening easily, thereby improving the security. Also, the accommodated banknotes can be taken out by operating the dispensing lock unit 60 and opening the dispensing port 51. While the dispensing box 50 is mounted on the device main body 2, the lock mechanism 70 turns the dispensing lock unit 60 in a locked state in the normal state, and turns the dispensing lock unit 60 in a non-locked state when a releasing instruction is given. Consequently, even if the dispensing box 50 is mounted on the device main body 2, the dispensing port 51 can be prevented from opening easily, thereby improving the security. Furthermore, the dispensing port 51 can be opened by automatically turning the dispensing lock unit 60 in a non-locked state by the releasing instruction. Consequently, the accommodated banknotes can be easily taken out.

In the banknote processing device described above, the guide unit 52 of the dispensing box 50 is communicably connected to the depositing port 2*a*, when the dispensing box 50 is mounted on the device main body 2, and a part of the guide unit 52 functions as a gripping unit, when the dispensing box 50 is removed from the device main body 2. Thus, the dispensing box 50 that is removed from the device main body 2 can be easily held, by gripping the gripping unit. Hence, the transportability and operability of the dispensing box 50 can be improved.

In the banknote processing device described above, when the dispensing door 53 swings downward to close the dispensing port 51, the front end portion of the slide member 54 of the dispensing box 50 slides toward the front and comes into contact with the end of the dispensing door 53. When the dispensing door 53 swings upward to open the dispensing port 51, the slide member 54 slides toward the rear so as to expose the lower portion of the bottom banknote among the accommodated banknotes. Consequently, the banknotes can be taken out by sandwiching the banknotes between the fingers from upper and lower sides, without pushing out the banknotes as in the conventional device. Consequently, the banknotes can be prevented from being hooked to the dispensing door 53 and the like, thereby suitably discharging the banknotes from the dispensing port 51.

In the storage unit 40 of the banknote processing device described above, the pusher member 43 moves forward and rearward, while the pinion 451 of the pusher member 43 is meshed with the rack 452 of the storage bottom 40B. Consequently, the posture of the pusher member 43 can be restricted so that the action surface 43*a* of the pusher member 43 is always in parallel with the storage surface 41*a* of the storage wall 41. Hence, a generation of an accumulation failure can be prevented such as a paper jam in the accumulation area S1.

Third Embodiment

Figure 27:
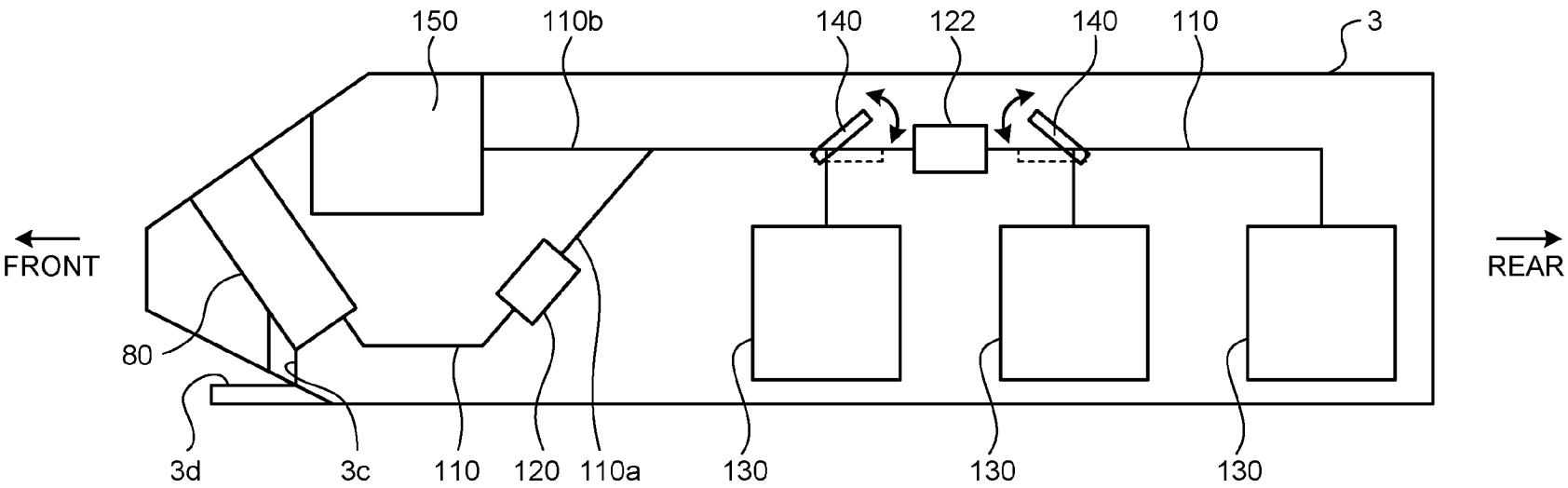
FIG. 27 is an explanatory diagram schematically illustrating a banknote processing device of a third embodiment of the disclosure.

FIG. 27 is an explanatory diagram schematically illustrating a banknote processing device of a third embodiment of the disclosure. The banknote processing device illustrated in this example is applied as a changing machine, for example, and includes a device main body 3.

The device main body 3 includes a depositing unit 80, a discriminating unit 120, a determining unit 122, storage units 130, and a dispensing box 150.

Figure 28:
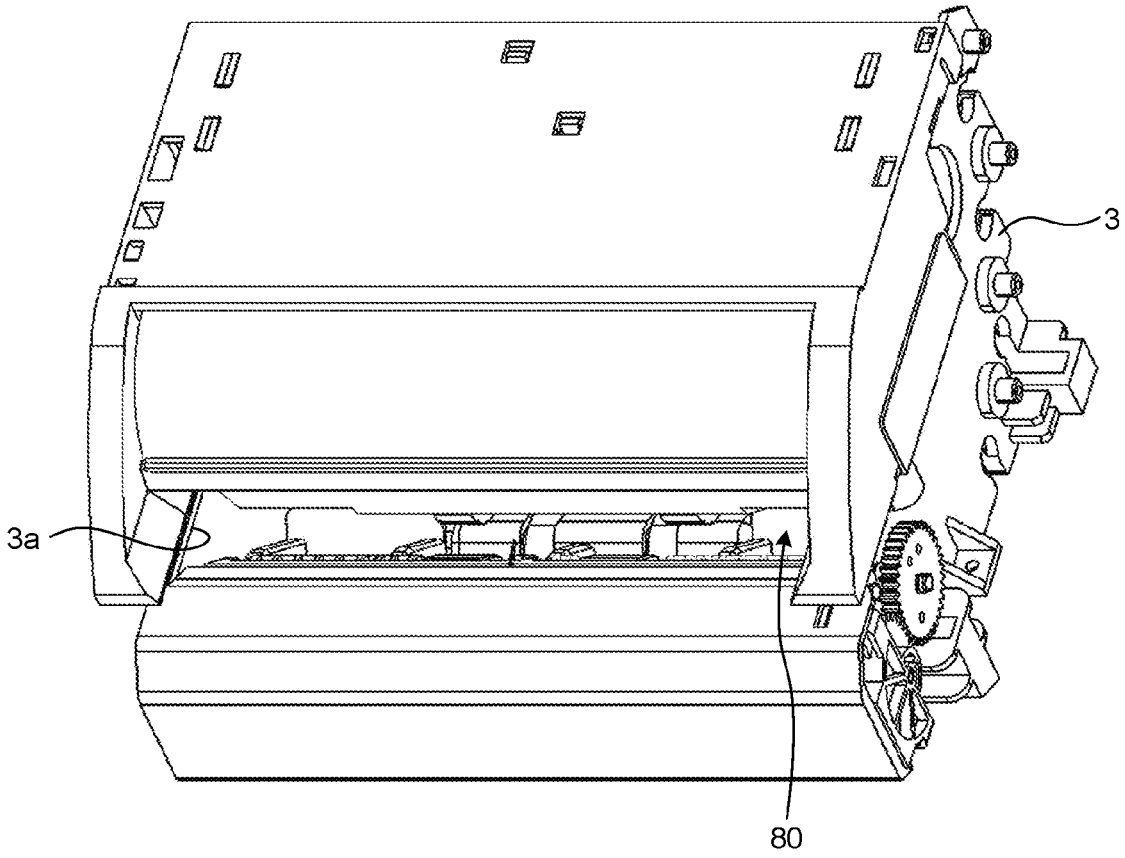
FIG. 28 is a perspective view illustrating a front end portion of a device main body illustrated in FIG. 27.
Figure 29:
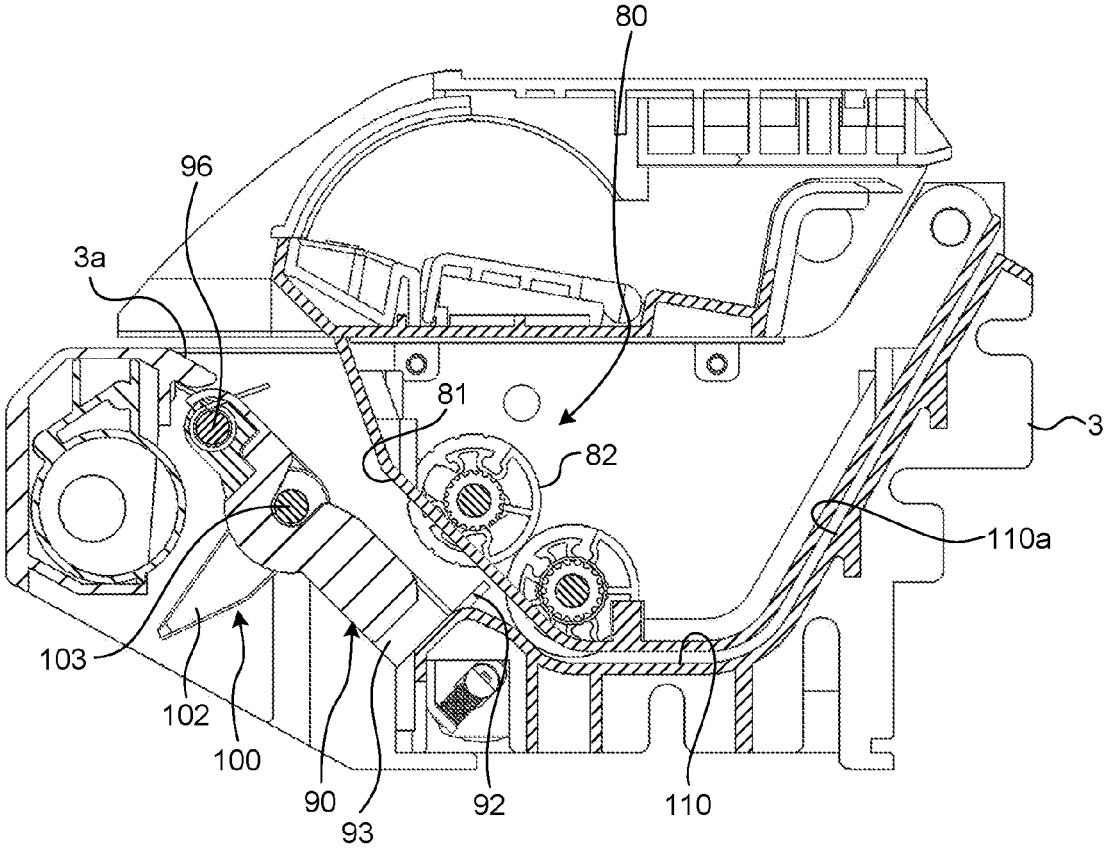
FIG. 29 is a sectional side view illustrating the front end portion of the device main body illustrated in FIG. 27.

As illustrated in FIG. 28 and FIG. 29, the depositing unit 80 is provided at the front end portion of the device main body 3. The depositing unit 80 includes a depositing path 81, a stopper member 90, and a pressing member 100.

The depositing path 81 is communicably connected to a depositing port 3*a* that is formed at the front end portion of the device main body 3. The depositing path 81 is gradually inclined downward as the depositing path 81 is away from the depositing port 3*a*. In other words, the depositing path 81 is gradually inclined downward toward the rear. A conveyance path 110 is provided in the downstream side of the depositing path 81. The conveyance path 110 conveys the banknotes that have passed through the depositing path 81, and extends along the front-to-rear direction in the device main body 3. More specifically, the conveyance path 110 includes an inclination path 110*a* that is gradually inclined upward toward the rear from the portion where the inclination path 110*a* is connected to the depositing path 81. In other words, the inclination path 110*a* is gradually inclined upward as the inclination path 110*a* is away from an outlet of the depositing unit 80. The conveyance path 110 extends toward the rear, after the inclination path 110*a*. Although not illustrated, the conveyance path 110 conveys the banknotes from the front to the rear, and also conveys the banknotes from the rear to the front, when the conveyance belts that are stretched over the conveyance pulleys are displaced.

Figure 30:
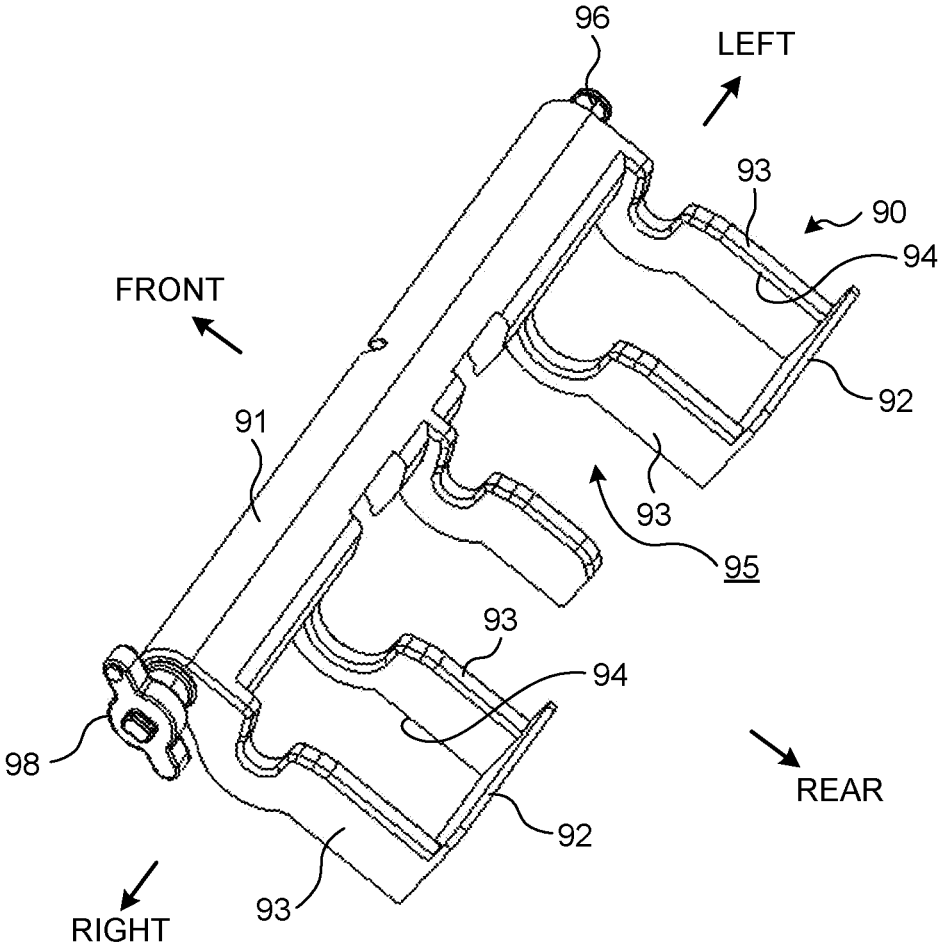
FIG. 30 is a perspective view illustrating a stopper member.
Figure 31:
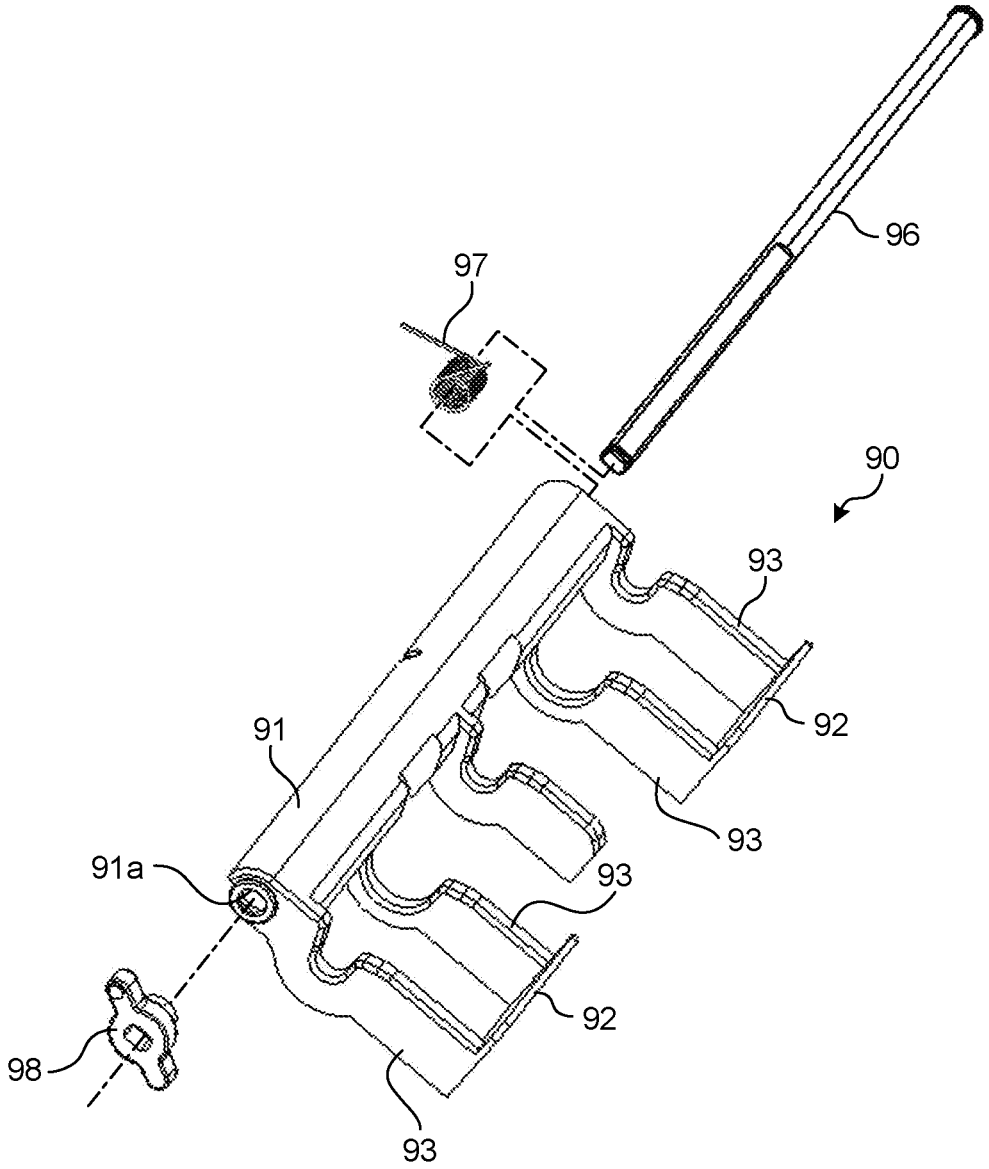
FIG. 31 is an exploded perspective view illustrating the stopper member.

FIG. 30 and FIG. 31 are diagrams each illustrating the stopper member 90. FIG. 30 is a perspective view of the stopper member 90, and FIG. 31 is an exploded perspective view of the stopper member 90. As illustrated in FIG. 30 and FIG. 31, for example, the stopper member 90 is made of resin or the like, and includes a stopper base 91 and stopper pieces 92.

The stopper base 91 is a long portion in which the left-to-right direction is the longitudinal direction, and a through hole 91*a* is formed along the longitudinal direction.

The stopper pieces 92 connect rear ends of left and right pairs of arm units 93 that are placed at the left and right ends of the stopper base 91 and project toward the rear. The stopper pieces 92 project more upward than the arm units 93.

In the stopper member 90 as described above, a rectangular-shaped opening portion 94 is formed between the stopper base 91 and the stopper piece 92. Also, an opened portion 95 is formed between the stopper pieces 92. The opening portions 94 and the opened portion 95 form discharge openings.

Figure 32:
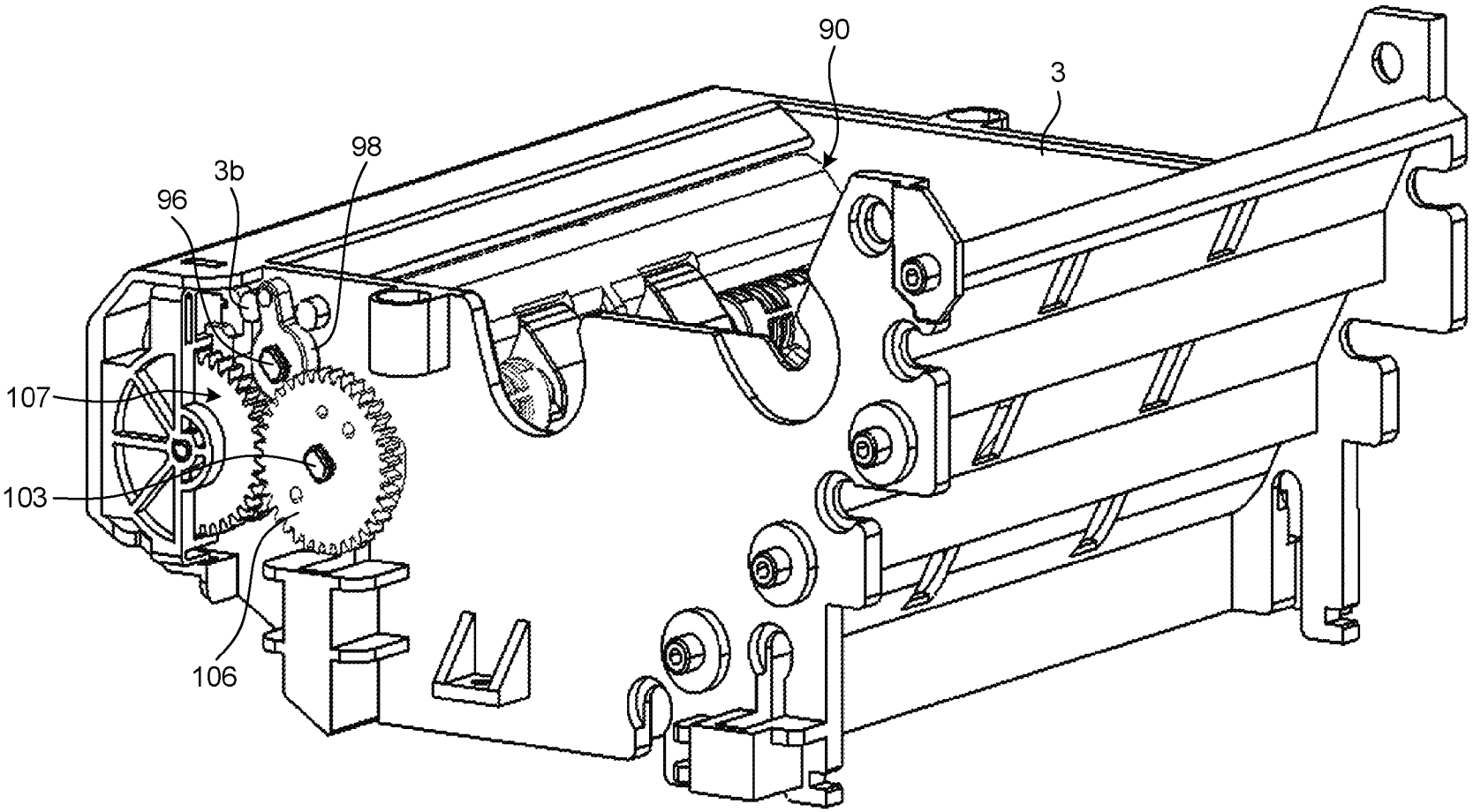
FIG. 32 is a perspective view illustrating the main part of the front end portion of the device main body illustrated in FIG. 28.

In the stopper member 90 described above, a stopper axis 96 penetrates through the through hole 91*a* that is formed in the stopper base 91. Also, as illustrated in FIG. 32, because the device main body 3 supports both ends of the stopper axis 96, the stopper member 90 is swingable around the center axis of the stopper axis 96. In other words, the stopper member 90 moves forward and rearward relative to the depositing path 81 in a swingable manner.

Figure 33:
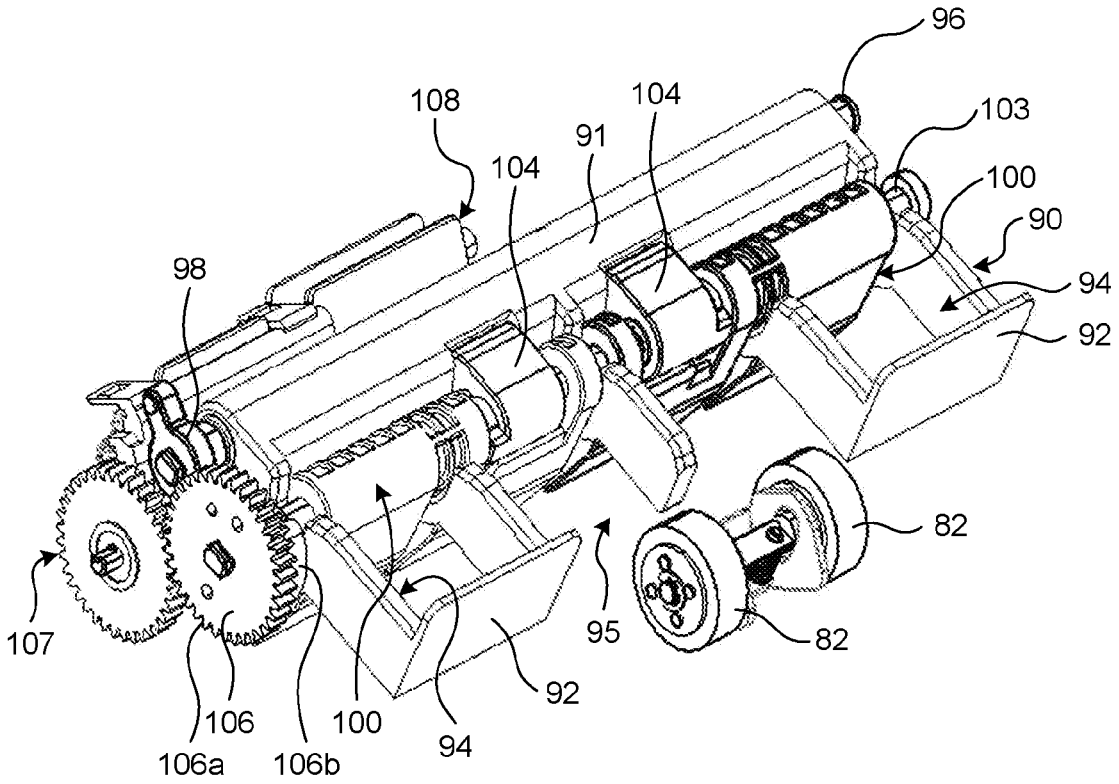
FIG. 33 is a perspective view illustrating the stopper member and a pressing member included in a depositing unit.

A stopper spring 97 is wound around the stopper axis 96, and the stopper spring 97 is interposed between the stopper member 90 and the device main body 3. The stopper member 90 is energized by the stopper spring 97 so that the stopper member 90 moves forward toward the depositing path 81. Thus, as illustrated in FIG. 28 and FIG. 33, in the normal state, the stopper member 90 moves forward relative to the depositing path 81 by the stopper spring 97. The amount of the forward movement of the stopper member 90 toward the depositing path 81 is restricted, because a stopper transmission unit 98 that is inserted into the stopper axis 96 abuts to a stopper pin 3*b* being provided in the device main body 3, as illustrated in FIG. 32. When the stopper member 90 moves forward relative to the depositing path 81, and the amount of the forward movement is restricted, the projection height of the stopper piece 92 in the upward direction or the like is adjusted so that the banknotes is restricted from passing between the upper side of the stopper piece 92 and the upper wall of the depositing path 81.

When the stopper member 90 moves forward toward the depositing path 81, the depositing path 81 and a discharge path 3*c* are communicably connected via the discharge openings 94 and 95. In this example, the discharge path 3*c* is communicably connected to the depositing path 81, and is a path for discharging foreign matters other than banknotes such as a coin to the outside. The foreign matters that have passed through the discharge path 3*c* are guided to a receptacle 3*d* that is provided in the device main body 3.

Figure 34:
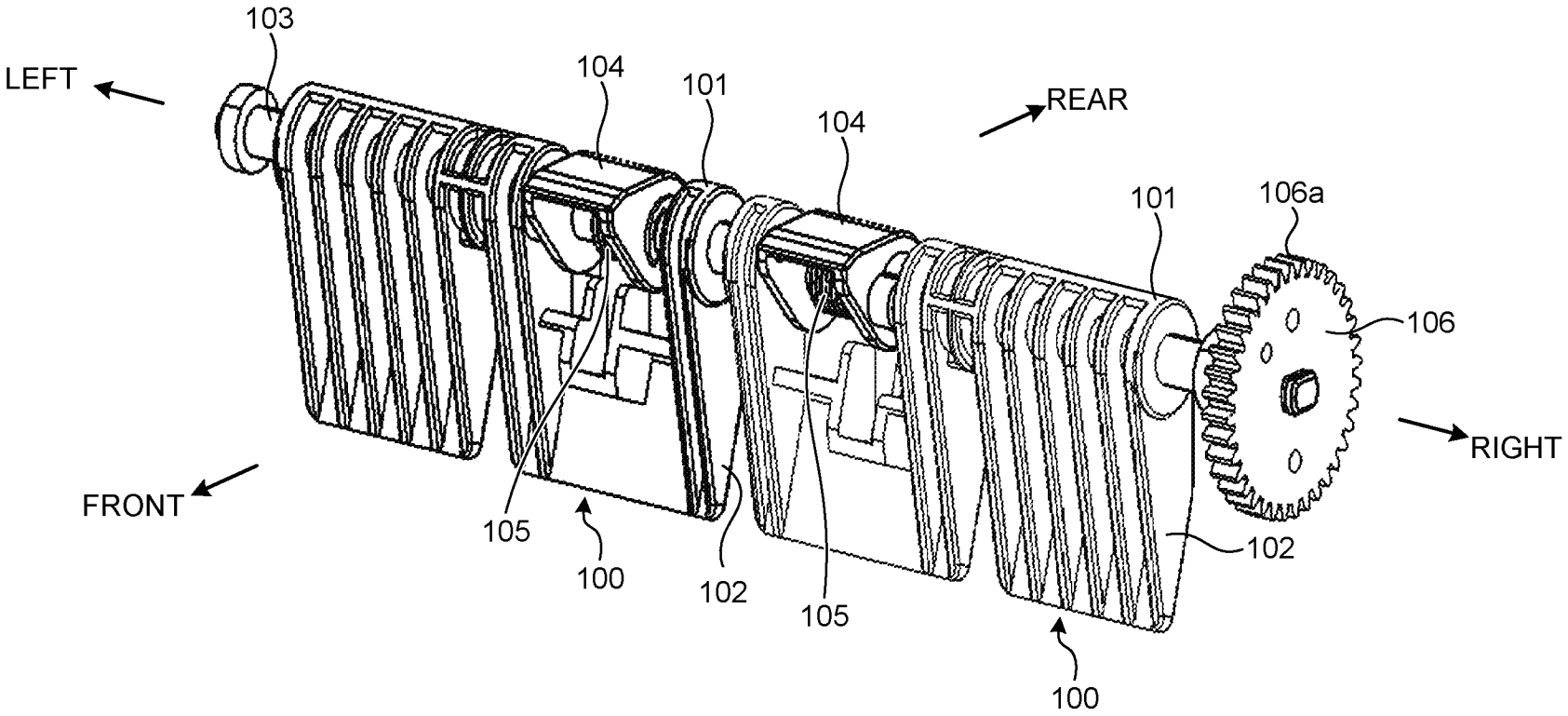
FIG. 34 is a perspective view illustrating the pressing member.
Figure 35:
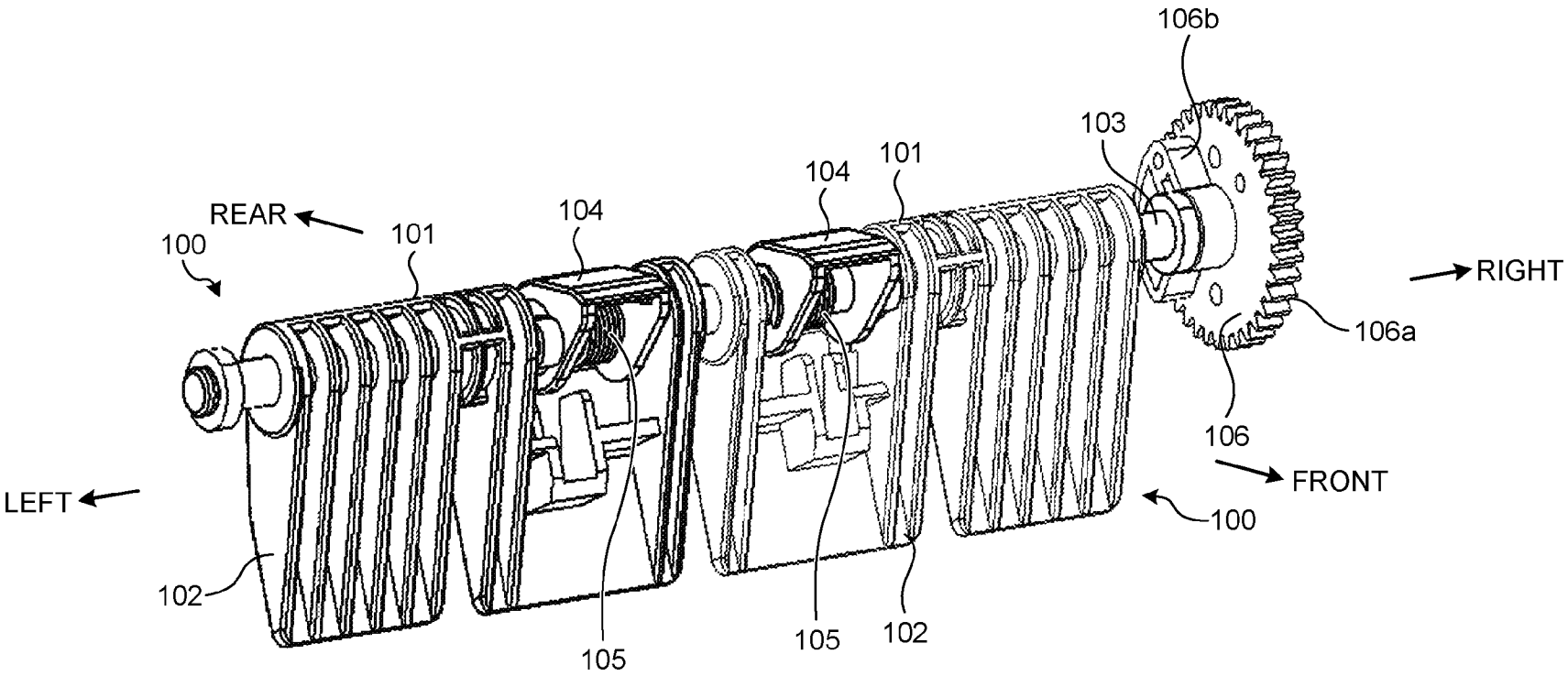
FIG. 35 is a perspective view illustrating the pressing member.
Figure 36:
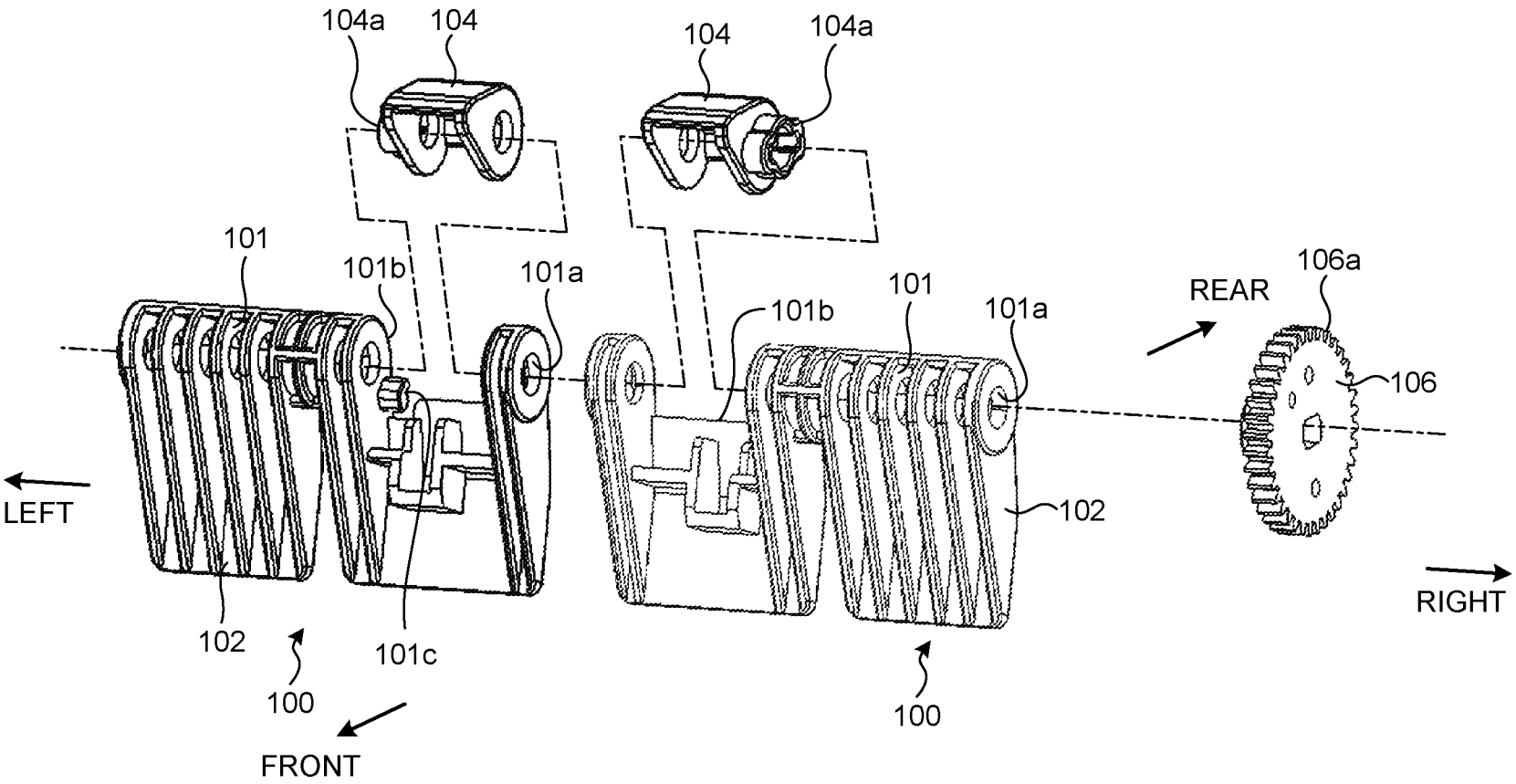
FIG. 36 is an exploded perspective view illustrating the pressing member.
Figure 37:
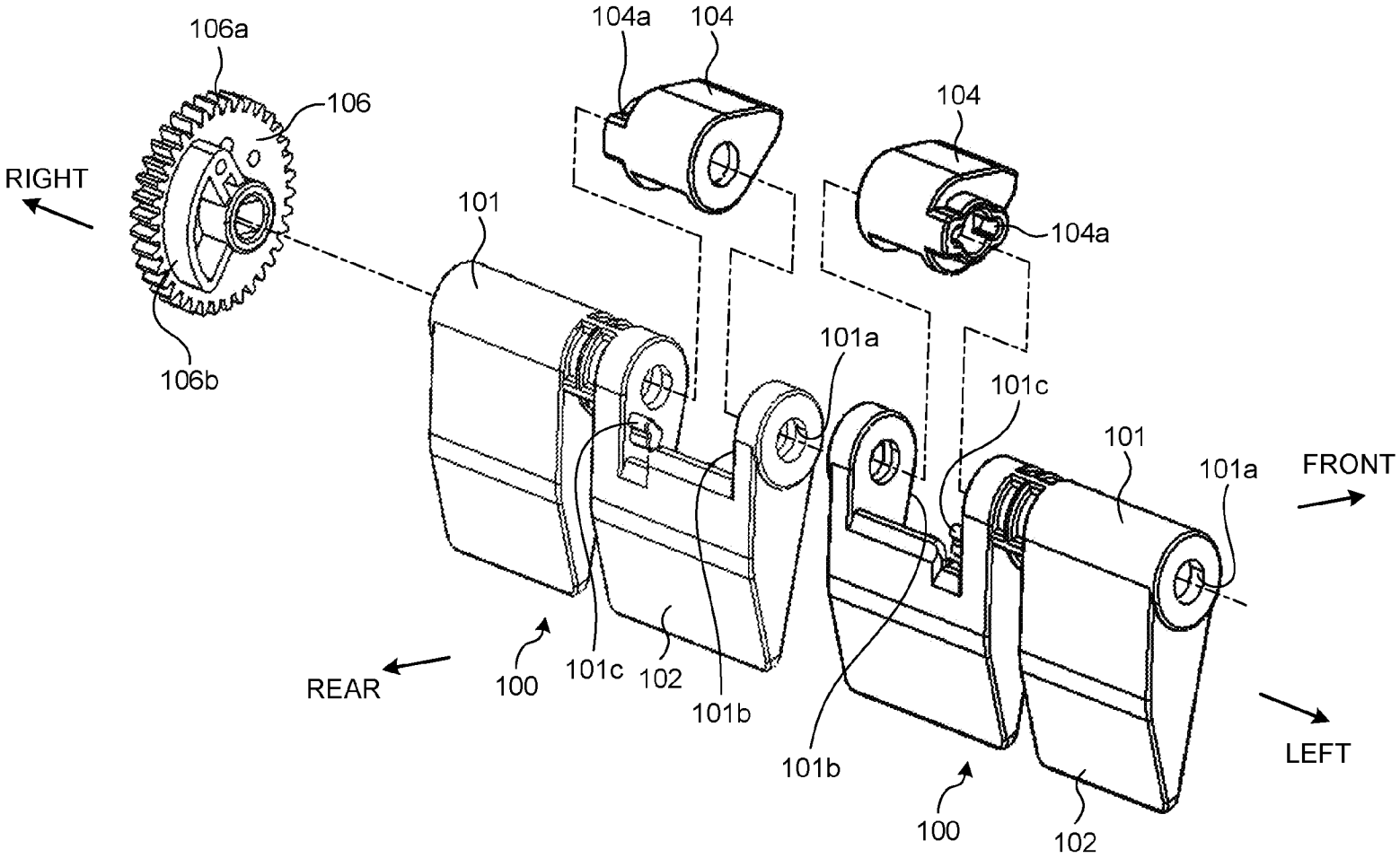
FIG. 37 is an exploded perspective view illustrating the pressing member.

FIG. 34 to FIG. 37 each illustrates the pressing member 100. FIG. 34 and FIG. 35 are perspective views of the pressing member 100, and FIG. 36 and FIG. 37 are exploded perspective views of the pressing member 100. As illustrated in FIG. 34 to FIG. 37, there is a pair of left and right pressing members 100. Each of the pressing members 100 is made of resin or the like, for example, and includes a pressing base 101 and a pressing end 102.

A through hole 101*a* that extends along the left-to-right direction is formed in the pressing base 101. The pressing end 102 is integrally formed on the pressing base 101, and extends toward the radially outward direction of the through hole 101*a*.

In the pressing member 100 as described above, a pressing axis 103 penetrates through the through hole 101*a* that is formed in the pressing base 101. Also, as illustrated in FIG. 32, because the device main body 3 supports both ends of the pressing axis 103, the pressing member 100 is swingably provided around the center axis of the pressing axis 103. In other words, the pressing member 100 moves forward and rearward relative to the depositing path 81 in a swingable manner.

A fixing unit 104 that has entered a notch 101*b* being formed on the pressing base 101 of each pressing member 100 is integrally connected to the pressing axis 103. A pressing spring 105 is wound around the pressing axis 103, and the pressing spring 105 is interposed between the pressing member 100 and the fixing unit 104. In the pressing member 100, the pressing end 102 is always energized toward the rear by the pressing spring 105. In the pressing member 100, an engagement projection 101*c* that is provided at the periphery of the notch 101*b* is engaged with an engagement restricting unit 104*a* that is provided on the corresponding fixing unit 104. Thus, the pressing member 100 is restricted from swinging toward the rear by the pressing spring 105.

A pressing transmission unit 106 in a disk shape is connected to the right end portion of the pressing axis 103 described above. The pressing transmission unit 106 has a gear unit 106*a* at the outer periphery, and has a cam unit 106*b* on the left surface. The gear unit 106*a* of the pressing transmission unit 106 is linked to an output axis, which is not illustrated, of a motor 108 via a transmission mechanism 107 that is made of a plurality of gear members. The motor 108 is a drive source that drives based on an instruction from the control unit, which is not illustrated, and rotates the output axis in forward and reverse directions. The cam unit 106*b* projects toward the left from the left surface of the pressing transmission unit 106, and can be abutted to the stopper transmission unit 98.

In the depositing unit 80 having the configuration as described above, as illustrated in FIG. 28, FIG. 29, and FIG. 33, in a standby state, the stopper member 90 moves forward toward the depositing path 81, while the pressing member 100 moves rearward from the depositing path 81. Consequently, the depositing path 81 and the discharge path 3*c* are communicably connected via the discharge openings 94 and 95, and the upper portion of the stopper piece 92 is brought close to the upper wall of the depositing path 81.

When banknotes are deposited from the depositing port 3*a* in the standby state, the banknotes pass through the depositing path 81, abut to the stopper piece 92, and are retained. When the user operates the input unit, which is not illustrated, and a depositing instruction is given from the control unit, after the banknotes are deposited through the depositing port 3*a* in this manner, the motor 108 rotates the output axis in the forward direction, and the power is transmitted to the pressing transmission unit 106 via the transmission mechanism 107. Thus, the pressing transmission unit 106 rotates in the counterclockwise direction when viewed from the right. When the pressing transmission unit 106 is rotated, the pressing axis 103 and the fixing unit 104 that is connected to the pressing axis 103 are integrally rotated. With the rotation of the fixing unit 104, the pressing member 100 also swings around the center axis of the pressing axis 103 by the energizing force of the pressing spring 105 so that the pressing end 102 moves toward the rear. Hence, the pressing member 100 moves forward relative to the depositing path 81.

Figure 38:
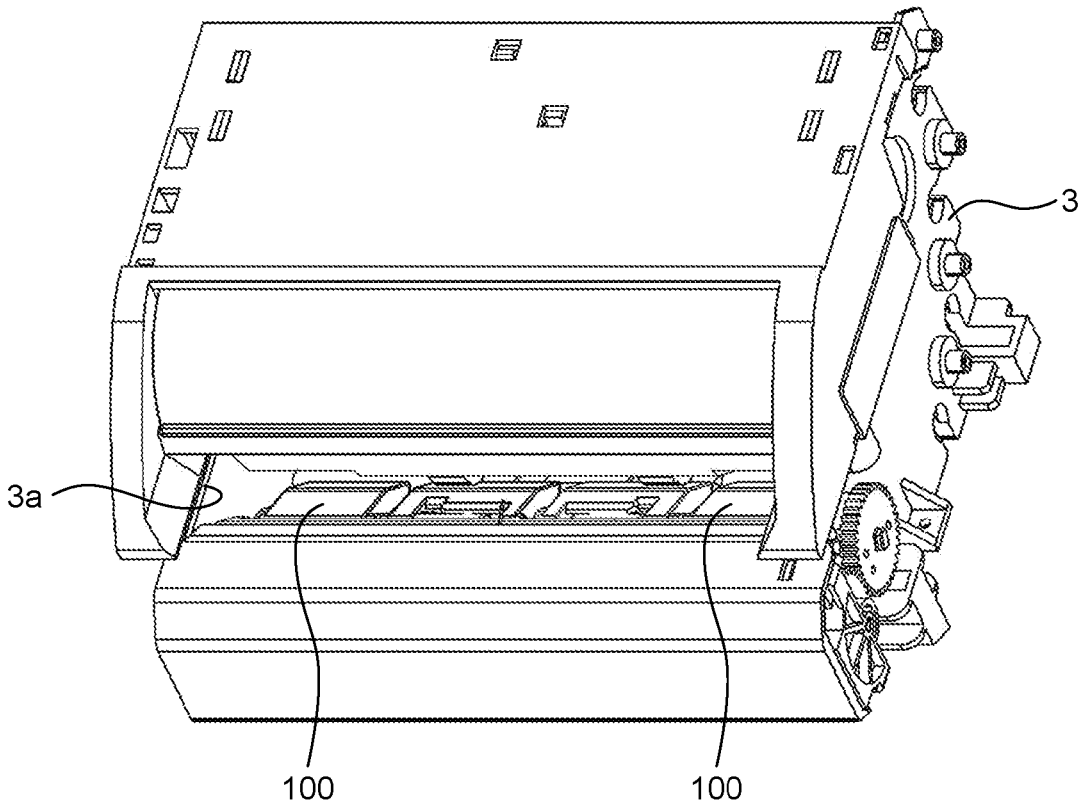
FIG. 38 is a perspective view illustrating the front end portion of the device main body.
Figure 39:
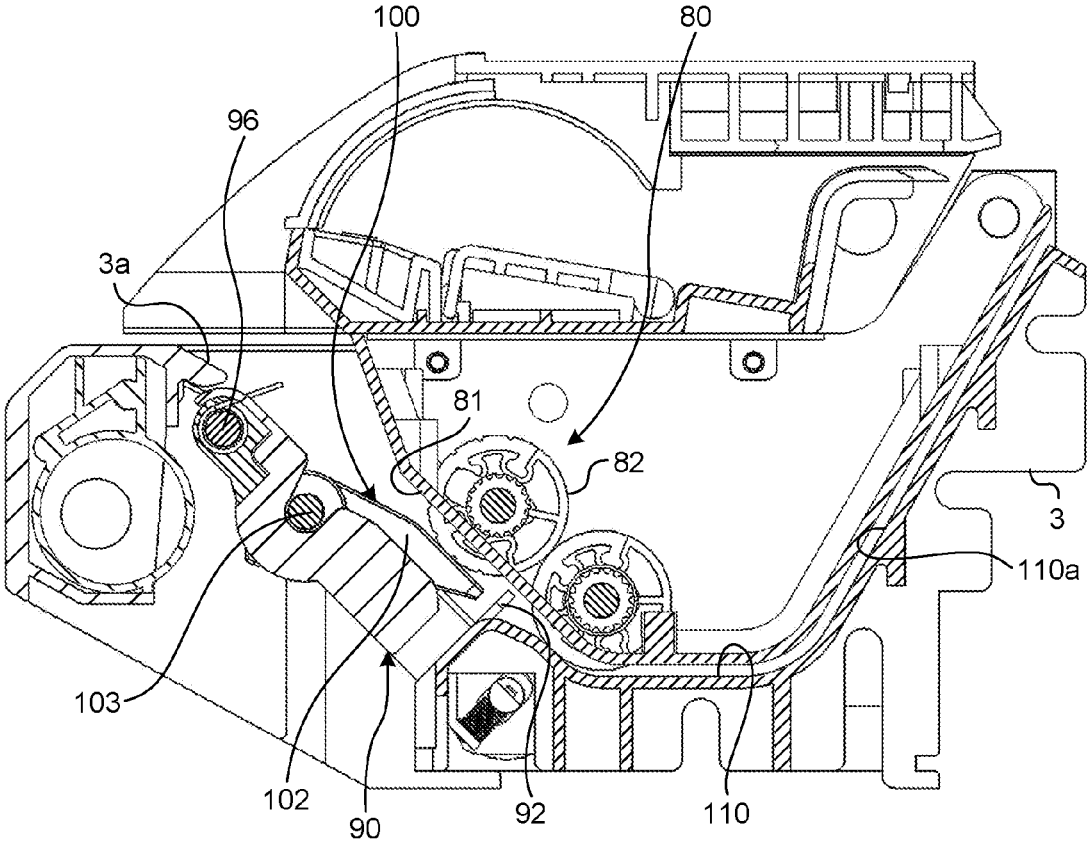
FIG. 39 is a sectional side view illustrating the front end portion of the device main body illustrated in FIG. 38.
Figure 40:
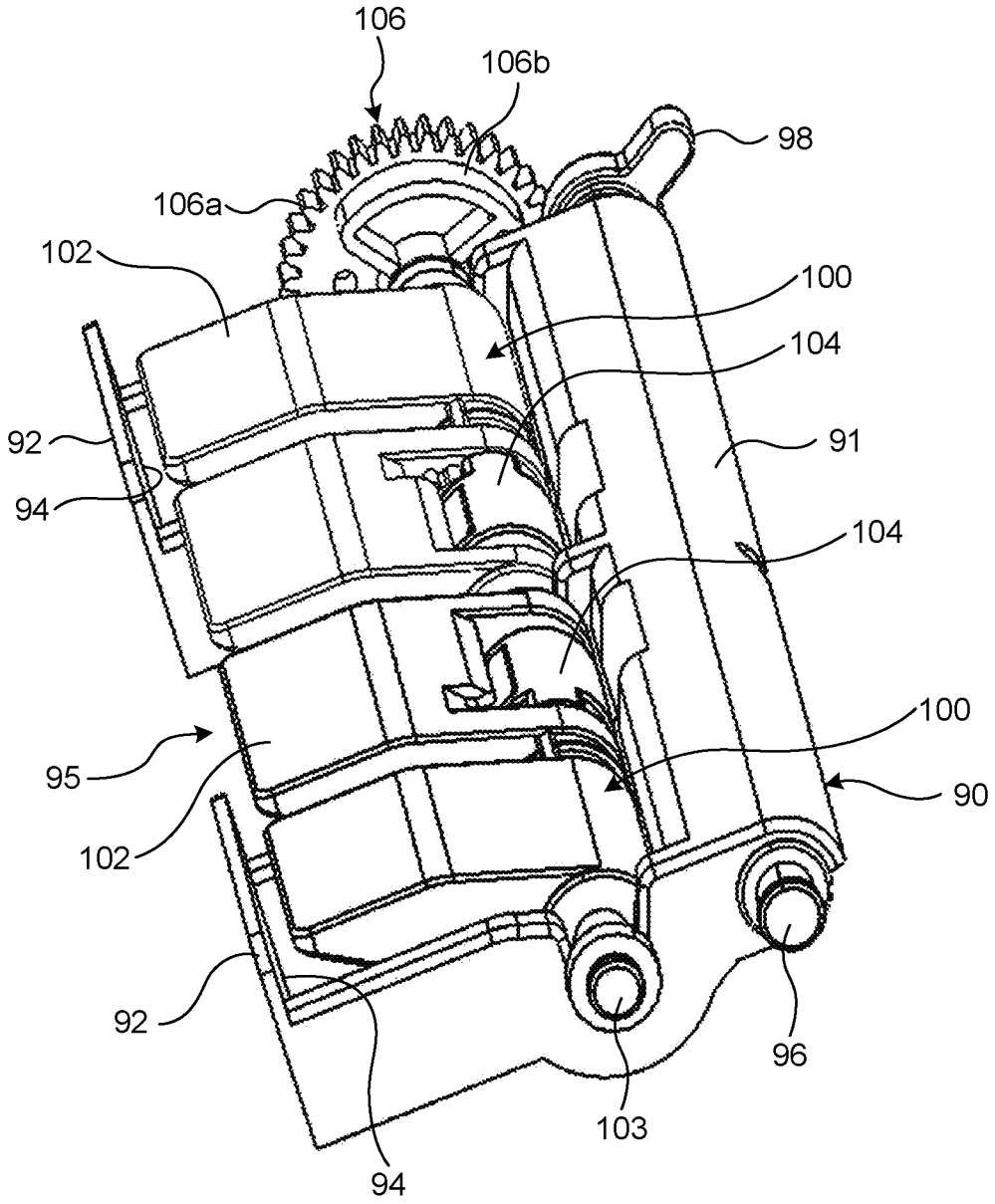
FIG. 40 is a perspective view illustrating the main part of the depositing unit when the pressing member has moved forward.

When the pressing member 100 moves forward toward the depositing path 81, as illustrated in FIG. 38 to FIG. 40, the pressing member 100 passes the discharge openings 94 and 95 of the stopper member 90, and the pressing end 102 presses the retained banknotes against a sending roller 82. The sending roller 82 is driven based on an instruction from the control unit, and when driven, the sending roller 82 sends the banknotes to the conveyance path 110 one by one.

Figure 41:
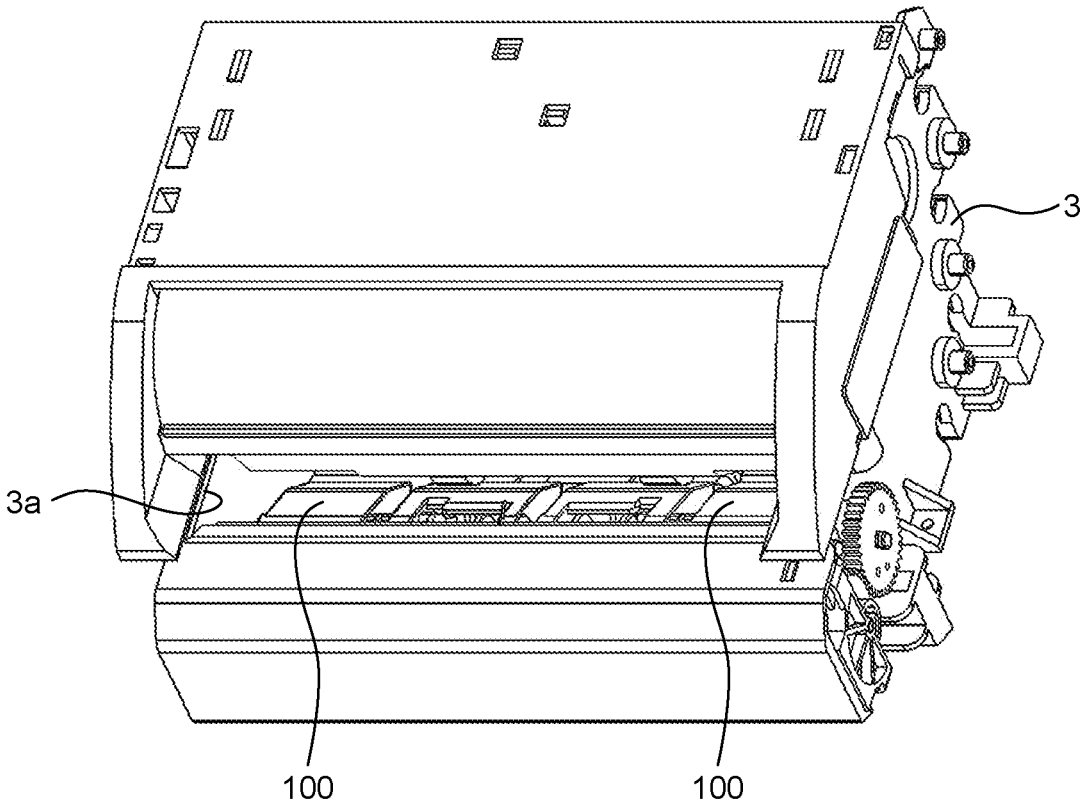
FIG. 41 is a perspective view illustrating the front end portion of the device main body.
Figure 42:
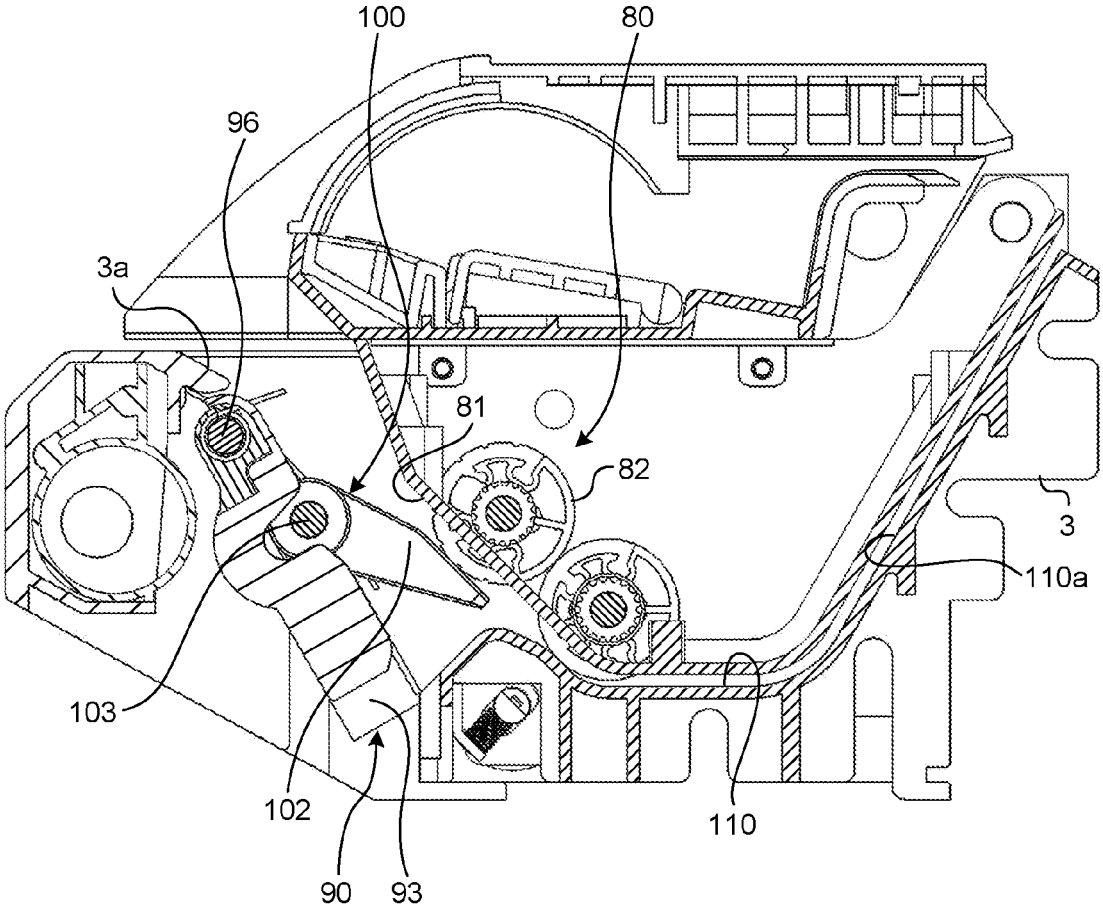
FIG. 42 is a sectional side view illustrating the front end portion of the device main body illustrated in FIG. 41.
Figure 43:
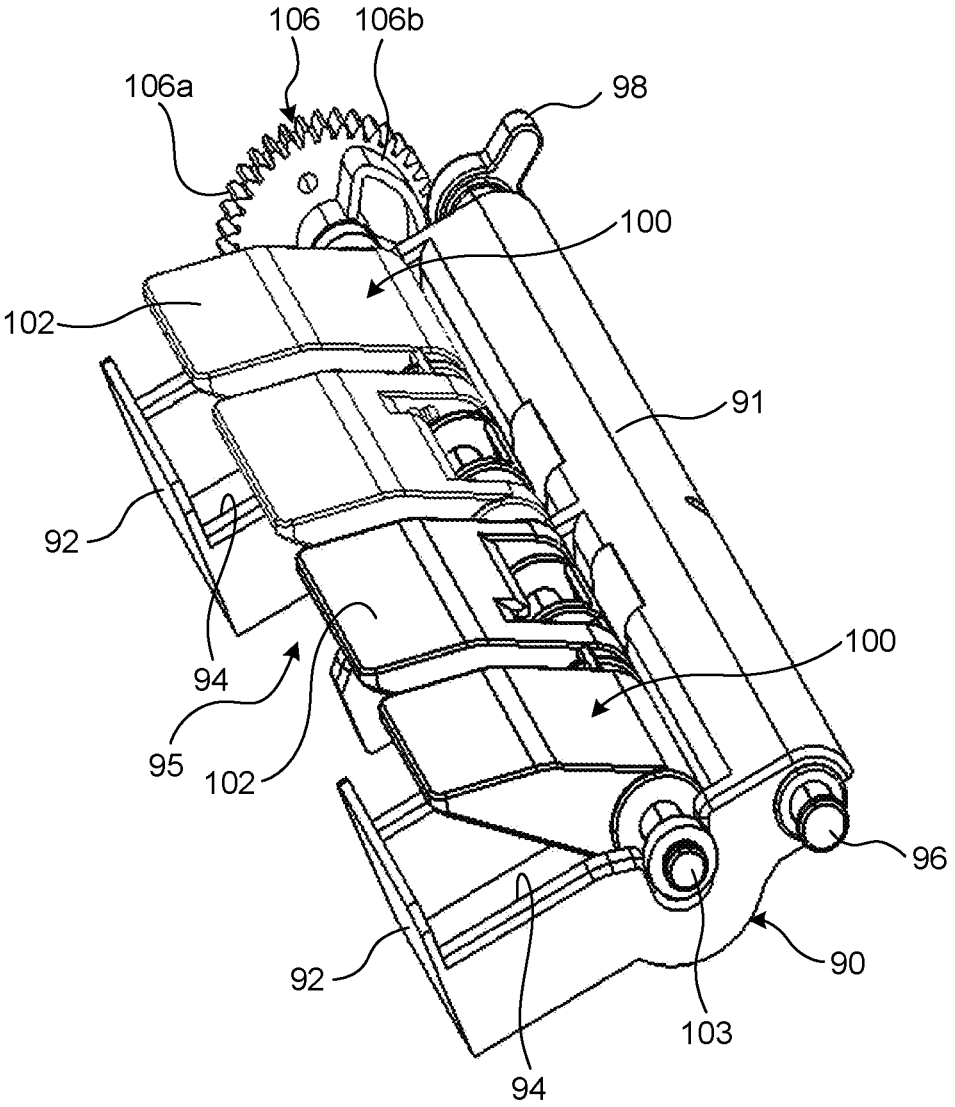
FIG. 43 is a perspective view illustrating the main part of the depositing unit when the stopper member has moved rearward.

When the pressing transmission unit 106 is further rotated in the same direction by the drive of the motor 108, the cam unit 106*b* abuts to the lower end portion of the stopper transmission unit 98, and rotates the stopper transmission unit 98 in the clockwise direction when viewed from the right. Consequently, as illustrated in FIG. 41 to FIG. 43, the stopper member 90 moves rearward from the depositing path 81 against the energizing force of the stopper spring 97. When the pressing transmission unit 106 is further rotated in the same direction, the pressing axis 103 is also rotated, as well as the fixing unit 104. However, the pressing member 100 presses the banknotes against the sending roller 82, and the forward movement of the pressing member 100 relative to the depositing path 81 is restricted. As a result, the pressing spring 105 is twisted and the energizing force is increased. Consequently, the pressing force of the pressing member 100 that presses the banknotes against the sending roller 82 is increased.

At a point when the pressing transmission unit 106 has rotated to a certain degree in this manner, and when the motor 108 stops driving based on an instruction from the control unit, the pressing transmission unit 106 stops rotating. Then, when the sending roller 82 is driven based on an instruction from the control unit, the sending roller 82 sends the banknotes to the conveyance path 110 one by one.

When all the retained banknotes are sent to the conveyance path 110 one by one in this manner, and the sending roller 82 stops driving based on an instruction from the control unit, the motor 108 rotates the output axis in the reverse direction based on an instruction from the control unit. Consequently, the pressing transmission unit 106 rotates in the clockwise direction when viewed from the right. Hence, when the cam unit 106*b* of the pressing transmission unit 106 stops pressing the stopper transmission unit 98, the stopper member 90 moves forward toward the depositing path 81 by the stopper spring 97. Then, when the pressing transmission unit 106 is rotated, the stopper member 90 moves rearward from the depositing path 81, and returns to the standby state as described above.

The discriminating unit 120 is placed in the middle of the inclination path 110*a* described above. The discriminating unit 120 discriminates the authenticity and denomination of the banknotes that are sent from the depositing unit 80 one by one and pass therethrough. The discrimination result by the discriminating unit 120 is given to the control unit as a discrimination signal.

The determining unit 122 is placed in the middle of the conveyance path 110 in the rear side of the discriminating unit 120. The determining unit 122 determines the denomination and number of the banknotes that pass therethrough. The determination result by the determining unit 122 is given to the control unit as a determination signal.

The storage units 130 are placed at the rear side of the device main body 3 below the conveyance path 110, and are disposed in the front-to-rear direction for each denomination. The storage unit 130 at the forefront is provided in the front side of the determining unit 122 and below the conveyance path 110.

Figure 44:
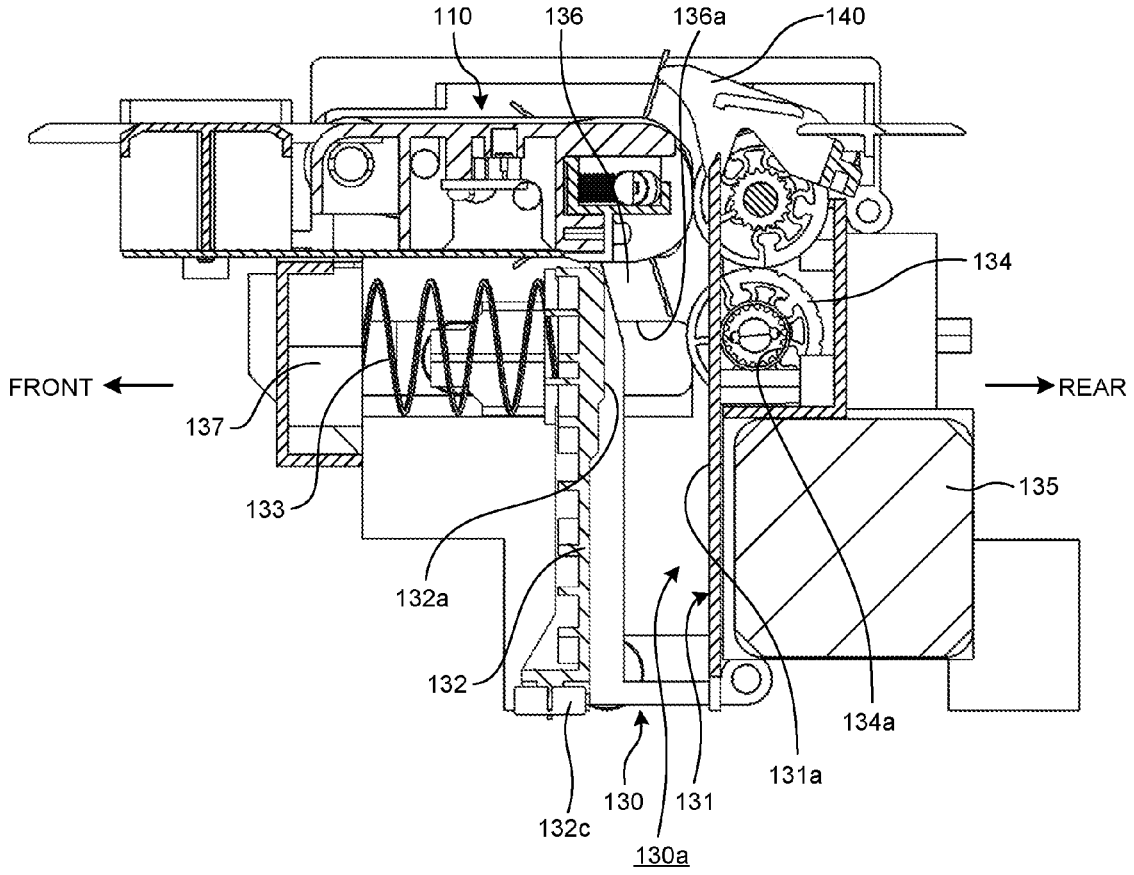
FIG. 44 is a longitudinal sectional view illustrating the second storage unit from the front.
Figure 45:
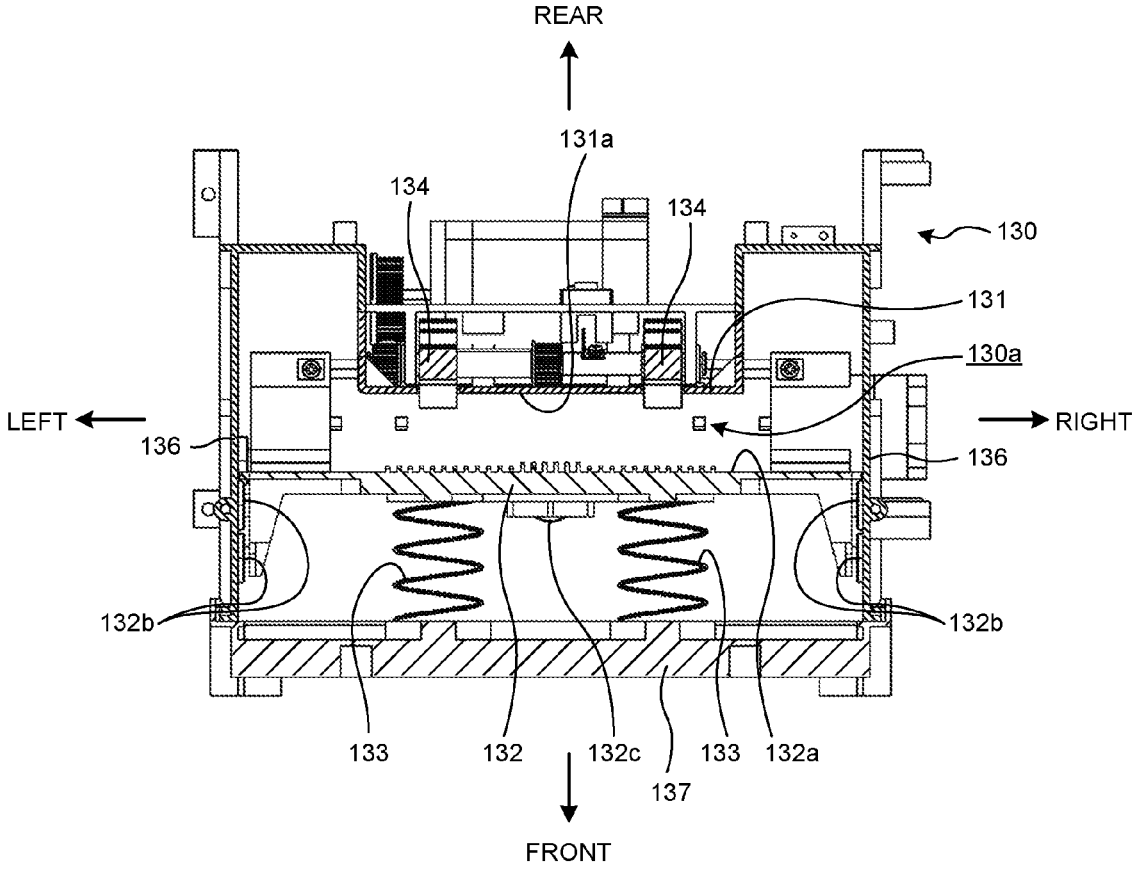
FIG. 45 is a transverse sectional view of the storage unit illustrated in FIG. 44.

FIG. 44 and FIG. 45 each illustrates the second storage unit 130 from the front. FIG. 44 is a longitudinal sectional view of the second storage unit 130 from the front, and FIG. 45 is a transverse sectional view of the second storage unit 130 from the front. As illustrated in FIG. 44 and FIG. 45, the storage unit 130 includes a storage wall 131, a slide member 132, and a slide energizing member 133.

The storage wall 131 is included in the rear wall of the storage unit 130. A kick roller 134 is provided on the storage wall 131. There are two kick rollers 134, and each of the kick rollers 134 is rotatable around the center axis of an axis member 134*a* that extends along the left-to-right direction. The kick rollers 134 are linked to a motor 135, and rotate in the clockwise direction or in the counterclockwise direction when viewed from the right, by the drive of the motor 135. A part of the outer peripheral surface of the kick rollers 134 projects forward from a storage surface 131*a* that is the front surface of the storage wall 131.

The slide member 132 is disposed so that an action surface 132*a* being the rear surface faces the storage surface 131*a* of the storage wall 131. In the slide member 132 as described above, guide rollers 132*b* that are provided on the left and right sides enter guide holes 136*a* of a pair of left and right guide members 136. Although not illustrated, when guide rollers 132*c* that are provided below the slide member 132 enter a bottom guide hole, the slide member 132 is slidable in the front-to-rear direction so as to approach to and be away from the storage wall 131. The slide member 132 forms a storage area 130*a* for storing banknotes with the storage wall 131.

The slide energizing member 133 is formed of what is called a spring member. The front end portion of the slide energizing member 133 is engaged with a front wall 137 of the storage unit 130, and the rear end portion of the slide energizing member 133 is engaged with a rear surface of the action surface 132*a* of the slide member 132. The slide energizing member 133 energizes the slide member 132 toward the rear so that the slide member 132 is brought close to the storage wall 131. In this example, the slide energizing member 133 is disposed at the same height level as that of the kick rollers 134. Also, the slide energizing member 133 is disposed so as to face a part of the outer peripheral surface of the kick rollers 134 projecting from the storage surface 131*a*, while the slide member 132 is interposed therebetween.

A reference numeral 140 in FIG. 44 and FIG. 45 is a distribution gate (distribution gate member). The distribution gate 140 is provided at the vicinity of an inlet of the storage unit 130, excluding the rearmost storage unit 130. The distribution gate 140 swings based on an instruction from the control unit. When the banknotes of the corresponding denomination are to be conveyed, based on the discrimination result by the discriminating unit 120, the distribution gate 140 swings upward, opens the inlet of the corresponding storage unit 130, and allows the banknotes to pass through the inlet. In other words, as a result of the discrimination by the discriminating unit 120, when the banknotes to be conveyed do not correspond to the denomination, the distribution gate 140 swings downward, closes the inlet of the corresponding storage unit 130, and restricts the banknotes from passing through the inlet. The distribution gate 140 also swings upward and opens the inlet, when the banknotes of the corresponding denomination are delivered from the storage unit 130 to the conveyance path 110.

In the storage unit 130 having the configuration as described above, as a result of the discrimination by the discriminating unit 120, when the banknotes of the corresponding denomination are to be conveyed, the banknotes are to be stored as follows. In other words, as illustrated in FIG. 44 and FIG. 45, the slide member 132 is slidably moved forward against the energizing force of the slide energizing member 133, by an actuator such as a solenoid, which is not illustrated. In other words, the slide member 132 is slidably moved so as to be away from the storage wall 131. After the slide member 132 is slidably moved in this manner, the motor 135 is driven based on an instruction from the control unit, and the kick rollers 134 rotate in the counterclockwise direction when viewed from the right.

In this manner, when the banknotes of the corresponding denomination that are conveyed through the conveyance path 110 have passed the inlet, the banknotes enter the storage area 130*a* to be stored.

Figure 46:
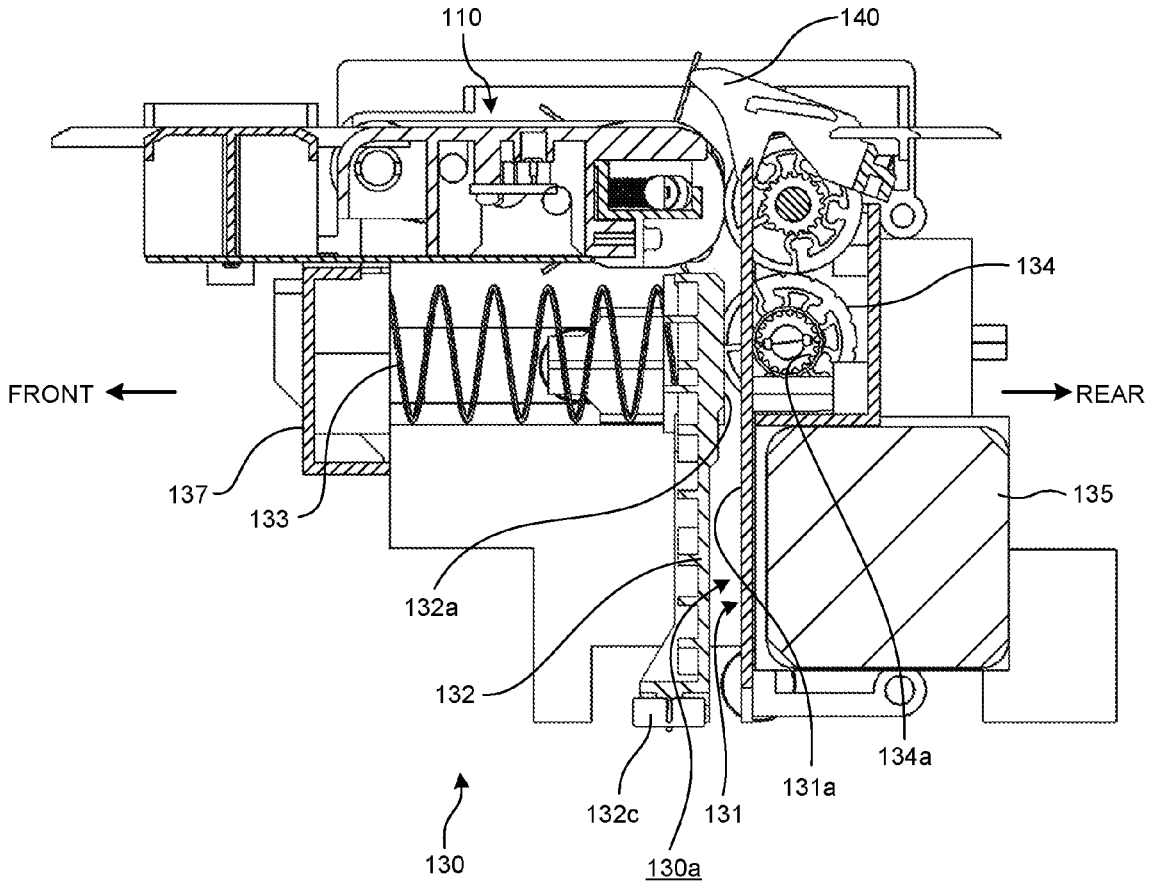
FIG. 46 is a longitudinal sectional view illustrating the second storage unit from the front.

When the banknotes of the corresponding denomination are stored in this manner, the motor 135 stops driving based on an instruction from the control unit. Consequently, the kick rollers 134 stop rotating, and the actuator also stops driving. Thus, as illustrated in FIG. 46, in the storage unit 130, the slide member 132 slidably moves toward the rear by the slide energizing member 133, and the action surface 132*a* presses the banknotes in the storage area 130*a* against the storage surface 131*a* of the storage wall 131.

When a dispensing instruction of the banknotes of the corresponding denomination is given, in the storage unit 130, the distribution gate 140 swings upward, the motor 135 is driven, and the kick rollers 134 are rotated in the clockwise direction when viewed from the right. Consequently, the banknotes in the storage area 130*a* can be delivered to the conveyance path 110 one by one.

As illustrated in FIG. 27 and the like, the dispensing box 150 is provided at the front end portion of the device main body 3, and above the depositing unit 80. The dispensing box 150 receives the banknotes that are delivered to the conveyance path 110 from the storage unit 130 for conveyance, that are determined by the determining unit 122, and that have passed through a dispensing path 110*b* continuing to the conveyance path 110. The dispensing box 150 then dispenses the banknotes to the outside from a dispensing port, which is not illustrated.

As described above, in the depositing unit 80, the depositing path 81 is gradually inclined downward as the depositing path 81 is away from the depositing port 3*a*. Consequently, the extension length of the depositing path 81 can be secured without increasing the length of the depositing path 81 in the vertical direction. Also, in the standby state, the stopper member 90 moves forward toward the depositing path 81, and the depositing path 81 and the discharge path 3*c* are communicably connected via the discharge openings 94 and 95. Furthermore, the pressing member 100 moves rearward from the depositing path 81. Consequently, when foreign matters such as a coin is fed to the depositing path 81 from the depositing port 3*a*, the foreign matters can be discharged by dropping the foreign matters to the discharge path 3*c* from the discharge openings 94 and 95. As a result, the depositing unit 80 described above can reduce the overall size of the device while allowing the foreign matters to be discharged.

In the storage unit 130 described above, the slide energizing member 133 is disposed at the same height level as that of the kick rollers 134. Also, the slide energizing member 133 is disposed so as to face a part of the outer peripheral surface of the kick rollers 134 projecting from the storage surface 131*a*, while the slide member 132 is interposed therebetween. Consequently, the energizing force of the slide energizing member 133 passes through the center axis of the kick rollers 134, and the energizing force of the slide energizing member 133 can be applied to the kick rollers 134, without applying the rotation force or the like to the slide member 132. Also, the number of components can be reduced relative to the conventional pantograph structure. Thus, the storage unit 130 described above can reduce the manufacturing cost.

In the banknote processing device described above, the discriminating unit 120 discriminates the authenticity and denomination of the banknotes that pass through the inclination path 110*a*. Consequently, a sufficient distance can be secured between the area where the discriminating unit 120 performs discrimination and the distribution gate 140 corresponding to the storage unit 130 at the forefront. Thus, the banknote processing device described above can reduce the overall size of the device.

In particular, the storage unit 130 at the forefront is disposed in the front side of the determining unit 122. Thus, the banknotes can be stored in the storage unit 130 as follows. That is, the banknotes of denomination to be stored that are discriminated by the discriminating unit 120 are passed toward the rear by temporarily swinging the forefront distribution gate 140 downward, and are determined by the determining unit 122. The banknotes are then conveyed toward the front, and the forefront distribution gate 140 swings upward. Consequently, the banknotes can be stored in the storage unit 130.

As mentioned above, a sufficient conveyance distance can be secured between the discriminating unit 120 and the forefront distribution gate 140. Consequently, the overall size of the device can be further reduced.

The preferred first to third embodiments of the disclosure have been described above. However, some embodiments are not limited thereto, and various modifications may be made.

In the first embodiment described above, during the collecting operation, the dispensing door 16*a* always closes the dispensing port 16*b*. However, in some embodiments, also in the collecting operation, the dispensing port may be opened and closed by the dispensing door based on an instruction from the control unit.

In the second embodiment described above, the pinion 451 of the pusher member 43 and the rack 452 of the storage bottom 40B are meshed with each other, and the posture of the pusher member 43 is restricted, while the action surface 43*a* of the pusher member 43 is always in parallel with the storage surface 41*a* of the storage wall 41. However, in some embodiments, various configurations may be adopted, as long as the posture of the pusher member can be restricted, while the action surface of the pusher member is always in parallel with the storage surface of the storage wall.

In the second embodiment described above, the slide member 54 slides toward the front by being linked to the dispensing door 53 swinging downward, and the slide member 54 slides toward the rear by being linked to the dispensing door 53 swinging upward. However, in some embodiments, the slide member need not be linked to the movement of the dispensing door. The slide member may slide toward the rear when the dispensing port is opened, and slide toward the front when the dispensing port is closed.

In the depositing unit 80 of the third embodiment described above, in the standby state, the stopper member 90 moves forward toward the depositing path 81 while the pressing member 100 moves rearward from the depositing path 81. However, in the some embodiments, in the standby state, not only the stopper member but also the pressing member may move forward toward the depositing path. In this case, foreign matters can be discharged, by only moving the pressing member rearward from the depositing path afterward.

In the storage unit 130 of the third embodiment described above, the slide energizing member 133 is disposed at the same height level as that of the kick rollers 134, and the slide energizing member 133 is disposed so as to face a part of the outer peripheral surface of the kick rollers 134 projecting from the storage surface 131*a*, while the slide member 132 is interposed therebetween. However, in the some embodiments, the number of the energizing unit, the number of the kick roller, or the like is not particularly limited, as long as the slide energizing member is disposed at the same height level as that of the kick rollers, and the energizing force of the slide energizing member passes through the axis of the kick rollers.

In some embodiments, when a collecting instruction is given, the dispensing box collects the banknotes that are stored in the storage units. Consequently, the dispensing box also functions as a conventional collecting unit. As a result, the installation space of the collecting unit can be reduced, thereby reducing the overall size of the device.

In some embodiments, the discriminating unit discriminates the authenticity and denomination of the banknotes that pass the inclination path being gradually inclined upward as the inclination path is away from the outlet of the depositing unit. Consequently, a sufficient distance can be secured between the area where the discriminating unit performs discrimination and the distribution gate member of the storage unit. As a result, the overall size of the device can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A banknote processing device, comprising:

a plurality of storage units configured to store a banknote having a predetermined condition in a storage unit corresponding to the banknote among the plurality of storage units when the banknote is fed through a depositing port provided on a device main body; and a dispensing box configured to discharge the banknote through a dispensing port provided on the dispensing box by conveying the banknote, which is sent from the storage unit, to the dispensing box when a dispensing instruction is given, wherein the dispensing box is configured to collect the banknote being stored in the storage units when a collecting instruction is given.

2. The banknote processing device according to claim 1, wherein the dispensing box includes:

a dispensing door configured to open and close the dispensing port; and a dispensing lock unit configured to:

be in a locked state for restricting the dispensing door to move in an opening direction in a normal state; and be in a non-locked state for allowing the dispensing door to move in the opening direction when a releasing operation is performed, the banknote processing device further comprising:

a lock mechanism configured to turn the dispensing lock unit in the locked state in the normal state and turn the dispensing lock unit in the non-locked state when a releasing instruction is given, while the dispensing box is mounted on the device main body.

3. The banknote processing device according to claim 1, further comprising a guide unit configured to:

be communicably connected to the depositing port when the dispensing box is mounted on the device main body; and be such that a part of the guide unit functions as a gripping unit when the dispensing box is removed from the device main body.

4. The banknote processing device according to claim 1, wherein the dispensing box includes:

a dispensing door configured to open and close the dispensing port; and a slide member configured to form a lower edge portion of the dispensing port and slidably provided along a front-to-rear direction, wherein the slide member is configured to slide forward when the dispensing door closes the dispensing port, and slide rearward when the dispensing door opens the dispensing port so as to expose a lower portion of the banknote that is sent from the storage unit.

5. The banknote processing device according to claim 4, wherein the dispensing door is swingably provided around an axis, and opens the dispensing port when swinging upward, and closes the dispensing port when swinging downward; and the slide member is linked to the dispensing door via a linking member, and is configured to slide rearward when the dispensing door swings upward and slide forward when the dispensing door swings downward.

6. The banknote processing device according to claim 1, wherein the dispensing box is detachably provided in the device main body.

7. The banknote processing device according to claim 6, wherein the dispensing box includes:

a dispensing door configured to open and close the dispensing port; and a dispensing lock unit configured to:

be in a locked state for restricting the dispensing door to move in an opening direction in a normal state; and be in a non-locked state for allowing the dispensing door to move in the opening direction when a releasing operation is performed, the banknote processing device further comprising:

a lock mechanism configured to turn the dispensing lock unit in the locked state in the normal state and turn the dispensing lock unit in the non-locked state when a releasing instruction is given, while the dispensing box is mounted on the device main body.

8. The banknote processing device according to claim 6, further comprising a guide unit configured to:

be communicably connected to the depositing port when the dispensing box is mounted on the device main body; and be such that a part of the guide unit functions as a gripping unit when the dispensing box is removed from the device main body.

9. The banknote processing device according to claim 6, wherein the dispensing box includes:

a dispensing door configured to open and close the dispensing port; and a slide member configured to form a lower edge portion of the dispensing port and slidably provided along a front-to-rear direction, wherein the slide member is configured to slide forward when the dispensing door closes the dispensing port, and slide rearward when the dispensing door opens the dispensing port so as to expose a lower portion of the banknote that is sent from the storage unit.

10. The banknote processing device according to claim 9, wherein the dispensing door is swingably provided around an axis, and opens the dispensing port when swinging upward, and closes the dispensing port when swinging downward; and the slide member is linked to the dispensing door via a linking member, and is configured to slide rearward when the dispensing door swings upward and slide forward when the dispensing door swings downward.

* * * * *